US006265118B1

(12) United States Patent
Taguchi

(10) Patent No.: US 6,265,118 B1
(45) Date of Patent: Jul. 24, 2001

(54) IMAGE ELEMENT AND IMAGE FORMATION METHOD

(75) Inventor: Keiichi Taguchi, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/492,793

(22) Filed: Jan. 28, 2000

(30) Foreign Application Priority Data

Jan. 28, 1999 (JP) ..... 11-020853

(51) Int. Cl.[7] ..... G03C 8/10; G03C 8/26; G03C 8/40; G03C 8/36; G03C 7/413

(52) U.S. Cl. ..... 430/17; 430/203; 430/216; 430/218; 430/238; 430/371; 430/380; 430/545; 430/551

(58) Field of Search ..... 430/203, 216, 430/218, 551, 213, 545, 371, 380, 17, 238

(56) References Cited

U.S. PATENT DOCUMENTS

| | | | | |
|---|---|---|---|---|
| 4,465,757 | * | 8/1984 | Leppard et al. | 430/216 |
| 4,814,255 | * | 3/1989 | Vanmaele et al. | 430/213 |
| 5,023,162 | * | 6/1991 | Yamanouchi et al. | 430/213 |
| 5,049,473 | * | 9/1991 | Furuya et al. | 430/216 |
| 5,871,880 | * | 2/1999 | Makuta et al. | 430/218 |
| 5,976,756 | * | 11/1999 | Nakamura et al. | 430/218 |
| 6,010,819 | * | 1/2000 | Arakatsu et al. | 430/216 |
| 6,013,421 | * | 1/2000 | Nakamura et al. | 430/203 |

* cited by examiner

*Primary Examiner*—Richard L. Schilling
(74) *Attorney, Agent, or Firm*—Sughrue, Mion, Zinn, Macpeak & Seas, PLLC

(57) ABSTRACT

There is disclosed an image element wherein a dye, formed or released by reaction with an oxidized product of specific a compound, and specific a fixed compound, coexist in a binder on a support. The image element can have high color density in image, and it can be excellent in light fastness. Furthermore, there is also disclosed an image formation method to provide the image element.

13 Claims, No Drawings

IMAGE ELEMENT AND IMAGE FORMATION METHOD

FIELD OF THE INVENTION

The present invention relates to a color diffusion transfer image element and an image formation method.

BACKGROUND OF THE INVENTION

It is known that a silver halide photographic light-sensitive material is subjected to heat-development to form an image, which is described, for example, in "Shashin Kogaku no Kiso," Hi-ginen Shashin-hen, (1982, published by Korona-sha), pages 242 to 255, and in U.S. Pat. No. 4,500,626.

Further, heat-developable light-sensitive materials wherein use is made of silver halides are a conventionally widely practiced photographic means, because they are excellent in photographic properties, such as sensitivity and gradation, in comparison with the electrophotographic technique, the diazo photographic technique, and the like. For the method of obtaining a color image by subjecting to heat-development a silver halide light-sensitive material, many proposals are made, one of which is a color-development system of forming a dye image by the coupling reaction of the oxidized product of a developing agent and a coupler. With respect to the developing agent and the coupler that can be used in this color-development system, for example, a combination of a p-phenylenediamine-series reducing agent with a phenol or with an active methylene coupler is proposed in U.S. Pat. No. 3,531,256, a p-aminophenol-series reducing agent is proposed in U.S. Pat. No. 3,761,270, and a combination of a sulfonamidophenol-series reducing agent with a four-equivalent coupler is proposed in U.S. Pat. No. 4,021,240.

This method is, however, accompanied by such defects as that color formation at the undeveloped part of undeveloped silver halides remaining after the processing occurs at the time of printing out or with the lapse of time, and that color contamination occurs due to the simultaneous presence of reduced silver and a dye image at the exposed part. To solve these defects, a dye transfer system is proposed, wherein a diffusion dye is formed by heat development and is transferred to an image-receiving layer.

In such a diffusion transfer-type heat-developable light-sensitive material, there are a case wherein an image-receiving layer capable of receiving a dye is formed on the base of the light-sensitive material, and a case wherein an image-receiving layer is formed on a base different from that of the light-sensitive material.

Particularly when use is made of a heat-developable color light-sensitive material, for the purpose of obtaining a dye image high in color purity, it is desirable to use an image-receiving material having a dye image-receiving layer formed on a separate base, to cause the dye to be diffused and transferred, either simultaneously with the formation of the diffusion dye by the color development, or after the formation of the diffusion dye.

The method wherein a diffusible dye is released or formed imagewise by heat development and the resultant diffusible dye is transferred to a dye-fixing element is proposed. In this method, by changing the type of the dye-providing compound to be used or the type of the silver halide to be used, a negative dye image, as well as a positive dye image, can be obtained. More details are described, for example, in U.S. Pat. Nos. 4,500,625, 4,483,914, 4,503,137, 4,559,290, JP-A-58-149046 ("JP-A" means unexamined published Japanese patent application), JP-A-60-133449, JP-A-59-218443, JP-A-61-238056, EP-A-220 746 (A2), Kokai-giho No. 87-6199, EP-A-210 660 (A2), and the like. These are accompanied by the problem that the sensitivity of the light-sensitive material is lowered, because a color-formed dye has previously been fixed in a dye-providing substance, and it therefore is preferable to realize a system wherein an originally colorless coupler and a developing agent are reacted, to allow the intended dye to diffuse.

As means of forming an image by the above coupling system, heat-developable light-sensitive materials containing a coupler and a color-developing agent precursor capable of releasing a p-phenylenediamine are disclosed, for example, in JP-B-63-36487 ("JP-B" means examined Japanese patent publication), JP-A-5-224381, and JP-A-6-83005; a combination of a ureidoanilin-series reducing agent with an active methylene-type coupler is disclosed in JP-A-59-111148; and a light-sensitive material, wherein use is made of a coupler that has a coupling split-off group with a polymer chain and that can release a diffusion dye by color development, is disclosed in JP-A-58-149047.

However, color-developing agents or color-developing agent precursors, used in these literatures, had such problems that the fastness to light of images during the storage was poor, as well as insufficient density of dye images after the transfer. In these meanings, there has been a need for technology that enables to attain excellent fastness and transfer density of image, compatibly.

SUMMARY OF THE INVENTION

An object of the present invention is to provide a color diffusion transfer image element. In particular, an object of the present invention is to provide a method of forming image, in which dyes are formed or released by coupling reaction and a dye image is obtained by diffusion transfer, and to provide thereby obtainable image element that is excellent in fastness to light of image.

Other and further objects, features, and advantages of the invention will appear more fully from the following description.

DETAILED DESCRIPTION OF THE INVENTION

After earnest study, the inventor of the present invention found that the object mentioned above could be attained by the methods indicated in the following.

(1) An image element wherein a dye, formed or released by reaction with an oxidized product of a compound represented by the following formula (I), and a fixed compound represented by the following formula (II), coexist in a binder on a support:

formula (I)

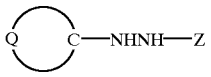

wherein, Z represents a carbamoyl group, an acyl group, an alkoxycarbonyl group, an aryloxycarbonyl group, a sulfonyl group, or a sulfamoyl group, and Q represents a group of atoms that, together with the C, form an unsaturated ring;

formula (II)

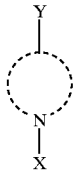

wherein the ring structure containing the N represents a nitrogen-containing nonaromatic ring having at least three ring members, X represents a hydrogen atom, an alkoxy group, an aryloxy group, an oxy radical group, a hydroxyl group, or a group capable of forming an imino group or a hydroxyimino group by hydrolysis, and Y represents a group that is capable of causing chemical reaction with a reactive group contained in the binder, to form a covalent bond;

(2) The image element as described in the above (1), wherein the compound represented by formula (I) is a compound represented by the following formula (Ia):

formula (Ia)

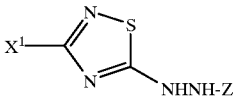

wherein $X^1$ represents a halogen atom, an alkyl group, an aryl group, a heterocyclic group, an alkylthio group, an arylthio group, a heterocyclic thio group, an alkylsulfinyl group, an arylsulfinyl group, an alkylsulfonyl group, an arylsulfonyl group or a sulfamoyl group and Z has the same meanings as defined in the formula (I);

(3) The image element as described in the above (1), wherein the binder comprises at least one mordant polymer;

(4) The image element as described in the above (3), wherein the reactive group which can react with Y, to fix the compound represented by the formula (II), is contained in the mordant polymer;

(5) The image element as described in the above (3) or (4), wherein the mordant polymer comprises tertiary nitrogen atoms;

(6) The image element as described in the above (1), (2), (3), (4), or (5), wherein the ring structure containing the N in the formula (II) is a pyrrolidine ring or a piperidine ring; and (7) A method of forming a color diffusion transfer image, in which a light-sensitive material having a light-sensitive silver halide, a binder, a compound represented by the following formula (I), and a compound which reacts with an oxidized product of a compound represented by the formula (I) to form or release a diffusion dye, on a support, is developed after exposure, and the formed or released diffusion dye is transferred on a dye-fixing layer, wherein the dye-fixing layer comprises a mordant polymer and a compound represented by the following formula (II):

formula (I)

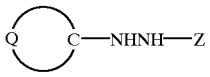

wherein, Z represents a carbamoyl group, an acyl group, an alkoxycarbonyl group, an aryloxycarbonyl group, a sulfonyl group, or a sulfamoyl group, and Q represents a group of atoms that, together with the C, form an unsaturated ring:

formula (II)

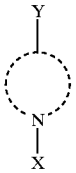

wherein the ring structure containing the N represents a nitrogen-containing nonaromatic ring having at least three ring members, X represents a hydrogen atom, an alkoxy group, an aryloxy group, an oxy radical group, a hydroxyl group, or a group capable of forming an imino group or a hydroxyimino group by hydrolysis, and Y represents a group that is capable of causing chemical reaction with a reactive group contained in the binder, to form a covalent bond.

The compound represented by formula (I) used in the present invention will be explained more in detail.

In formula (I), Z represents a carbamoyl group, an acyl group, an alkoxycarbonyl group, an aryloxycarbonyl group, a sulfonyl group, or a sulfamoyl group. Preferred among them is a carbamoyl group, and a carbamoyl group, in which at least one substituent of two substituents on the nitrogen atom of the carbamoyl group is a hydrogen atom, is particularly preferred.

The carbamoyl group preferably has from 1 to 50 carbon atoms, and more preferably 6 to 40. Specific examples include an unsubstituted carbamoyl group, a methylcarbamoyl group, an ethylcarbamoyl group, an n-propylcarbamoyl group, a sec-butylcarbamoyl group, an n-octylcarbamoyl group, a cyclohexylcarbamoyl group, a tert-butylcarbamoyl group, a dodecylcarbamoyl group, a 3-dodecyloxypropylcarbamoyl group, an octadecylcarbamoyl group, a 3-(2,4-tert-pentylphenoxy)-propylcarbamoyl group, a 2-hexyldecylcarbamoyl group, a phenylcarbamoyl group, a 4-dodecyloxyphenylcarbamoyl group, a 2-chloro-5-dodecyloxycarbonylphenylcarbamoyl group, a naphthylcarbamoyl group, a 3-pyridylcarbamoyl group, a 3,5-bis-octyloxycarbonylphenylcarbamoyl group, a 3,5-bis-tetradecyloxyphenylcarbamoyl group, a benzyloxycarbamoyl group, and a 2,5-dioxo-1-pyrrolidinylcarbamoyl group.

The acyl group preferably has from 1 to 50 carbon atoms, and more preferably from 6 to 40. Specific examples include a formyl group, an acetyl group, a 2-methylpropanoyl group, a cyclohexylcarbonyl group, an n-octanoyl group, a 2-hexyldecanoyl group, a dodecanoyl group, a chloroacetyl group, a trifluoroacetyl group, a benzoyl group, a 4-dodecyloxybenzoyl group, a 2-hydroxymethylbenzoyl group, and a 3-(N-hydroxy-N-methylaminocarbonyl) propanoyl group.

The alkoxycarbonyl group and the aryloxycarbonyl group, respectively, preferably have from 2 to 50 carbon atoms, and more preferably from 6 to 40. Specific examples include a methoxycarbonyl group, an ethoxycarbonyl group, an isobutyloxycarbonyl group, a cyclohexyloxycarbonyl group, a dodecyloxycarbonyl group, a benzyloxycarbonyl group, a phenoxycarbonyl group, a 4-octyloxyphenoxycarbonyl group, a 2-hydroxymethylphenoxycarbonyl group, and a 4-dodecyloxyphenoxycarbonyl group.

The sulfonyl group preferably has from 1 to 50 carbon atoms, and more preferably from 6 to 40. Specific examples include a methyl sulfonyl group, a buthyl sulfonyl group, an octyl sulfonyl group, a 2-hexyl decyl sulfonyl group, a 3-dodecyl oxypropyl sulfonyl group, a 2-n-octyloxy-5-t-octyl phenyl sulfonyl group, and a 4-dodecyl oxyphenyl sulfonyl group.

The sulfamoyl group preferably has from 1 to 50 carbon atoms, and more preferably from 6 to 40 carbon atoms. Specific examples include an unsubstituted sulfamoyl group, an ethyl sulfamoyl group, a 2-ethylhexyl sulfamoyl group, a decyl sulfamoyl group, a hexadecyl sulfamoyl group, a 3-(2-ethylhexyl oxy)propyl sulfamoyl group, a (2-chloro-5-dodecyloxy carbonyl phenyl) sulfamoyl group, and a 2-tetradecyl oxyphenyl sulfamoyl group.

Q represents a group of atoms that form an unsaturated ring together with the C, in which the unsaturated ring formed is preferably a 3- to 8-membered ring, and more preferably a 5- to 6-membered ring. Preferred examples of the unsaturated ring are a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, and a thiophene ring, and a condensed ring formed from the above-mentioned rings condensed with each other is also preferably used.

Further, the above-mentioned ring may have a substituent. Examples of the substituent include a straight-chain or branched, chain or cyclic alkyl group having 1 to 50 carbon atoms (e.g. trifluoromethyl, methyl, ethyl, propyl, heptafluoropropyl, isopropyl, butyl, t-butyl, t-pentyl, cyclopentyl, cyclohexyl, octyl, 2-ethylhexyl and dodecyl); a straight-chain or branched, chain or cyclic alkenyl group having 2 to 50 carbon atoms (e.g. vinyl, 1-methylvinyl, and cyclohexene-1-yl), an alkynyl group having 2 to 50 total carbon atoms (e.g. ethynyl and 1-propynyl), an aryl group having 6 to 50 carbon atoms (e.g. phenyl, naphthyl, and anthryl), an acyloxy group having 1 to 50 carbon atoms (e.g. acetoxy, tetradecanoyloxy, and benzoyloxy), an alkoxycarbonyloxy group having 2 to 50 carbon atoms (e.g. methoxycarbonyloxy group and 2-methoxyethoxycarbonyloxy group), an aryloxycarbonyloxy group having 7 to 50 carbon atoms (e.g. phenoxycarbonyloxy group), a carbamoyloxy group having 1 to 50 carbon atoms (e.g. N,N-dimethylcarbamoyloxy), a carbonamide group having 1 to 50 carbon atoms (e.g. formamide, N-methylacetoamide, acetoamide, N-methylformamide, and benzamide), a sulfonamide group having 1 to 50 carbon atoms (e.g. methanesulfonamide, dodecanesulfonamide, benzenesulfonamide, and p-toluenesulfonamide), a carbamoyl group having 1 to 50 carbon atoms (e.g. N-methylcarbamoyl, N,N-diethylcarbamoyl, and N-mesylcarbamoyl), a sulfamoyl group having 0 to 50 carbon atoms (e.g. N-butylsulfamoyl, N,N-diethylsulfamoyl, and N-methyl-N-(4-methoxyphenyl) sulfamoyl), an alkoxy group having 1 to 50 carbon atoms (e.g. methoxy, propoxy, isopropoxy, octyloxy, t-octyloxy, dodecyloxy, and 2-(2,4-di-t-pentylphenoxy)ethoxy), an aryloxy group having 6 to 50 carbon atoms (e.g. phenoxy, 4-methoxyphenoxy, and naphthoxy), an aryloxycarbonyl group having 7 to 50 carbon atoms (e.g. phenoxycarbonyl and naphthoxycarbonyl), an alkoxycarbonyl group having 2 to 50 carbon atoms (e.g. methoxycarbonyl and t-butoxycarbonyl), an N-acylsulfamoyl group having 1 to 50 carbon atoms (e.g. N-tetradecanoylsulfamoyl and N-benzoylsulfamoyl), N-sulfamoylcarbamoyl group having 1 to 50 carbon atoms (e.g. N-methanesulfonylcarbamoyl), an alkylsulfonyl group having 1 to 50 carbon atoms (e.g. methanesulfonyl, octylsulfonyl, 2-methoxyethylsulfonyl and 2-hexyldecylsulfonyl), an arylsulfonyl group having 6 to 50 carbon atoms (e.g. benzenesulfonyl, p-toluenesulfonyl, and 4-phenylsulfonylphenylsulfonyl), an alkoxycarbonylamino group having 2 to 50 carbon atoms (e.g. ethoxycarbonylamino), an aryloxycarbonylamino group having 7 to 50 carbon atoms (e.g. phenoxycarbonylamino and naphthoxycarbonylamino), an amino group having 0 to 50 carbon atoms (e.g. amino, methylamino, diethylamino, diisopropylamino, anylino, and morpholino), an ammonio group having 3 to 50 carbon atoms (e.g. trimethylammonio and dimethylbenzylammonio), a cyano group, a nitro group, a carboxyl group, a hydroxy group, a sulfo group, a mercapto group, an alkylsulfinyl group having 1 to 50 carbon atoms (e.g. methanesulfinyl and octanesulfinyl), an arylsulfinyl group having 6 to 50 carbon atoms (e.g. benzenesulfinyl, 4-chlorophenylsulfinyl, and p-toluenesulfinyl), an alkylthio group having 1 to 50 carbon atoms (e.g. methylthio, octylthio, and cyclohexylthio), an arylthio group having 6 to 50 carbon atoms (e.g. phenylthio and naphthylthio), a ureido group having 1 to 50 carbon atoms (e.g. 3-methylureido, 3,3-dimethylureido, and 1,3-diphenylureido), a heterocyclic group having 2 to 50 carbon atoms (a 3- to 12-membered monocyclic or condensed ring containing, for example, at least one nitrogen, oxygen, or sulfur as hetero atoms, e.g. 2-furyl, 2-pyranyl, 2-pyridyl, 2-thienyl, 2-imidazolyl, morpholino, 2-quinolyl, 2-benzimidazolyl, 2-benzothiazolyl and 2-benzooxazolyl), an acyl group having 1 to 50 carbon atoms (e.g. acetyl, benzoyl and trifluoroacetyl), a sulfamoylamino group having 0 to 50 carbon atoms (e.g. N-butylsulfamoylamino and N-phenylsulfamoylamino), a silyl group having 3 to 50 carbon atoms (e.g. trimethylsilyl, dimethyl-t-butylsilyl and triphenylsilyl) and a halogen atom (e.g. fluorine atom, chlorine atom, and bromine atom). The substituent described above may further have a substituent, and those substituents mentioned above can be mentioned as examples for such a substituent.

The number of carbon atoms of the substituent is preferably 50 or below, more preferably 42 or below, and further preferably 30 or below.

Further, in order for the dye produced by the reaction of the color-developing agent with the coupler to have sufficient diffusion property, the total number of carbon atoms in the unsaturated ring formed with Q and C, and its substituents, is preferably 1 or more but 30 or less, more preferably 1 or more but 24 or less, and most preferably 1 or more but 18 or less.

When the ring formed with Q and the C consists only of carbon atoms, on which the substituents are present (e.g. a benzene ring, a naphthalene ring, and an anthrathene ring), the sum of the σ values of the Hammett's substituent constant (σp value is used when the substituent is at 1,2, 1, 4, . . . relation for the C and σm value is used when the substituent is at 1,3, 1,5, . . . relation for the C) for all substituents is preferably 0.8 or more, more preferably 1.2 or more, and most preferably 1.5 or more. The sum is preferably 4.0 or below, more preferably 3.5 or below, and most preferably 3.0 or below.

Herein, Hammett substituent constants σp and σm are described in detail in such books as "Hammett Soku/Kozo to Hannousei," written by Naoki Inamoto (Maruzen); "Shinjikken Kagaku-koza 14/Yukikagoubutsu no Gosei to Hanno V," page 2605 (edited by Nihonkagakukai, Maruzen); "Riron Yukikagaku Kaisetsu," written by Tadao Nakaya, page 217 (Tokyo Kagakudojin); and "Chemical Review" (Vol. 91), pages 165 to 195 (1991).

The compound represented by formula (I) is preferably a compound represented by formula (Ia).

In the formula (Ia), $X^1$ represents a halogen atom (e.g., fluorine atom, chlorine atom and bromine atom); an alkyl group (preferably a straight-chain, branched or cyclic alkyl group having 1 to 32 carbon atoms, such as methyl, ethyl, propyl, isopropyl, butyl, t-butyl, 1-octyl, tridecyl, cyclopropyl, cyclopentyl, cyclohexyl, 1-norbornyl and 1-adamantyl); an aryl group (preferably an aryl group having 6 to 32 carbon atoms, such as phenyl, 1-naphthyl and 2-naphthyl); a heterocyclic group (preferably a 5 to 8-membered heterocyclic group having 1 to 32 carbon atoms, such as 2-thienyl, 4-pyridyl, 2-furyl, 2-pyrimidinyl, 2-pyridyl, 2-benzothiazolyl, 1-imidazolyl, 1-pyrazolyl and benzotriazole-2-yl); an alkylthio group (preferably an alkylthio group having 1 to 32 carbon atoms, such as methylthio, ethylthio, octylthio, benzylthio and cyclohexylthio); an arylthio group (preferably an arylthio group having 6 to 32 carbon atoms, such as phenylthio and 1-naphthylthio); a heterocyclicthio group (preferably a heterocyclicthio group having 1 to 32 carbon atoms, such as 2-benzothiazolylthio, 2-pyridylthio and 1-phenyltetrazolylthio); an alkylsulfinyl group (preferably an alkylsulfinyl group having 1 to 32 carbon atoms, such as methylsulfinyl, benzylsulfonyl and dodecanesulfinyl); an arylsulfinyl group (preferably an arylsulfinyl group having 6 to 32 carbon atoms, such as phenylsulfinyl); an alkylsulfonyl group (preferably an alkylsulfonyl group having 1 to 32 carbon atoms, such as methylsulfonyl, octylsulfonyl, benzylsulfonyl and cyclohexylsulfonyl); arylsulfonyl group (preferably an arylsulfonyl group having 6 to 32 carbon atoms, such as phenylsulfonyl and 1-naphthylsulfonyl); or a sulfamoyl group (preferably a sulfamoyl group having 32 or less carbon atoms, such as sulfamoyl, N,N-dipropylsulfamoyl and N-ethyl-N-dodecylsulfamoyl).

The group represented by $X^1$ may have a substituent. Preferable examples of the substituent include a halogen atom (e.g., fluorine atom, chlorine atom and bromine atom); an alkyl group (preferably a straight-chain, branched or cyclic alkyl group having 1 to 32 carbon atoms, such as methyl, ethyl, propyl, isopropyl, butyl, t-butyl, 1-octyl, tridecyl, cyclopropyl, cyclopentyl, cyclohexyl, 1-norbornyl and 1-adamantyl); an alkenyl group (preferably an alkenyl group having 2 to 32 carbon atoms, such as vinyl, allyl and 3-butene-1-yl); an aryl group (preferably an aryl group having 6 to 32 carbon atoms, such as phenyl, 1-naphthyl and 2-naphthyl); a heterocyclic group (preferably a 5- to 8-membered heterocyclic group having 1 to 32 carbon atoms, such as 2-thienyl, 4-pyridyl, 2-furyl, 2-pyrimidinyl, 2-pyridyl, 2-benzothiazolyl, 1-imidazolyl, 1-pyrazolyl and benzotriazole-2-yl); a cyano group; a silyl group (preferably a silyl group having 3 to 32 carbon atoms, such as trimethylsilyl, triethylsilyl, tributylsilyl, t-butyldimethylsilyl and t-hexyldimethylsilyl); a hydroxyl group; a nitro group; an alkoxy group (preferably an alkoxy group having 1 to 32 carbon atoms, such as methoxy, ethoxy, 1-butoxy, 2-butoxy, isopropoxy, t-butoxy, dodecyloxy, cyclopentyloxy and cyclohexyloxy); and an aryloxy group (preferably an aryloxy groups having 6 to 32 carbon atoms, such as phenoxy and 2-naphthoxy).

a heterocyclic oxy group (preferably a heterocyclic oxy group having 1 to 32 carbon atoms, e.g., 1-phenyltetrazol-5-oxy, 2-tetrahydropyranyloxy, and 2-furyloxy), a silyloxy group (preferably a silyloxy group having 1 to 32 carbon atoms, e.g., trimethylsilyloxy, t-butyldimethylsilyloxy, and diphenylmethylsilyloxy), an acyloxy group (preferably an acyloxy group having 2 to 32 carbon atoms, e.g., acetoxy, pivaloyloxy, benzoyloxy, and dodecanoyloxy), an alkoxycarbonyloxy group (preferably an alkoxycarbonyloxy group having 2 to 32 carbon atoms, e.g., ethoxycarbonyloxy, t-butoxycarbonyloxy, cyclohexyloxycarbonyloxy), an aryloxycarbonyloxy group (preferably an aryloxycarbonyloxy group having 7 to 32 carbon atoms, e.g., phenoxycarbonyloxy), a carbamoyloxy group (preferably a carbamoyloxy group having 1 to 32 carbon atoms, e.g., N,N-dimethylcarbamoyloxy and N-butylcarbamoyloxy), a sulfamoyloxy group (preferably a sulfamoyloxy group having 1 to 32 carbon atoms, e.g., N,N-diethylsulfamoyloxy and N-propylsulfamoyloxy), an alkylsulfonyloxy group (preferably an alkylsulfonyloxy group having 1 to 32 carbon atoms, e.g., methylsulfonyloxy, hexadecylsulfonyloxy, and cyclohexylsulfonyloxy), an arylsulfonyloxy group (preferably an arylsulfonyloxy group having 6 to 32 carbon atoms, e.g., phenylsulfonyloxy), an acyl group (preferably an acyl group having 1 to 32 carbon atoms, e.g., formyl, acetyl, pivaloyl, benzoyl, tetradecanoyl, and cyclohexylcarbonyl), an alkoxycarbonyl group (preferably an alkoxycarbonyl group having 2 to 32 carbon atoms, e.g., methoxycarbonyl, ethoxycarbonyl, octadecyloxycarbonyl, and cyclohexyloxycarbonyl), an aryloxycarbonyl group (preferably an aryloxycarbonyl group having 7 to 32 carbon atoms, e.g., phenoxycarbonyl), a carbamoyl group (preferably a carbamoyl group having 1 to 32 carbon atoms, e.g., carbamoyl, N,N-dibutylcarbamoyl, N-ethyl-N-octylcarbamoyl, N-propylcarbamoyl, and N,N-dicyclohexylcarbamoyl), an amino group (preferably an amino group having 32 or less carbon atoms, e.g., amino, methylamino, N,N-dioctylamino, tetradecylamino, octadecylamino, and cyclohexylamino), an anilino group (preferably an anilino group having 6 to 32 carbon atoms, e.g., anilino and N-methylanilino), a heterocyclic amino group (preferably a heterocyclic amino group having 1 to 32 carbon atoms, e.g., 4-pyridylamino), a carbonamido group (preferably a carbonamido group having 2 to 32 carbon atoms, e.g., acetoamido, benzamido, and tetradecanamido), an ureido group (preferably a ureido group having 1 to 32 carbon atoms, e.g., ureido, N,N-dimethylureido, and N-phenylureido), an imido group (preferably an imido group having 4 to 32 carbon atoms, e.g., N-succinimido and N-phthalimido), an alkoxycarbonylamino group (preferably an alkoxycarbonylamino group having 2 to 32 carbon atoms, e.g., methoxycarbonylamino, ethoxycarbonylamino, t-butoxycarbonylamino, octadecyloxycarbonylamino, and cyclohexyloxycarbonylamino), an aryloxycarbonylamino group (preferably an aryloxycarbonylamino group having 7 to 32 carbon atoms, e.g., phenoxycarbonylamino), a sulfonamido group (preferably a sulfonamido group having 1 to 32 carbon atoms, e.g., methanesulfonamido, butanesulfonamido, benzenesulfonamido, hexadecanesulfonamido, and cyclohexylsulfonylamino), a sulfamoylamino group (preferably a sulfamoylamino group having 1 to 32 carbon atoms, e.g., N,N-dipropylsulfamoylamino and N-ethyl-N-dodecylsulfamoylamino), an azo group (preferably an azo group having 1 to 32 carbon atoms, e.g., phenylazo), an alkylthio group (preferably an alkylthio group having 1 to 32 carbon atoms, e.g., ethylthio, octylthio, and cyclohexylthio), an arylthio group (preferably an arylthio group having 6 to 32 carbon atoms, e.g., phenylthio), a heterocyclic thio group (preferably a heterocyclic thio group having 1 to 32 carbon atoms, e.g., 2-benzothiazolylthio, 2-pyridylthio, and 1-phenyltetrazolylthio), an alkylsulfinyl group (preferably an alkylsulfinyl group having 1 to 32 carbon atoms, e.g., dodecanesulfinyl), an arylsulfinyl group (preferably an arylsulfinyl group having 6 to 32 carbon atoms, e.g., phenylsulfinyl), an alkylsulfonyl group (preferably an alkylsulfonyl group having 1 to 32 carbon atoms, e.g., methylsulfonyl, octylsulfonyl, and cyclohexylsulfonyl), an arylsulfonyl group (preferably an arylsulfonyl group having 6 to 32 carbon atoms, e.g., phenylsulfonyl and 1-naphthylsulfonyl), a sulfamoyl group (preferably a sulfamoyl group having 32 or less carbon atoms, e.g., sulfamoyl, N,N-dipropylsulfamoyl, and N-ethyl-N-dodecylsulfamoyl), a sulfo group, a phosphonyl group (preferably a phosphonyl group having 1 to 32 carbon atoms, e.g., phenoxyphosphonyl, octyloxyphosphonyl, and phenylphosphonyl), and a phosphinoylamino group (diethoxyphosphinoylamino and dioctyloxyphosphinoylamino group).

In the formula (Ia), Z has the same meanings as defined in the formula (I).

Next, a preferable range of the compound represented by the formula (Ia) is described. As the group represented by $X^1$, a halogen atom, an aryl group, a heterocyclic group, an alkylthio group, an arylthio group, an alkylsulfonyl group, an arylsulfonyl group and an arylsulfinyl group is preferable, chlorine atom, an aryl group, an alkylthio group and an arylthio group is more preferable, and an aryl group is most preferable. As the group represented by Z, a carbamoyl group is preferable and a carbamoyl group having at least one hydrogen atom on its nitrogen atom is particularly preferable.

Preferably the compound represented by the formula (Ia) have one or more groups represented by $—CO_2H$, $—NHSO_2R_a$, $—SO_2NHR_b$, $—CONHSO_2R_b$, $—SO_2NHCOR_b$, or —OH, in at least one of the groups represented by $X^1$ and Z, wherein $R_a$ represents an alkyl group, an aryl group or a heterocyclic group, and $R_b$ represents a hydrogen atom, an alkyl group, an aryl group, or heterocyclic group. Preferable carbon numbers and specific examples of these alkyl, aryl, and heterocyclic groups are the same that is given in the description of the substituents of the group represented by $X^1$. It is more preferable that the compound represented by the formula (Ia) have one or more groups represented by $—CO_2H$, $—NHSO_2R_a$, $—SO_2NHR_b$, $—CONHSO_2R_b$, $—SO_2NHCOR_b$, or —OH, in the group represented by $X^1$.

Specific examples of the color-developing agent represented by formula (I) are described below, but the scope of the present invention is not limited to them.

R-1

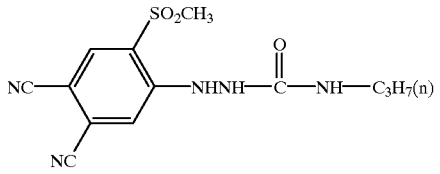

R-2

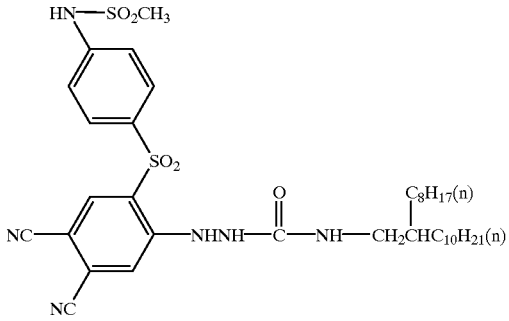

R-3

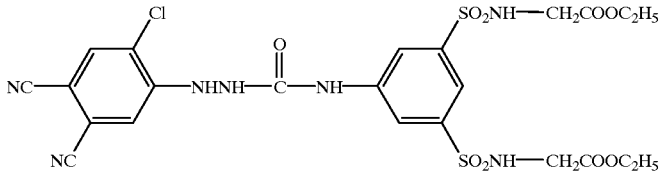

R-4

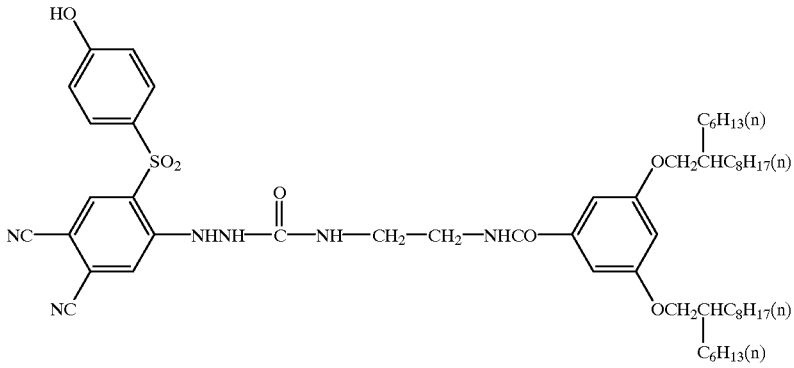

-continued
R-5
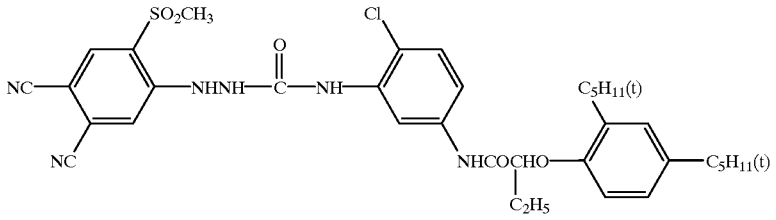
R-6
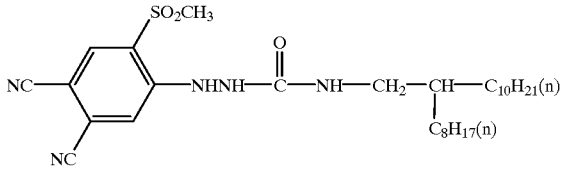
R-7
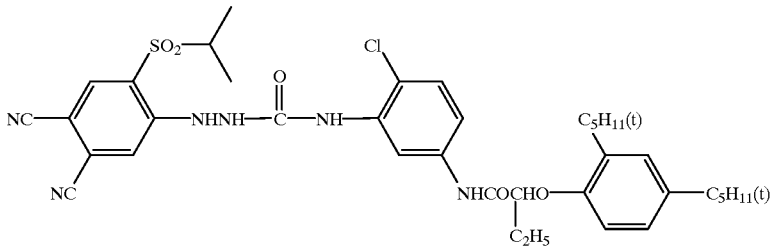
R-8
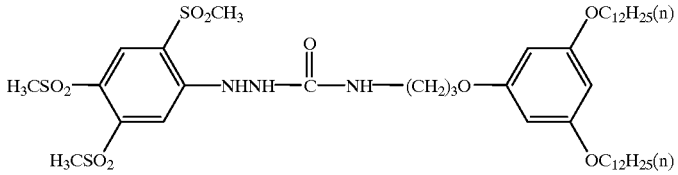
R-9
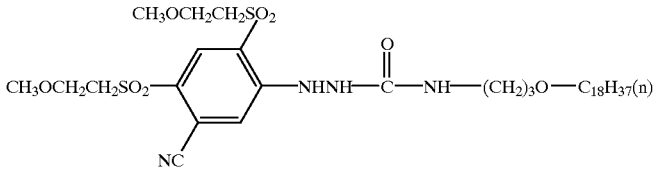
R-10
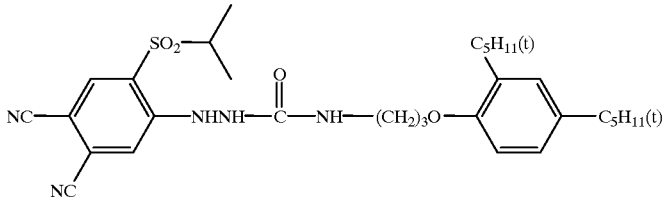
R-11
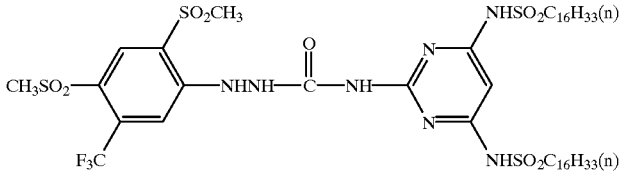

-continued
R-12
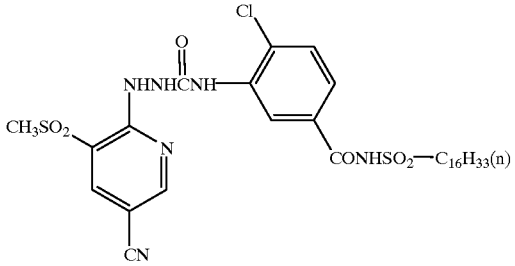
R-13
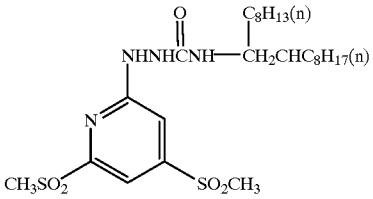
R-14
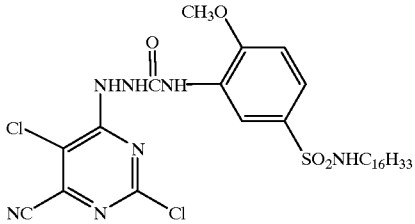
R-15
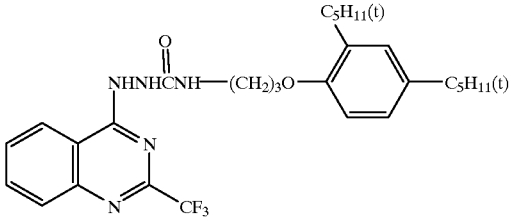
R-16
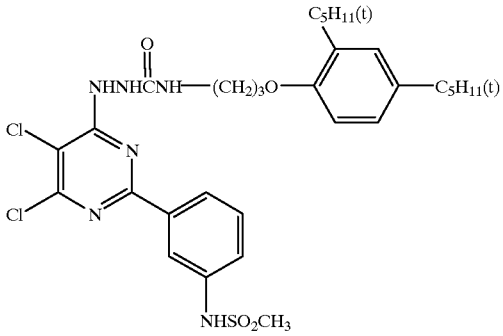
R-17
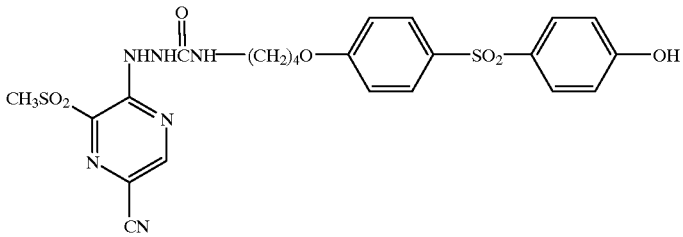
R-18
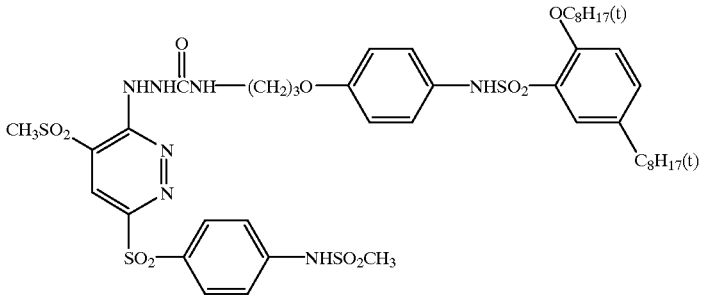

-continued
R-19
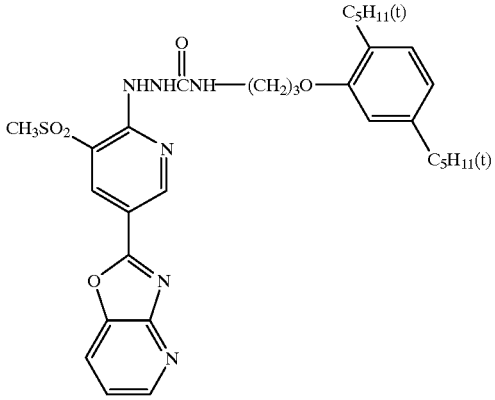
R-20
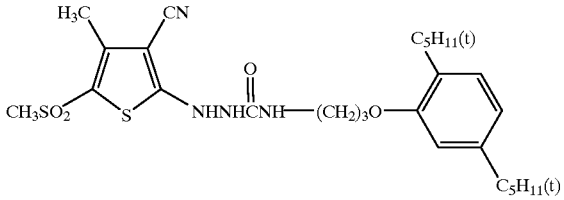
R-21
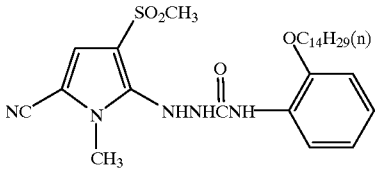
R-22
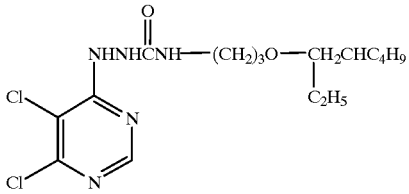
R-23
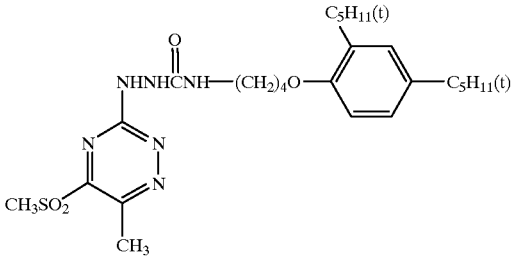
R-24
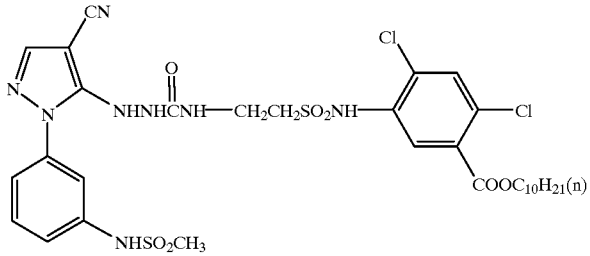
R-25
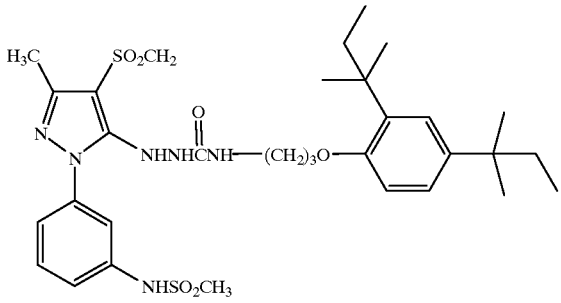

-continued
R-26
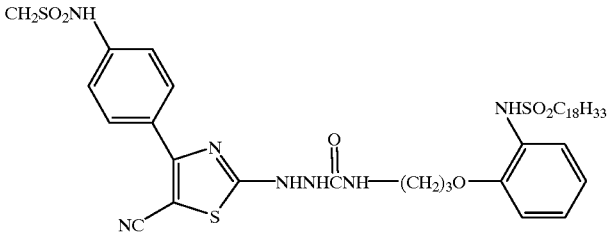
R-27
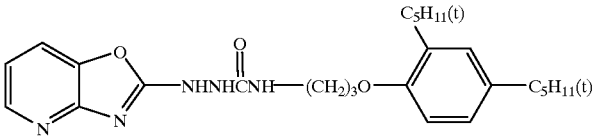
R-28
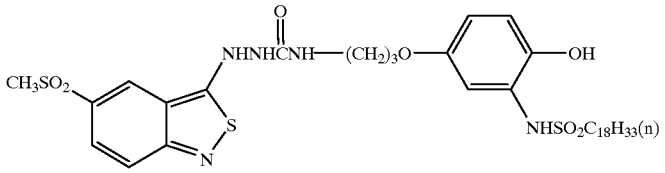
R-29
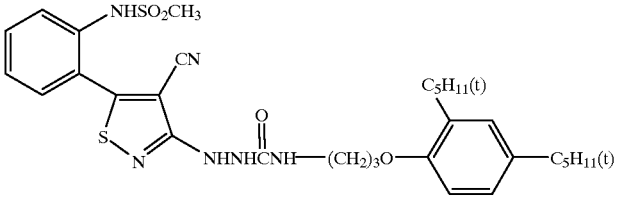
R-30
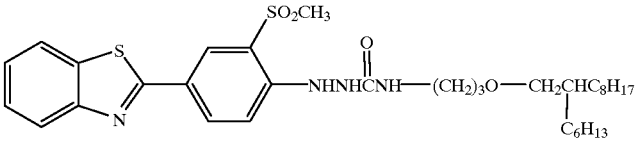
R-31
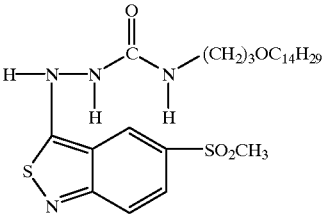
R-32
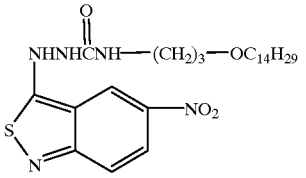
D-1
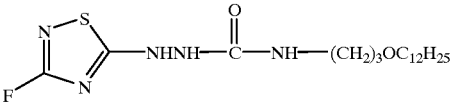
D-2
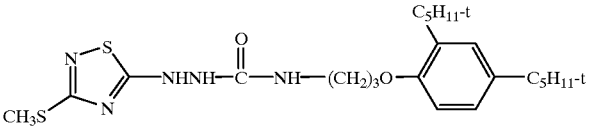
D-3
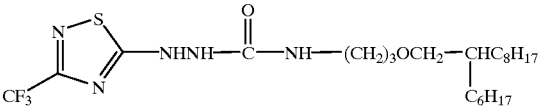
D-4
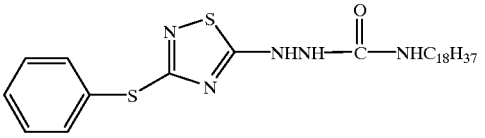

-continued
D-5
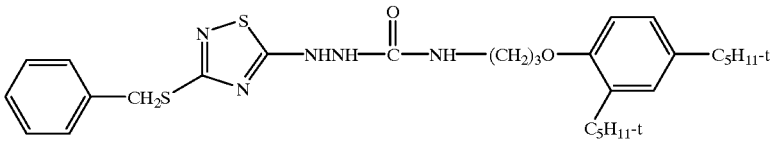
D-6
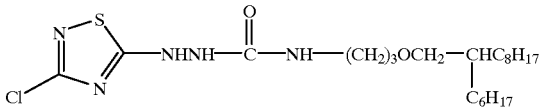
D-7
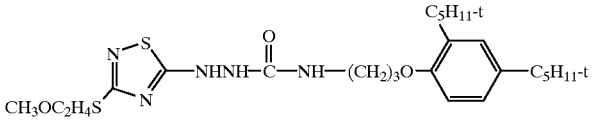
D-8
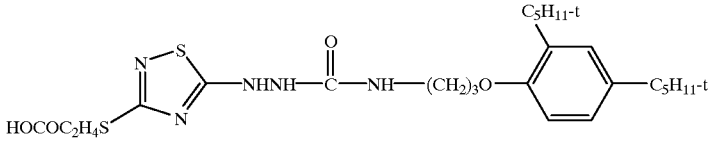
D-9
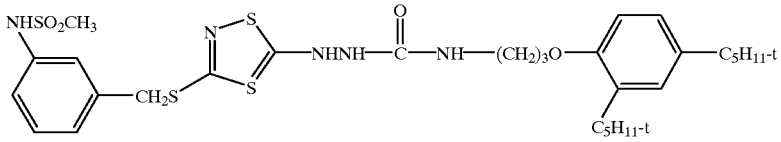
D-10
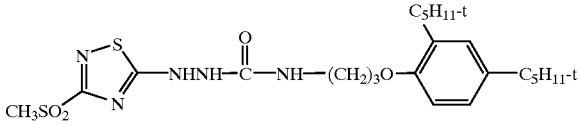
D-11
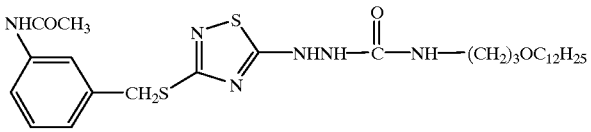
D-12
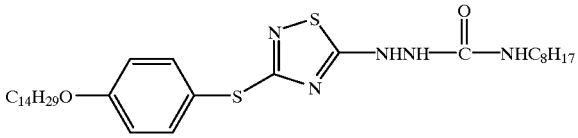
D-13
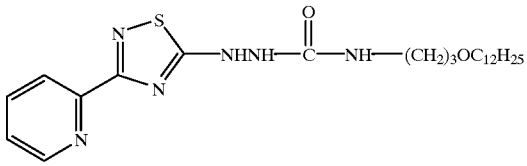
D-14
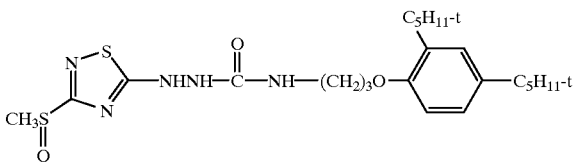
D-15
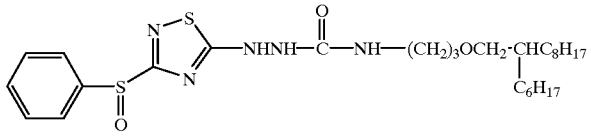
D-16
D-17
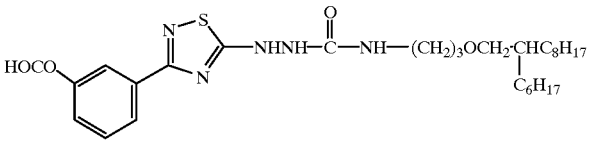
D-18
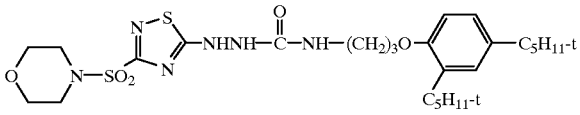
D-19
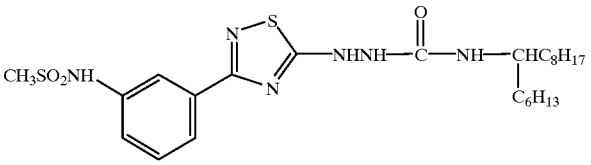
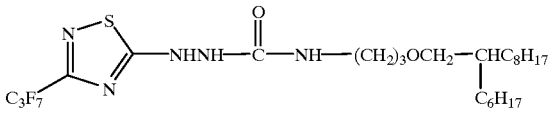

-continued
D-20
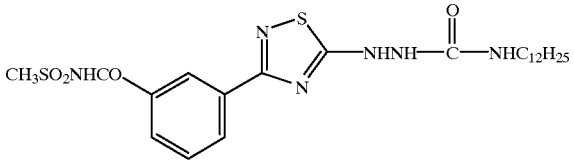
D-21
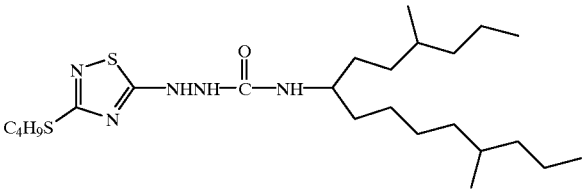
D-22
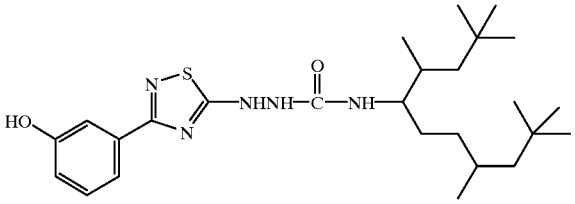
D-23
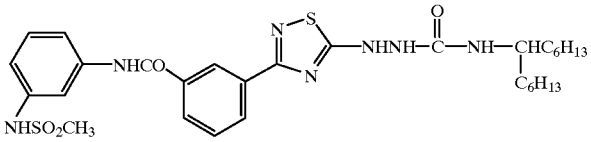
D-24
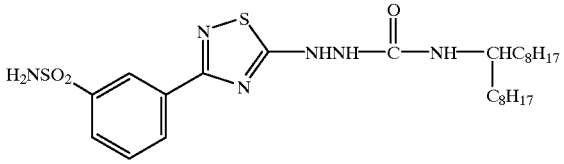
D-25
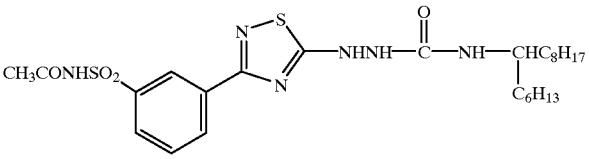
D-26
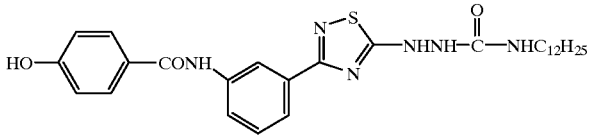
D-27
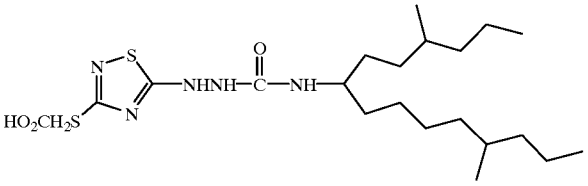
D-28
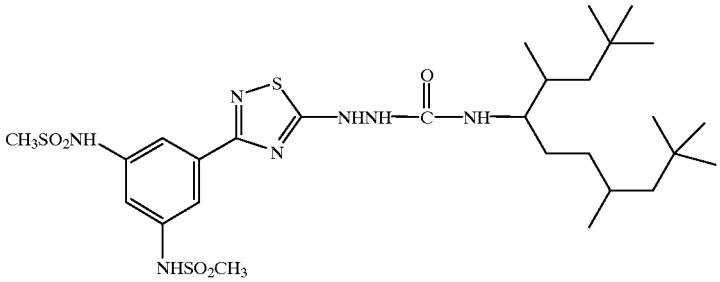
D-29
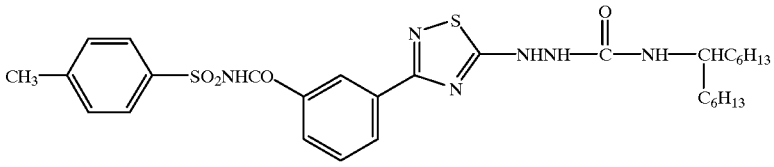

-continued

D-30

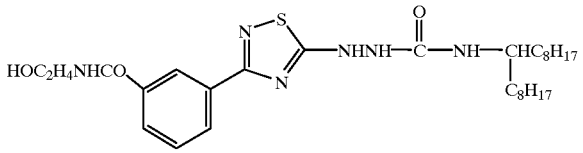

D-31

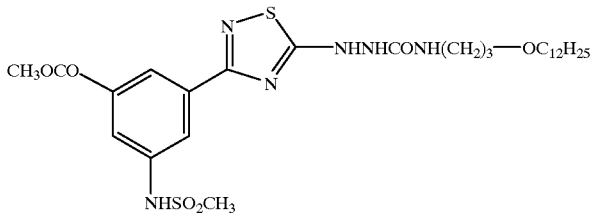

D-32

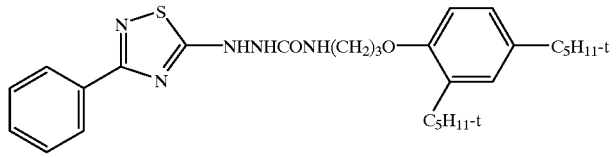

D-33

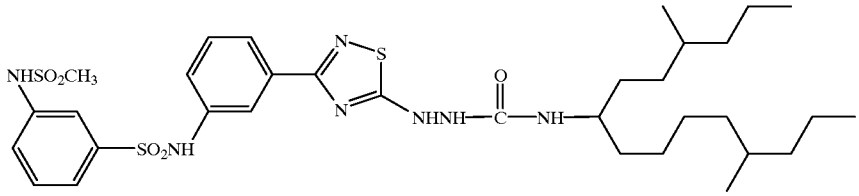

D-34

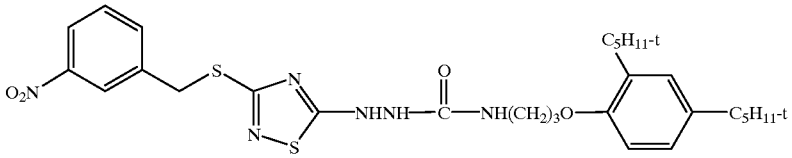

D-35

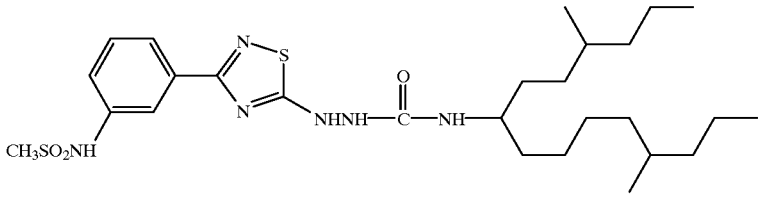

D-36

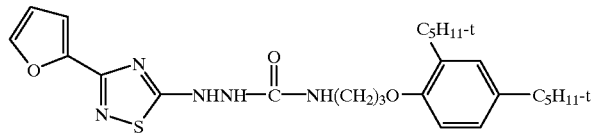

D-37

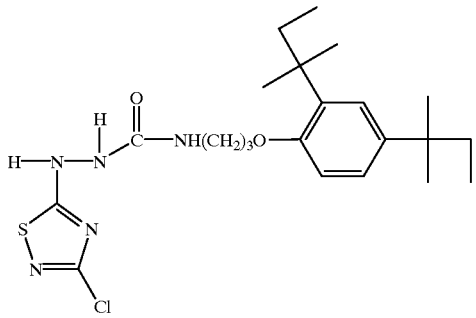

Next, general synthesis method of compounds represented by the formula (I) in the present invention are shown. Typical synthetic examples of some compounds out of the compounds used in the present invention are shown below. Other compounds can also be synthesized in the same way as that for the following examples.

Synthetic Example 1

Synthesis of Exemplified Compound R-1

The synthesis is carried out by following the below-shown synthesis route:

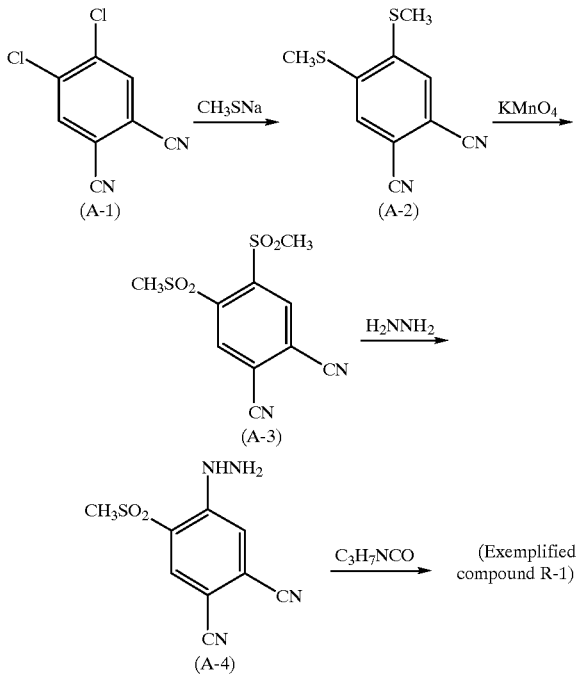

Synthesis of Compound (A-2)

53.1 g of 1,2-dichloro-4,5-dicyanobenzene (A-1) (CAS Registry No. 139152-08-2) was dissolved in 1.1 liters of N,N-dimethylformamide (DMF), and then 268 g of an aqueous methyl mercaptan sodium salt solution (15%) was added, dropwise, to the solution, at room temperature over 1 hour, followed by stirring at 60° C. for 1 hour. The reaction liquid was cooled to room temperature and poured into water, followed by stirring for 30 min. The produced white solid was filtered, washed with water, and dried. Yield: 46.5 g (78.1%).

Synthesis of Compound (A-3)

41.1 g of Compound (A-2) was suspended in 400 ml of acetic acid, and then a solution of 89.3 g of potassium permanganate in 400 ml of water was added, dropwise, over 1 hour under cooling with water. After the reaction mixture was allowed to stand overnight at room temperature, 2 liters of water and 2 liters of ethyl acetate were added thereto, and the mixture was Celite-filtered. The filtrate was separated, and the organic layer was washed with water, an aqueous sodium hydrosulfite solution, an aqueous sodium bicarbonate solution, and then brine, followed by drying over anhydrous magnesium sulfate. After filtering the dried organic layer, the solvent was distilled off, and an ethyl acetate/hexane mixed solvent was added to the residue, to effect crystallization, to obtain 29.4 g of a white solid of Compound (A-3). Yield: 55.0%.

Synthesis of Compound (A-4)

29.4 g of Compound (A-3) was dissolved in 200 ml of dimethylsulfoxide (DMSO), and 8.7 g of hydrazine monohydrate was added, dropwise, to the solution, over 15 min under cooling with water, followed by stirring for 10 min under cooling with water. The reaction liquid was poured into water, and the produced yellow solid was filtered, washed with water, and dried. Yield: 17.4 g (70.9%).

Synthesis of Exemplified Compound R-1

11.8 g of Compound (A-4) was dissolved in 50 ml of tetrahydrofuran, and 4.7 g of propyl isocyanate was added, dropwise, to the solution, at room temperature over 30 min, followed by stirring for 1 hour. The reaction mixture was poured into water, and extraction was effected with ethyl acetate. The organic layer was washed with hydrochloric acid and then brine; then it was dried over anhydrous magnesium sulfate, filtered, and the solvent was distilled off. The residue was crystallized from an ethyl acetate/hexane mixed solvent (1:10), to obtain 14.5 g of a white solid of Exemplified Compound R-1. Yield: 90.2%.

Synthetic Example 2

Synthesis of Exemplified Compound R-5

The synthesis was made by following the below-shown synthesis route:

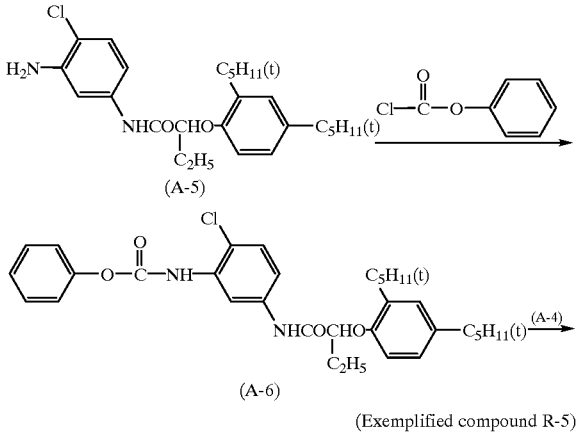

Synthesis of Compound (A-6)

44.5 g of Compound (A-5) (CAS Registry No. 51461-11-1) was dissolved in 500 ml ethyl acetate, and then a solution of 25 g of sodium bicarbonate in 500 ml of water was added to the solution. To the resulting solution was added, dropwise, 16.4 g of phenyl chlorocarbonate, at room temperature over 30 min, followed by stirring for a further 1 hour. The layers were separated, the organic layer was washed with brine and dried over anhydrous magnesium sulfate, and after filtering the dried organic layer, the solvent was distilled off, to obtain 54.0 g of a pale yellow oily matter of Compound (A-6). Yield: 95.6%.

Synthesis of Exemplified Compound R-5

5.0 g of Compound (A-4), 13.0 g of Compound (A-9), and 0.50 g of DMAP (N,N-dimethylaminopyridine) were dissolved in 100 ml of acetonitrile, and the solution was stirred at 60° C. for 3 hours. The reaction mixture was poured into water, and extraction with ethyl acetate was carried out. The organic layer was washed with an aqueous sodium bicarbonate solution, hydrochloric acid, and then brine; then it was dried over anhydrous magnesium sulfate, and after filtration of the dried organic layer was carried out, the solvent was distilled off. The residue was purified by silica gel column chromatography (eluent: ethyl acetate/hexane =1/2), and crystallization from hexane was carried out, to obtain 7.5 g of a white solid of Exemplified Compound R-5.

Synthetic Example 3

Synthesis of Exemplified Compound R-15

The synthesis was carried out by following the synthesis route shown below:

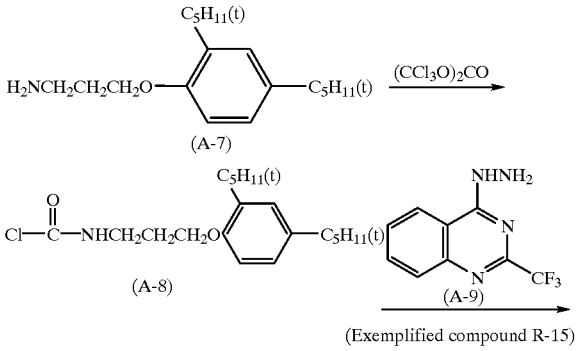

Synthesis of Exemplified Compound R-15

4.6 g of triphosgene was dissolved in 100 ml of THF, and to the solution were added, dropwise, 13.6 g of Compound (A-7) (CAS Registry No. 61053-26-7), at room temperature over 10 min, and then 18.7 ml of triethylamine, at room temperature over 10 min. Reaction was carried out for 30 min, to obtain a solution of Compound (A-8). To this solution was added 9.0 g of Compound (A-9), in portions, at room temperature over 10 min. After the reaction mixture was stirred for a further 1 hour, the reaction mixture was poured into water, and extraction with ethyl acetate was carried out. After the organic layer was washed with an aqueous sodium bicarbonate solution, hydrochloric acid, and then brine, the organic layer was dried over anhydrous magnesium sulfate. After the dried organic layer was filtered, the solvent was distilled off. The residue was purified by silica gel column chromatography, and crystallization from ethyl acetate/hexane (1:10) mixture was carried out, to obtain a white solid of Exemplified Compound R-15.

Further, Compound (A-9) was prepared in accordance with the method described in EP-A-545491(A1).

Synthetic Example 4

Synthesis of Exemplified Compound (D-19)

A method of synthesizing Exemplified compound (D-19) can refer to the method described in JP-A-9-152702. The compound was synthesized through the synthetic route described below according to the method of JP-A-9-152702. The compound (T-4) was synthesized by the synthetic method described in Japanese Patent No. 2,845,331.

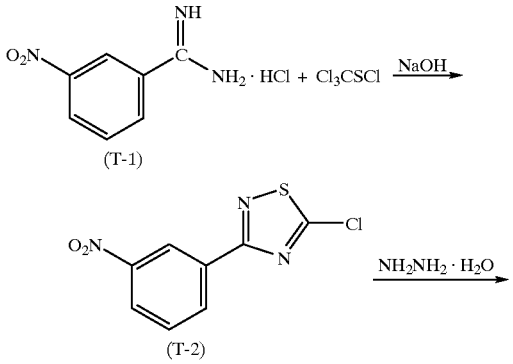

-continued

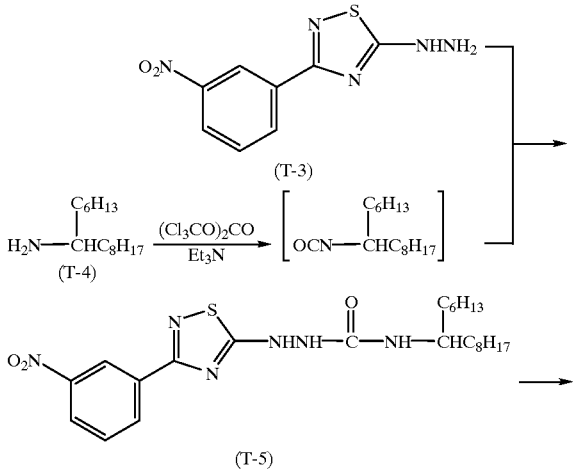

Synthesis of Compound (T-3)

110.5 g of Compound (T-1) was suspended in 1.0 l of methylene chloride, to which was then added 100 g of perchloromethylmercaptan. The reaction system was cooled to 0 to 5° C. and a solution in which 200 g of sodium hydroxide was dissolved in 600 ml of water was added dropwise to the reaction system such that the reaction temperature was kept at 15° C. or less. After the reaction, the water layer was removed and 50 g of hydrazine hydrate was added dropwise to the organic layer at 15° C. or less. After the reaction, 1.0 l of water was added to carry out extraction. The organic layer was concentrated under reduced pressure to obtain 141.1 g (yield: 57%) of Intermediate (T-3).

Synthesis of Compound (T-5)

100.5 g of triphosgene was dissolved in 2 l of tetrahydrofuran. To the mixture was dropwise added 300 g of the compound (T-4) and further 150 ml of triethylamine, under cooling. After the addition, the resulting mixture was reacted at room temperature for one hour and thereafter 237.5 g of Compound (T-3) was separately added in five lots. After the addition, the reaction mixture was further reacted for two hours. Then 2 l of ethyl acetate and 2 l of water were added to carry out extraction. Then the extract was washed again with 2 l of water two times, the organic layer was dried using magnesium sulfate anhydride and the solvent was distilled under reduced pressure. The residue was recrystallized from acetonitrile to obtain 330.2 g (yield: 55%) of Compound (T-5) as a white crystal.

Synthesis of Exemplified Compound (D-19)

28.0 g of Intermediate (T-5) was dissolved in 500 ml of ethyl acetate, 400 ml of water, and 100 ml of ethanol, to which was further added 87 g of sodium hydrosulfite. After the mixture was reacted for two hours, an extraction operation was performed. Then the extract was washed with 500 ml of water two times, the organic layer was dried using magnesium sulfate anhydride and the solvent was distilled under reduced pressure. The residue was dissolved in 100 ml of N,N-dimethylacetamide and 7 ml of triethylamine. 4.0 ml of methanesulfonyl chloride was added dropwise to the solution, under water-cooling in a manner that the internal temperature did not exceed 15° C. After the addition, the mixture was further reacted for one hour and the reaction mixture was poured into 500 ml of 1N hydrochloric acid. The precipitated crystal was subjected to filtration, washed and dried to obtain a crude crystal, which was then recrystallized from acetonitrile to obtain 24.7 g (yield: 83%) of Exemplified compound (D-19) as a white crystal.

Furthermore, for instance, Exemplified compound D-32 in the present invention can be synthesized through the following synthetic route according to Synthetic example 2 described on page 15 in the specification of JP-A-9-152702.

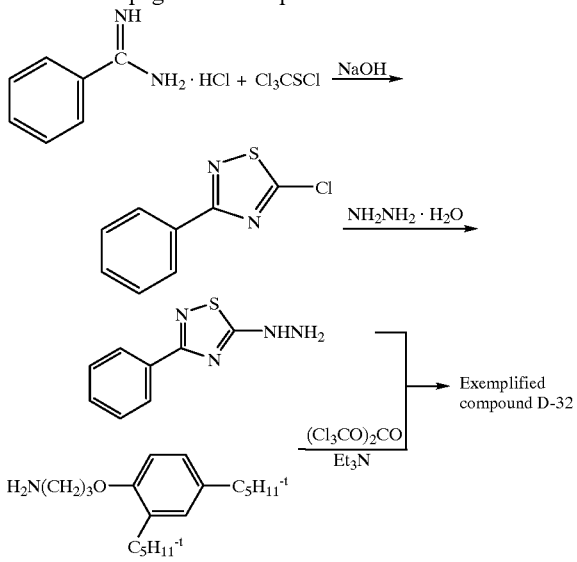

The color-developing agent in the present invention are used together with a compound (coupler) that forms or releases a diffusible dye through oxidation coupling reactions. In the present invention, it is preferably the so-called "a two-equivalent coupler" of which the coupling position is substituted, which is used in general silver salt photos using a paraphenylene diamine developing agent as a developing agent. Specific examples of the coupler are described in detail, for example, in "Theory of The Photographic Process" (4th Ed., edited by T. H. James, Macmillan, 1977), pages 291 to 334 and 354 to 361, and in JP-A-58-12353, 58-149046, 58-149047, 59-11114, 59-124399, 59-174835, 59-231539, 59-231540, 60-2951, 60-14242, 60-23474, and 60-66249.

Examples of couplers that can be preferably used in the present invention are listed below.

As couplers that are preferably used in the present invention, compounds having structures described by the following formulae (1) to (12) are mentioned. They are compounds, in general, collectively called active methylenes, pyrazolones, pyrazoloazoles, phenols, naphthols, and pyrrolotriazoles, respectively, and these compounds are known in the art.

(1)

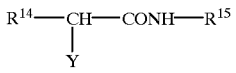

(2)

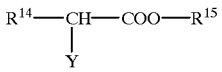

(3)

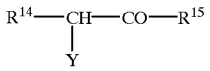

(4)

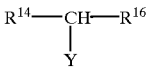

-continued (5)

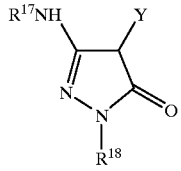

(6)

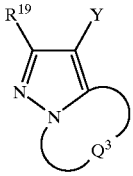

(7)

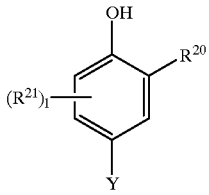

(8)

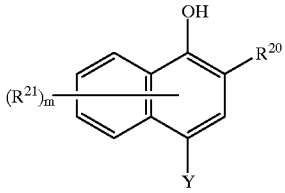

(9)

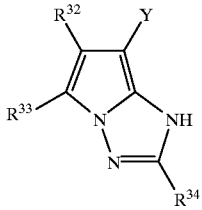

(10)

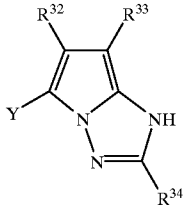

(11)

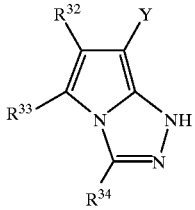

-continued (12)

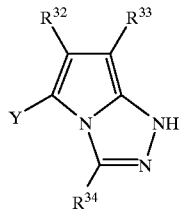

Formulae (1) to (4) represent couplers that are called active methylene couplers, which are described, for example, in U.S. Pat. Nos. 3,933,501, 4,022,620, and 4,248,961, JP-B ("JP-B" means examined Japanese patent publication) No. 58-10739, British Patent Nos. 1,425,020 and 1,476,760, U.S. Pat. Nos. 3,973,968, 4,314,023, and 4,511,649, and European Patent Nos. 249473 A. In the formulae, $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group, each of which may optionally be substituted.

In formulae (1) to (3), $R^{15}$ represents an optionally substituted alkyl group, aryl group, or heterocyclic residue. In formula (4), $R^{16}$ represents an optionally substituted aryl group or heterocyclic residue. Examples of the substituent that may be possessed by $R^{14}$, $R^{15}$, and $R^{16}$ include those mentioned for the above as examples of the substituent on the ring that is formed with Q and C.

In formulae (1) to (4), $R^{14}$ and $R^{15}$ together or $R^{14}$ and $R^{16}$ together may bond to form a ring.

Formula (5) represents a coupler that is called a 5-pyrazolone coupler, and in the formula, $R^{17}$ represents an alkyl group, an aryl group, an acyl group, or a carbamoyl group. $R^{18}$ represents a phenyl group or a phenyl group that is substituted by one or more halogen atoms, alkyl groups, cyano groups, alkoxy groups, alkoxycarbonyl groups, or acylamino groups.

Preferable 5-pyrazolone couplers represented by formula (5) are those wherein $R^{17}$ represents an aryl group or an acyl group, and $R^{18}$ represents a phenyl group that is substituted by one or more halogen atoms.

With respect to these preferable groups, more particularly, $R^{17}$ is an aryl group, such as a phenyl group, a 2-chlorophenyl group, a 2-methoxyphenyl group, a 2-chloro-5-tetradecaneamidophenyl group, a 2-chloro-5-(3-octadecenyl-1-succinimido)phenyl group, a 2-chloro-5-octadecylsulfonamidophenyl group, and a 2-chloro-5-[2-(4-hydroxy-3-t-butylphenoxy)tetradecaneamido]phenyl group; or $R^{17}$ is an acyl group, such as an acetyl group, a 2-(2,4-di-t-pentylphenoxy)butanoyl group, a benzoyl group, and a 3-(2,4-di-t-amylphenoxyacetamido)benzoyl group, any of which may have a substituent, such as a halogen atom or an organic substituent that is bonded through a carbon atom, an oxygen atom, a nitrogen atom, or a sulfur atom.

Preferably $R^{18}$ represents a substituted phenyl group, such as a 2,4,6-trichlorophenyl group, a 2,5-dichlorophenyl group, and a 2-chlorophenyl group.

Formula (6) represents a coupler that is called a pyrazoloazole coupler, and, in the formula, $R^{19}$ represents a hydrogen atom or a substituent. $Q^3$ represents a group of nonmetal atoms required to form a 5-membered azole ring containing 2 to 4 nitrogen atoms, which azole ring may have a substituent (including a condensed ring).

Preferable pyrazoloazole couplers represented by formula (6), in view of spectral absorption characteristics of the color-formed dyes, are imidazo[1,2-b]pyrazoles described in U.S. Pat. No. 4,500,630, pyrazolo[1,5-b]-1,2,4-triazoles described in U.S. Pat. No. 4,500,654, and pyrazolo[5,1-c]-1,2,4-triazoles described in U.S. Pat. No. 3,725,067.

Details of substituent $R^{19}$ and substituents of the azole rings represented by $Q^3$ are described, for example, in U.S. Pat. No. 4,540,654, the second column, line 41, to the eighth column, line 27. Preferable pyrazoloazole couplers are pyrazoloazole couplers having a branched alkyl group directly bonded to the 2-, 3-, or 6-position of the pyrazolotriazole group, as described in JP-A-61-65245, and U.S. Pat. No. 5,541,501; pyrazoloazole couplers containing a sulfonamido group in the molecule, as described in JP-A-61-65245; pyrazoloazole couplers having an alkoxyphenylsulfonamido ballasting group, as described in JP-A-61-147254; pyrazolotriazole couplers having an alkoxy group or an aryloxy group at the 6-position, as described in JP-A-62-209457 or JP-A-63-307453; and pyrazolotriazole couplers having a carbonamido group in the molecule, as described in JP-A-2-201443.

Formulae (7) and (8) are respectively called phenol couplers and naphthol couplers, and in the formulae $R^{20}$ represents a hydrogen atom or a group selected from the group consisting of —$CONR^{22}R^{23}$, —$SO_2NR^{22}R^{23}$, —$NHCOR^{22}$, —$NHCONR^{22}R^{23}$, and —$NHSO_2NR^{22}R^{23}$. $R^{22}$ and $R^{23}$ each represent a hydrogen atom or a substituent. In formulae (7) and (8), $R^{21}$ represents a substituent, 1 is an integer selected from 0 to 2, and m is an integer selected from 0 to 4. When 1 and m are 2 or more, $R^{21}$'s may be different. Examples of the substituent of $R^{21}$ to $R^{23}$ include those mentioned for the above as examples of the substituent of the ring that is formed with Q and C.

Preferable examples of the phenol couplers represented by formula (7) include 2-acylamino-5-alkylphenol couplers described, for example, in U.S. Pat. Nos. 2,369,929, 2,801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West Germany Patent Publication No. 3 329 729, and JP-A-59-166956; and 2-phenylureido-5-acylaminophenol couplers described, for example, in U.S. Pat. Nos. 3,446,622, 4,333,999, 4,451,559, and 4,427,767.

Preferable examples of the naphthol couplers represented by formula (8) include 2-carbamoyl-1-naphthol couplers described, for example, in U.S. Pat. Nos. 2,474,293, 4,052,212, 4,146,396, 4,282,233, and 4,296,200; and 2-carbamoyl-5-amido-1-naphthol couplers described, for example, in U.S. Pat. No. 4,690,889.

Formulas (9) to (12) are couplers called pyrrolotriazoles, and $R^{32}$, $R^{33}$, and $R^{34}$ each represent a hydrogen atom or a substituent. Examples of the substituent of $R^{32}$, $R^{33}$, and $R^{34}$ include those mentioned for the above as examples of the substituent on the ring that is formed with Q and C. Preferable examples of the pyrrolotriazole couplers represented by formulae (9) to (12) include those wherein at least one of $R^{32}$ and $R^{33}$ is an electron-attracting group, which specific couplers are described in EP-A-488 248 (A1), EP-A-491 197 (A1), EP-A-545 300, and U.S. Pat. No. 5,384,236.

In formulae (1) to (12), Y is a group that renders the coupler nondiffusible and that is capable of coupling split-off by the coupling reaction with the oxidized product of a developing agent. Examples of Y are a heterocyclic group (a saturated or unsaturated 5-membered to 7-membered monocyclic or condensed ring having as a hetero atom at least one nitrogen atom, oxygen atom, sulfur atom, or the like, e.g. succinimido, maleinimido, phthalimido, diglycolimido, pyrrole, pyrazole, imidazole, 1,2,4-triazole, tetrazole, indole, benzopyrazole, benzimidazole, benzotriazole, imidazolin-2,4-dione, oxazolidin-2,4-dione, thiazolidin-2,4-dione, imidazolidin-2-one, oxazolin-2-one, thiazolin-2-one, benzimidazolin-2-one, benzoxazolin-2-one, benzothiazolin-2-one, 2-pyrrolin-5-one, 2-imidazolin-5-one, indolin-2,3-dione, 2,6-dioxypurine, parabic acid, 1,2,4-triazolidin-3,5-dione, 2-pyridone, 4-pyridone, 2-pyrimidone, 6-pyridazone, 2-pyrazone, 2-amino-1,3,4-thiazolidine, and 2-imino-1,3,4-thiazolidin-4-one), a halogen atom (e.g. a chlorine atom and a bromine atom), an aryloxy group (e.g. phenoxy and 1-naphthoxy), a heterocyclic oxy group (e.g. pyridyloxy and pyrazolyloxy), an acyloxy group (e.g. acetoxy and benzoyloxy), an alkoxy group (e.g. methoxy and dodecyloxy), a carbamoyloxy group (e.g. N,N-diethylcarbamoyloxy and morpholinocarbonyloxy), an aryloxycarbonyloxy group (e.g. phenoxylcarbonyloxy), an alkoxycarbonyloxy group (e.g. methoxycarbonyloxy and ethoxycarbonyloxy), an arylthio group (e.g. phenylthio and naphthylthio), a heterocyclic thio group (e.g. tetrazolylthio, 1,3,4-thiadiazolylthio, 1,3,4-oxadiazolylthio, and benzimidazolylthio), an alkylthio group (e.g. methylthio, octylthio, and hexadecylthio), an alkylsulfonyloxy group (e.g. methanesulfonyloxy), an arylsulfonyloxy group (e.g. benzenesulfonyloxy and toluenesulfonyloxy), a carbonamido group (e.g. acetamido and trifluoroacetamido), a sulfonamido group (e.g. methanesulfonamido and benzenesulfonamido), an alkylsulfonyl group (e.g. methanesulfonyl), an arylsulfonyl group (e.g. benzenesulfonyl), an alkylsulfinyl group (e.g. methanesulfinyl), an arylsulfinyl group (e.g. benzenesulfinyl), an arylazo group (e.g. phenylazo and naphthylazo), and a carbamoylamino group (e.g. N-methylcarbamoylamino). Y may be substituted by a substituent, and examples of the substituent substituting on Y include those exemplifying the substituent on the ring formed by Q and C mentioned above. The total number of the carbon atoms contained in Y is preferably 6 or more but 50 or less, more preferably 8 or more but 40 or less, and most preferably 10 or more but 30 or less.

Preferably Y is an aryloxy group, a heterocyclic oxy group, an acyloxy group, an aryloxycarbonyloxy group, an alkoxycarbonyloxy group, and a carbamoyloxy group.

Further, couplers that have a structure such as a fused-ring phenol, an imidazole, a pyrrole, a 3-hydroxypyridine, an active methylene, an active methane, a 5,5-ring-fused heterocyclic, and a 5,6-ring-fused heterocyclic ring, can be used.

As the fused-ring phenol couplers, those described, for example, in U.S. Pat. Nos. 4,327,173, 4,564,586, and 4,904,575, can be used.

As the imidazole couplers, those described, for example, in U.S. Pat. Nos. 4,818,672 and 5,051,347, can be used.

As the 3-hydroxypyridine couplers, those described, for example, in JP-A-1-315736, can be used.

As the active methylene and active methine couplers, those described, for example, in U.S. Pat. Nos. 5,104,783 and 5,162,196, can be used.

As the 5,5-ring-fused heterocyclic couplers, for example, pyrrolopyrazole couplers described in U.S. Pat. No. 5,164,289, and pyrroloimidazole couplers described in JP-A-4-174429, can be used.

As the 5,6-ring-fused heterocyclic couplers, for example, pyrazolopyrimidine couplers described in U.S. Pat. No. 4,950,585, pyrrolotriazine couplers described in JP-A-4-204730, and couplers described in European patent No. 556 700, can be used.

In the present invention, in addition to the above couplers, use can be made of couplers described, for example, in West Germany Patent Nos. 3,819,051A and 3,823,049, U.S. Pat. Nos. 4,840,883, 5,024,930, 5,051,347, and 4,481,268, European Patent Nos. 304,856A2, 329,036, 354,549A2, 374,781A2, 379,110A2, and 386,930A1, and JP-A Nos. 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731, and 4-204732.

In the coupler used in the present invention, the total number of the carbon atoms excluding the carbon atoms in Y is preferably 1 or more but 30 or less, more preferably 1 or more but 24 or less, and most preferably 1 or more but 18 or less.

Specific examples of the couplers that can be used in the present invention are shown below, but, of course, the present invention is not limited to them:

C-27

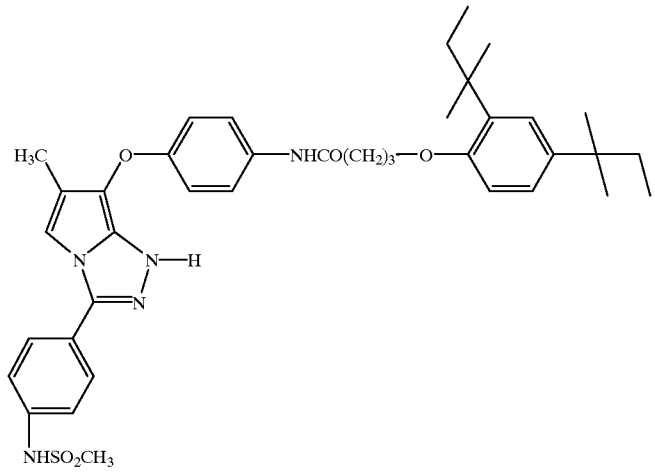

-continued

C-28

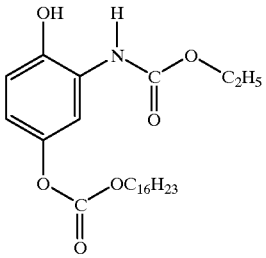

C-29

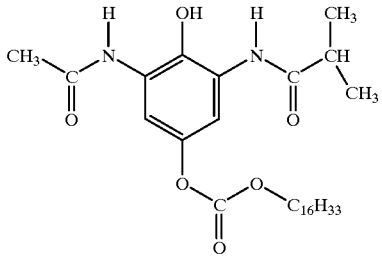

C-30

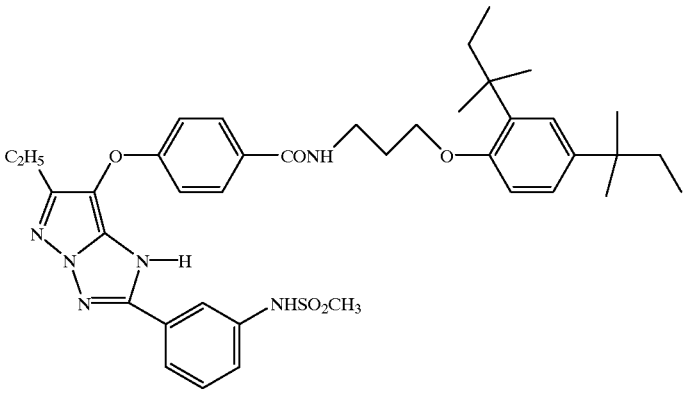

The amount to be added of the coupler that is used in the present invention, varies according to a molar extinction coefficient ($\epsilon$) of the dye to be formed or released. In order to obtain an image density of 1.0 or more in terms of reflection density, in the case of the coupler wherein the $\epsilon$ of the dye that will be produced by coupling is of the order of 5,000 to 500,000, suitably the amount to be added, of the coupler that is used in the present invention, is of the order of generally 0.001 to 100 mmol/$m^2$, preferably 0.01 to 10 mmol/$m^2$, and more preferably 0.05 to 5.0 mmol/$m^2$, in terms of the coated amount.

The molar amount to be added of the color-developing agent for use in the present invention is generally 0.01 to 100 times, preferably 1 to 10 times, and more preferably 0.2 to 5 times, the molar amount of the coupler.

Two or more of the couplers can be used in combination.

Next, the compound represented by formula (II) is described.

In formula, the ring structure containing the N represents a nitrogen-containing nonaromatic ring having at least three ring members (e.g., an aziridine ring, a pyrrolidine ring, and a piperidine ring). This nonaromatic ring may be substituted and may have an unsaturated bond(s) in the range wherein an aromatic $\pi$ electron system is not formed. Among those, a pyrrolidine ring and a piperidine ring are preferable and a piperidine ring is particularly preferable. In particular, derivatives of tetramethylpyrrolidine or tetramethylpiperidine, wherein a methyl group is substituted on the carbon atom adjacent to the N atom, are preferably used.

X represents a hydrogen atom, an alkoxy group (e.g., methoxy, ethoxy, butoxy, and octyloxy), an aryloxy group (e.g., phenoxy and tolyloxy), an oxy radical group, a hydroxyl group, or a group that forms an imino group or a hydroxyimino group by hydrolysis. As the group that forms an imino group or a hydroxyimino group by hydrolysis, can be mentioned, for example, a group represented by —Q—R, —Q—O—R, —Q—N—R(R'), —O—Q—R, —O—Q—O—R, or —O—Q—N—R(R'), wherein Q represents a divalent linking group selected from among a carbonyl group, an imino group, an $\alpha$-diketo group, a sulfonyl group, and a group —PO(R")— in which R" represents any one of an alkyl group, an aryl group, an alkylamino group, an arylamino group, an alkoxy group, and an aryloxy group; R represents any one of an alkyl group, an aryl group, and a heterocyclic group; when Q represents an imino group, R and Q may bond together to form a ring; and R' represents any one of a hydrogen atom, an alkyl group, an aryl group, and a heterocyclic group. Specific examples of such a group include, for example, an alkylcarbonyl group (e.g. acetyl, propionyl, and butyloyl), an arylcarbonyl group (e.g. benzoyl and alkylbenzoyl), an alkylcarbamoyl group (e.g. methylcarbamoyl, dimethylcarbamoyl, ethylcarbamoyl, diethylcarbamoyl, dibutylcarbamoyl, piperidinocarbamoyl, and morpholinocarbamoyl), an arylcarbamoyl group (e.g. phenylcarbamoyl, methylphenylcarbamoyl, ethylphenylcarbamoyl, and benzylphenylcarbamoyl), a unsubstituted carbamoyl group, an alkoxycarbonyl group (e.g. methoxycarbonyl, ethoxycarbonyl, and butoxycarbonyl), an aryloxycarbonyl group (e.g. phenoxycarbonyl), an alkylcarbonyloxy group (e.g. acetoxy, propionyloxy, and butyloyloxy), an arylcarbonyloxy group (e.g. benzoyloxy, and alkylbenzoyloxy), an alkoxycarbonyloxy group (e.g. methoxycarbonyloxy, and ethoxycarbonyloxy), an aryloxycarbonyloxy group (e.g. phenoxycarbonyloxy), an alkylcarbamate group (e.g. dimethylcarbamoyloxy), an arylcarbamate group (e.g. ethylphenylcarbamoyloxy), an alkylsulfonyl group (e.g. methanesulfonyl, and ethanesulfonyl), an arylsulfonyl group (e.g. phenylsulfonyl, 4-chlorophenylsulfonyl, and p-toluenesulfonyl), an alkylsulfamoyl group (e.g. methylsulfamoyl, dimethylsulfamoyl, ethylsulfamoyl, diethylsulfamoyl, dibutylsulfamoyl, piperidinosulfamoyl, and morpholinosulfamoyl), an arylsulfamoyl group (e.g. phenylsulfamoyl, methylphenylsulfamoyl, ethylphenylsulfamoyl, and benzylphenylsulfamoyl), an unsubstituted sulfamoyl group, and an alkyloxalyl group (e.g. ethyloxalyl).

Y represents a group that is capable of causing chemical reaction with a reactive group contained in the binder, to form a covalent bond. The reaction of Y with the binder permits the compound represented by formula (I) to be fixed in the image element of the present invention. Any organic chemical reaction capable of the formation of a covalent bond to meet that end, can be utilized. Examples thereof include nucleophilic substitution reactions represented, for example, by the $S_{N1}$ and $S_{N2}$ reactions; addition reactions represented, for example, by the Michael reaction; pericyclic reactions represented, for example, by the Diels-Alder reaction; and coupling reactions involving redox widely used in photochemistry, any of which reaction can be used. As the binder that is the partner in the fixing reaction, a polymer compound is generally used, and for the purpose of the present invention, any of oil-soluble polymers, water-soluble polymers, and polymer latexes can be used. Amongst those, a mordant polymer that can mordant a diffusion dye released and transferred in a diffusion transfer-type color light-sensitive material by ion interaction, is preferably used. Examples of such a polymer include polymers having secondary and/or tertiary amino groups, polymers having nitrogen-containing heterocyclic moieties, and polymers containing quaternary cation groups thereof, and the molecular weight of these polymers is generally 5,000 to 1,000,000 and particularly preferably 10,000 to 500,000. Among them, in particular, polymers having secondary or tertiary nitrogen atoms are preferable, and polymers having tertiary nitrogen atoms are more preferable.

Specific examples of the polymer are described, for example, in the following specifications: U.S. Pat. Nos. 2,548,564, 2,484,430, 3,148,061, 3,756,841, 3,625,694, 3,859,096, 4,128,538, 3,958,995, 2,721,852, 2,798,063, 4,168,976, 3,709,690, 3,788,855, 3,642,482, 3,488,706, 3,557,066, 3,271,147, 3,271,148, 2,675,316, 2,882,156, Great Britain Patent No. 1 277 453, JP-A-54-115228, JP-A-54-145529, JP-A-54-126027, JP-A-50-71332, JP-A-53-30328, JP-A-52-155528, JP-A-53-125, and JP-A-53-1024.

When it is considered to form a covalent bond by the reaction between such a mordant polymer and the compound represented by formula (II), the most preferably usable organic chemical reaction makes use of a nucleophilic reaction for Y of the compound represented by formula (II), by the nucleophilic nitrogen atom contained in the mordant polymer. As the group usable for that, can be mentioned, for example, a halogenated alkyl group, a halogenomethylenearyl group, a halogenomethylenecarbonyl group, a halogenomethylenecarbonyloxy group, a halogenomethylenecarbonamido group, a halogenomethylenesulfonyl group, a halogenomethylenesulfonamido group, an alkylsulfonyloxyalkyl group, an alkylsulfonyloxymethylenearyl group, an alkylsulfonyloxymethylenecarbonyl group, an alkylsulfonyloxymethylenecarbonyloxy group, an alkylsulfonyloxymethylenecarbonamido group, an arylsulfonyloxyalkyl group, an arylsulfonyloxymethylenearyl group, an arylsulfonyloxymethylenecarbonyl group, an arylsulfonyloxymethylenecarbonyloxy group, an alkylsulfonyloxymethylenecarbonamido group, a vinylcarbonyl group, a vinylcarbonyloxy group, a vinylcarbonamido group, a vinylsulfonyl group, a vinylsulfonamido group, an epoxy group, an episulfido group, and a formyl group.

Specific examples of the compound represented by formula (II) are shown below, which are not intended to limit the scope of the present invention.

TB-1

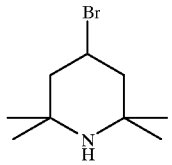

TB-2

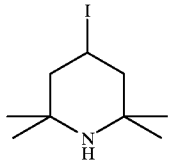

TB-3

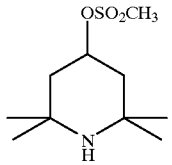

TB-4

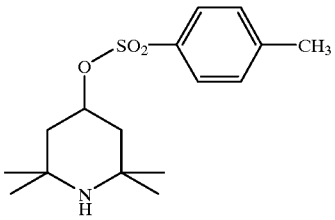

TB-5

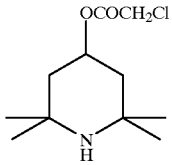

TB-6

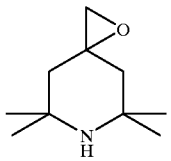

TB-7

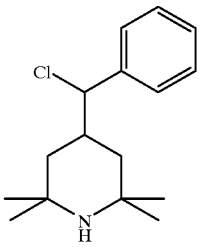

TB-8

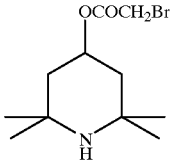

-continued
TB-9
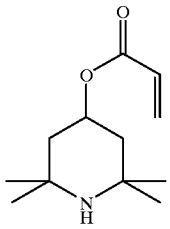
TB-10
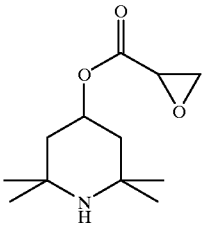
TB-11
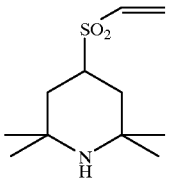
TB-12
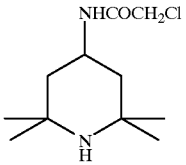
TB-13
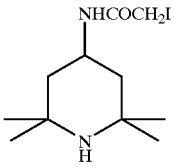
TB-14
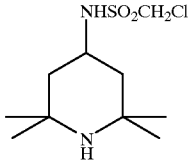
TB-15
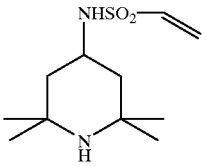
TB-16
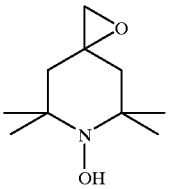
-continued
TB-17
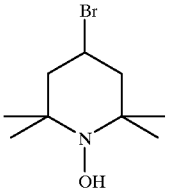
TB-18
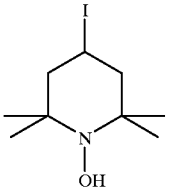
TB-19
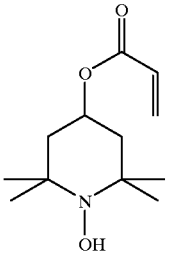
TB-20
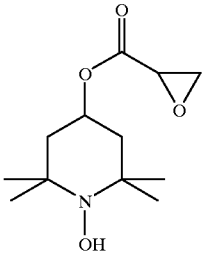
TB-21
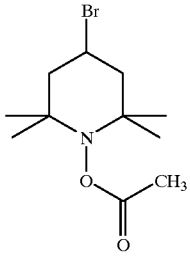
TB-22
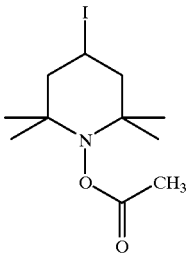
TB-23
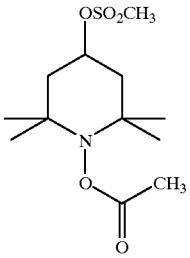

-continued
TB-24
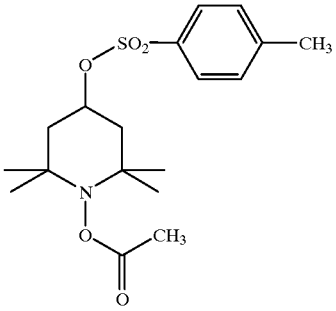
TB-25
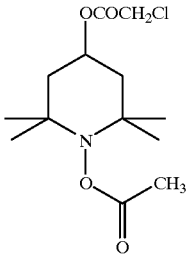
TB-26
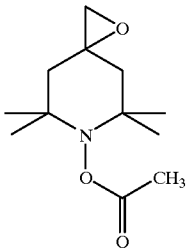
TB-27
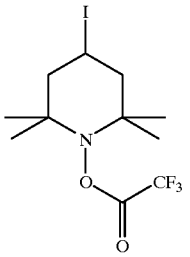
TB-28
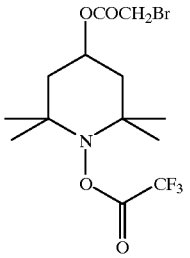
-continued
TB-29
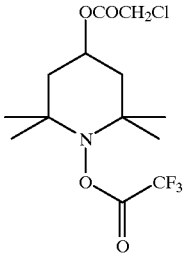
TB-30
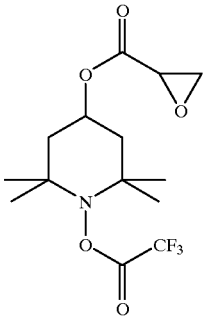
TB-31
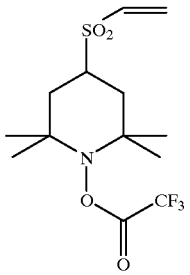
TB-32
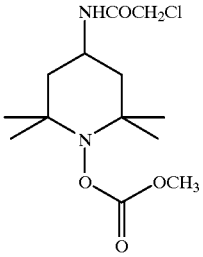
TB-33
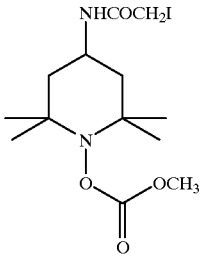

-continued
TB-34
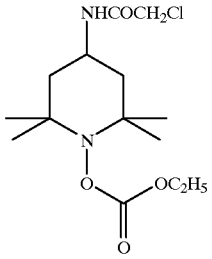
TB-35
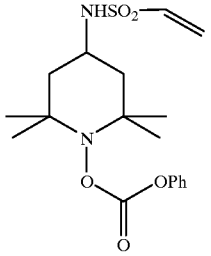
TB-36
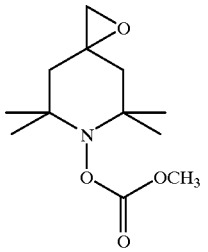
TB-37
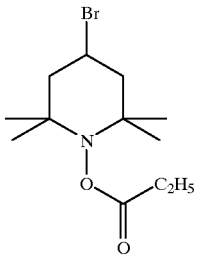
TB-38
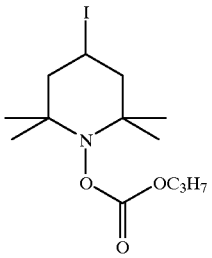
TB-39
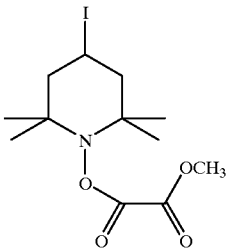
-continued
TB-40
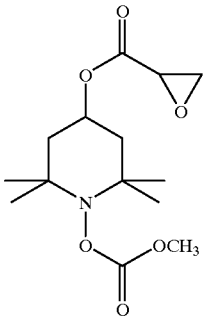
TB-41
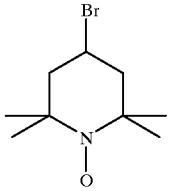
TB-42
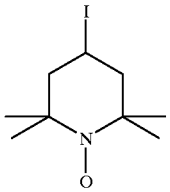
TB-43
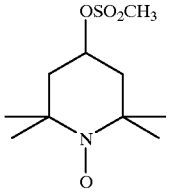
TB-44
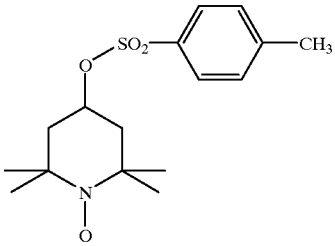
TB-45
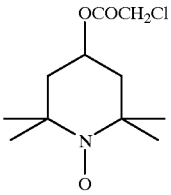
TB-46
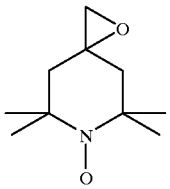

-continued
TB-47
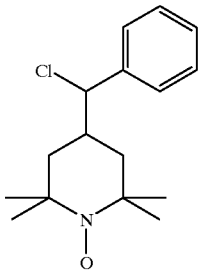
TB-48
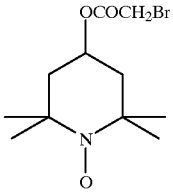
TB-49
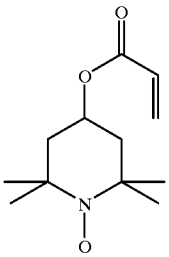
TB-50
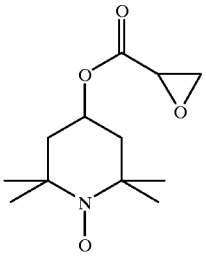
TB-51
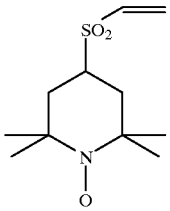
TB-52
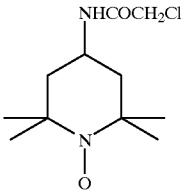
-continued
TB-53
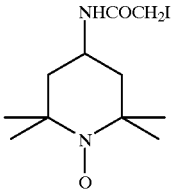
TB-54
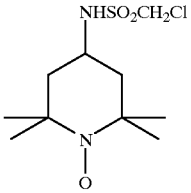
TB-55
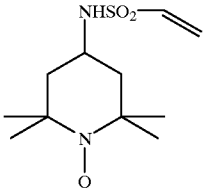
TB-56
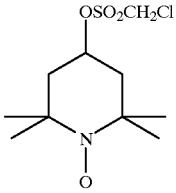
TB-57
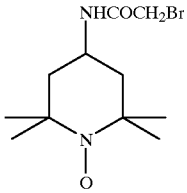
TB-58
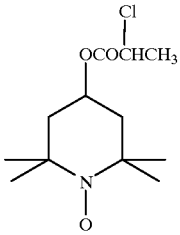
TB-59
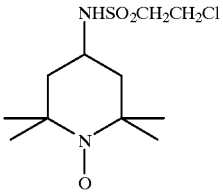

-continued
TB-60
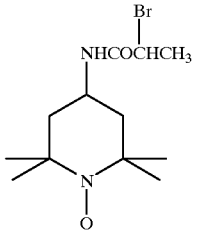
TB-61
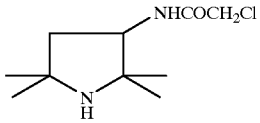
TB-62
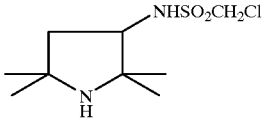
TB-63
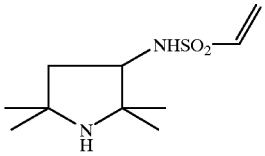
TB-64
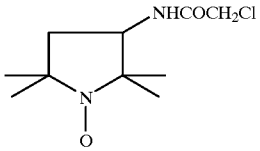
TB-65
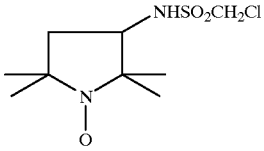
TB-66
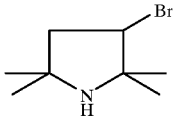
TB-67
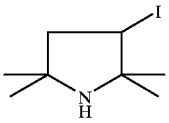
TB-68
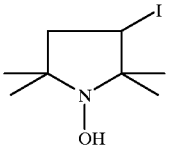
-continued
TB-69
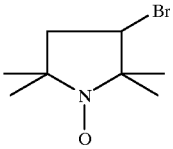
TB-70
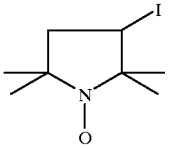
TB-71
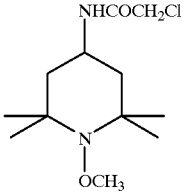
TB-72
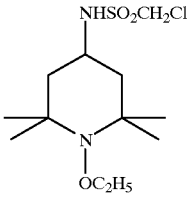
TB-73
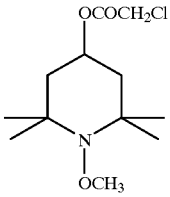
TB-74
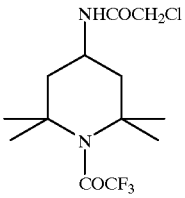
TB-75
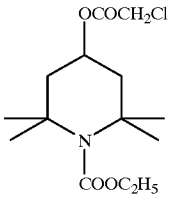
TB-76
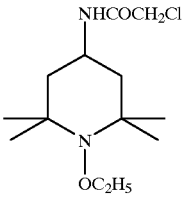

-continued

TB-77

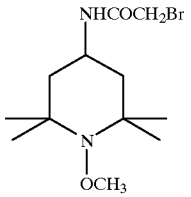

TB-78

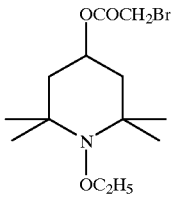

TB-79

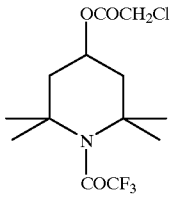

TB-80

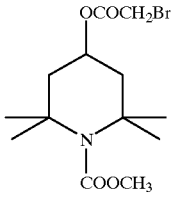

The above compounds can be synthesized by combining synthesis reactions step by step that are widely know in organic chemistry. Exemplified synthesis schemes thereof are shown below.

Synthesis of TB-6

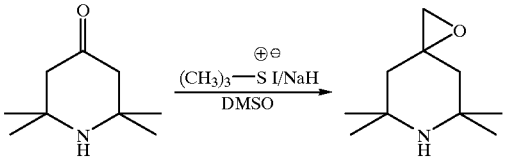

(TB-6)

Synthesis of TB-52

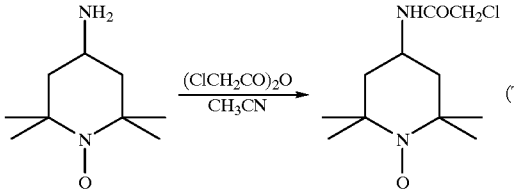

(TB-52)

The material that is involved in the formation of images of the present invention includes, for example, a processing element, such as a processing sheet, a light-sensitive element, and a dye-fixing element.

The position where the compound represented by formula (II) is to be added is described below. It is enough that the compound represented by formula (II) is present together with the image element referred to in the present invention when an image is formed finally; and, as the position where the compound is to be added, it is enough that the compound represented by formula (II) may be added anywhere so long as the compound can move to the dye-fixing layer when or after the image is formed. Further, the compound may be added to one position or plural positions. Namely, the compound can be added to an arbitrary position of the image element or a processing solution, and specifically it can be added to any layer of a dye-fixing element, any layer of a light-sensitive element, or a processing element. Furthermore, in the case of a light-sensitive microcapsule system, the compound may be added into the capsules or the binder wherein the capsules are dispersed and fixed. The compound can also be added to a dye-fixing element after the formation of an image. Specifically, the compound represented by formula (II) can be added to a dye-fixing element, for example, in such a manner that ① a solution of the compound is applied on the dye-fixing element, ② the dye-fixing element is dipped in a solution of the compound, ③ the compound contained in a processing sheet is transferred to the dye-fixing element, or ④ a solution of the compound is sprayed like an ink of an ink jet printer. Taking the fixing of the compound represented by formula (II) by the reaction with the binder into consideration, however, preferably the compound is added to the same layer where the binder of the subject, particularly the mordant polymer, is added; and as a more preferable method, can be mentioned a method wherein the compound represented by formula (II) is added to a mordant polymer solution previously, to allow the chemical reaction to take place, followed by coating the resultant solution.

The compound represented by formula (II) may be added in such a manner that the compound is added after dissolving in water, or that the compound is added after dissolving in an organic solvent, such as alcohols or ketones, or a mixed solvent of such an organic solvent with water, if it is not separated when added to a coating solution. The compound represented by formula (II) may also be added after dissolved in an acid or a base or included in a inclusion (clathrate) compound.

Preferably, in the present invention, the compound represented by formula (II) are finally present in a total amount to be added of 0.01 mmol/$m^2$ or more, and more preferably 0.1 mmol/$m^2$ to 10 mmol/$m^2$, in the image element after the formation of an image. The molar amount of the compound represented by formula (II) to be added is generally 0.0001 to 1,000 times, preferably 0.001 to 100 times, and more preferably 0.01 to 10 times, the reaction sites of the binder to be reacted therewith.

These compounds can be used in combination with other anti-fading agents, as well as in combination with other anti-fading means, such as addition of an ultraviolet absorber, and a laminate.

The compound represented by formula (II) can be used in combination with a compound that releases active oxygen. As the active-oxygen-releasing agent, can be mentioned a certain kind of image-forming dye, titanium oxide, a fluorescent whitening agent, a transition metal salt, etc. An ultraviolet absorbing agent can also be used as an active-oxygen-releasing agent.

In the present invention, it is preferable to use an auxiliary developing agent. Here, the auxiliary developing agent means materials having an action of promoting a transfer of electrons to silver halide from a color-developing agent in the developing process of silver halide development, and the auxiliary developing agent is an electron-releasing compound obeying the Kendall-Pertz rule. Examples of the auxiliary developing agent used in the present invention include the compounds represented by the formulae (B-1) and (B-2) described on pages 37 to 38 in the specification of JP-A-9-152705 and the sulfonamidophenol compounds represented by the formula [1] explained on pages 3 to 6 in the specification of JP-A-9-146248. Specific compound examples of these auxiliary developing agents include the compounds (ETA-1) to (ETA-36) described on pages 39 to 41 in the specification of JP-A-9-152705 and the compounds D-1 to D-35 described on pages 9 to 15 in the specification of JP-A-9-146248. Compounds which are especially preferable as the auxiliary developing agent used in the present invention is shown in the following. However, the present invention is not limited to these compounds.

ETA-1

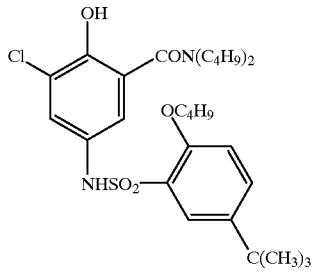

ETA-2

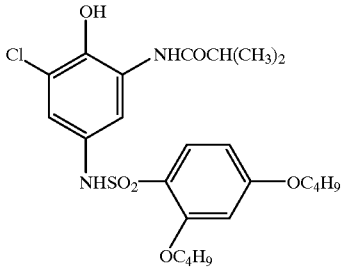

ETA-3

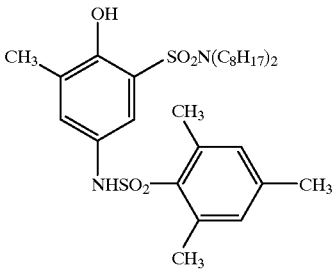

ETA-4

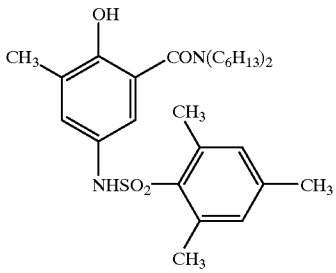

-continued

ETA-5

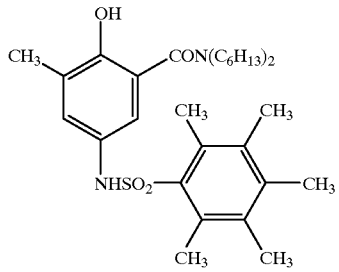

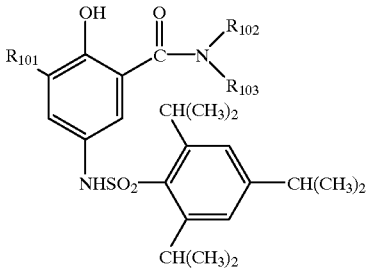

| | $R_{101}$ | $R_{102}$ | $R_{103}$ |
|---|---|---|---|
| ETA-6 | $CH_3$— | —$C_4H_9$ | —$C_4H_9$ |
| ETA-7 | $(CH_3)_3C$— | —$C_4H_9$ | —$C_4H_9$ |
| ETA-8 | $(CH_3)_2CH$— | —$C_4H_9$ | —$C_4H_9$ |
| ETA-9 | $CH_3$— | —$C_6H_{13}$ | —$C_6H_{13}$ |
| ETA-10 | $CH_3$— | —$C_8H_{17}$ | —$C_8H_{17}$ |
| ETA-11 | $CH_3$— | —$C_8H_{17}$ | —H |
| ETA-12 | $CH_3$— | —$C_{14}H_{29}$ | —H |
| ETA-13 | $CH_3$— | —$C_{18}H_{37}$ | —$CH_3$ |
| ETA-14 | $CH_3$— | —$CH_2CH_2OCH_3$ | —$CH_2CH_2OCH_3$ |
| ETA-15 | $CH_3CONH$— | —$C_2H_5$ | —$C_2H_5$ |
| ETA-16 | $CH_3CON(CH_3)$— | —$C_2H_5$ | —$C_2H_5$ |
| ETA-17 | $CH_3$— | —$C_6H_{13}$ | —$C_6H_{13}$ |

ETA-18

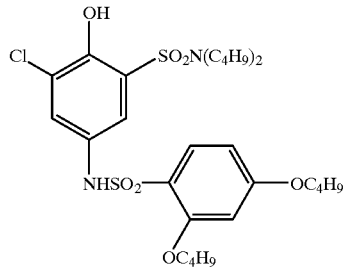

ETA-19

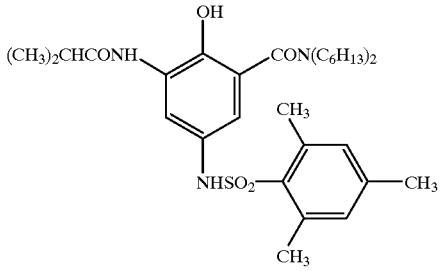

-continued

ETA-20

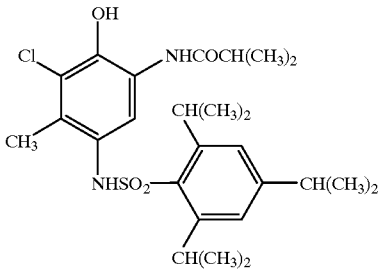

ETA-21

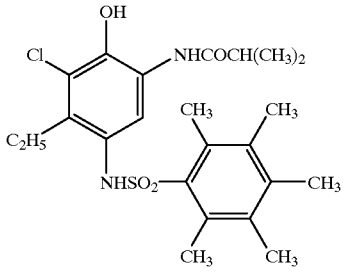

ETA-22

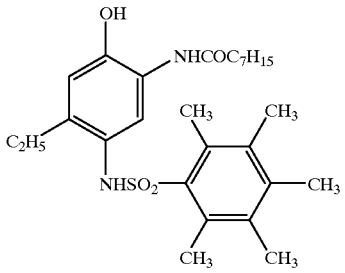

ETA-23

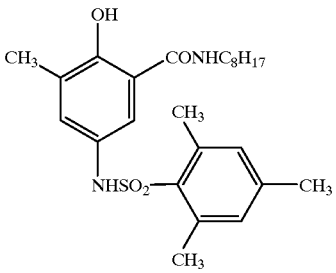

ETA-24

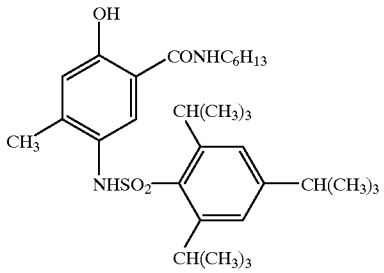

-continued

ETA-25

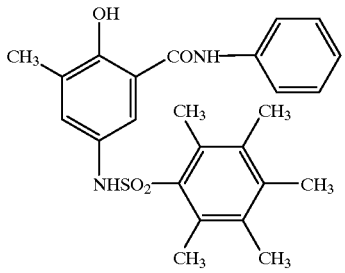

ETA-26

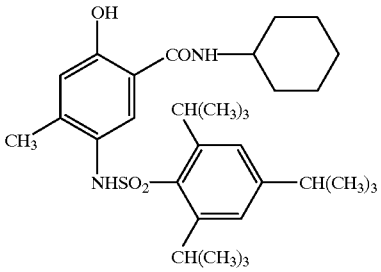

ETA-27

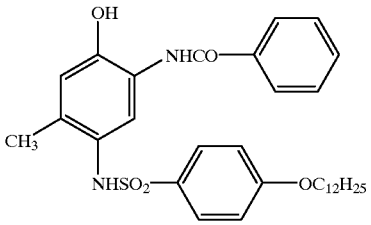

ETA-28

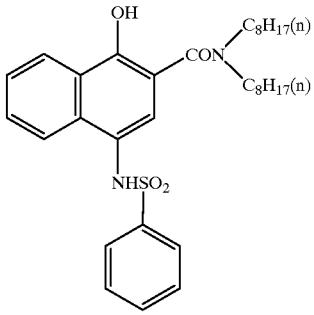

Next, the techniques that can be used in combination with the present invention are explained.

The heat-developable color light-sensitive material used in the present invention has on a base basically a light-sensitive silver halide emulsion, and a binder, and, if required, an organometallic salt oxidizing agent, a dye-providing compound (in some cases, a reducing agent serves for a dye-providing compound as described later), or the like can be contained.

These components are added to the same layer in many cases, but they may be added to separate layers. For instance, when a colored dye-providing compound is allowed to present in a layer under a silver halide emulsion, the sensitivity can be prevented from lowering.

Further, a reducing agent is preferably built in the heat-developable light-sensitive material, but it may be supplied from the outside, for example, by a method wherein it is diffused from a dye-fixing element as described later.

In order to obtain colors ranging widely on the chromaticity diagram by using three primary colors: yellow, magenta, and cyan, use is made of a combination of at least three silver halide emulsion layers photosensitive to respectively different spectral regions. For examples, a combination of a blue-sensitive layer, a green-sensitive layer, and a red-sensitive layer, and a combination of a green-sensitive layer, a red-sensitive layer, an infrared-sensitive layer, and a combination of a red-sensitive layer, an infrared-sensitive layer (1), and an infrared-sensitive layer (2), as described in JP-A-59-180550, JP-A-64-13546, JP-A-62-253159, and EP-A-479,167, can be mentioned. The each of photosensitive layers can be arranged in various orders known generally for color photographic materials. Further, each of these photosensitive layers can be divided into two or more layers if necessary, as described in JP-A-1-252954. In the heat-developable light-sensitive material, various non-light-sensitive layers can be provided, such as a protective layer, an underlayer, an intermediate layer, a yellow filter layer, and an antihalation layer, between the above silver halide emulsion layers, or as an uppermost layer or a lowermost layer; and on the opposite side of the photographic support, various auxiliary layers can be provided, such as a backing layer. Specifically, for example, layer constitutions as described in the above-mentioned patents, undercoat layers as described in U.S. Pat. No. 5,051,335, intermediate layers containing a solid pigment, as described in JP-A-1-167,838 and JP-A-61-20,943, intermediate layers containing a reducing agent or a DIR compound, as described in JP-A-1-129,553, JP-A-5-34,884, and JP-A-2-64,634, intermediate layers containing an electron transfer agent, as described in U.S. Pat. Nos. 5,017,454 and 5,139,919, and JP-A-2-235,044, protective layers containing a reducing agent, as described in JP-A-4-249,245, or combinations of these layers, can be provided. It is preferable to design a support so that it has antistatic function and the surface resistivity of $10^{12}\Omega\cdot$cm or less.

Next, silver halide emulsion used in the heat-developable light-sensitive material is described in detail. The silver halide emulsion that can be used in the present invention may be made of any of silver chloride, silver bromide, silver iodobromide, silver chlorobromide, silver chloroiodide, and silver chloroiodobromide.

The silver halide emulsion that is used in the present invention may be a surface-latent-image-type emulsion or an internal-latent-image-type emulsion. The internal-latent-image-type emulsion is used in combination with a nucleator or a light-fogging agent to be used as a direct reversal emulsion.

When the silver halide particle contained in the silver halide emulsion in the present invention are composed of a mixed crystal of different silver halides, the particle having uniform composition in the particle can be used, but it is also preferably performed to make the particle have what is called a lamination layer structure, having multiple layers with different halogen compositions within the particle. Examples of the latter includes a core-shell emulsion having different compositions in the inner part and surface layer of the particle. Further, in addition to the lamination layer structure as mentioned above, a structure having local phases with different halogen compositions within the particles can also be preferably used. Preferable examples of the particle having such a structure include a particle in which, on the surface, edge, or top of a silver halide particle as the parent body, a silver halide with different composition are joined by epitaxial joining. Furthermore, it is also preferable to form these local phases in the inner parts of the particle. The silver halide grains that constitutes the silver halide emulsion may have a monodisperse or a polydisperse distribution of grain size. A technique is preferably used wherein the gradation is adjusted by mixing monodisperse emulsions having different grain size or sensitivity, as described in JP-A-1-167743 or JP-A-4-223463. The grain size is preferably 0.1 to 2 $\mu$m, and particularly preferably 0.2 to 1.5 $\mu$m. The crystal habit of the silver halide grains may be any of regular crystals, such as cubic crystals, octahedral crystals and tetradecahedral crystals; irregular crystals, such as spherical crystals and tabular crystals having a high aspect ratio; crystals having crystal defects, such as twin planes, composite crystals of these, or others.

Specifically, any of silver halide emulsions can be used that are prepared by methods described, for example, in U.S. Pat. No. 4,500,626, column 50; U.S. Pat. No. 4,628,021, Research Disclosure (hereinafter abbreviated to as RD) No. 17,029 (1978), RD No. 17,643 (December 1978), pages 22 to 23; RD No. 18,716 (November 1979), page 648; RD No. 307,105 (November 1989), pages 863 to 865; JP-A-62-253159, JP-A-64-13546, JP-A-2-236546, and JP-A-3-110555; by P. Glafkides in Chemie et Phisique Photographique, Paul Montel (1967); by G. F. Duffin in Photographic Emulsion Chemistry, Focal Press, 1966; and by V. L. Zelikman et al., in Making and Coating Photographic Emulsion, Focal Press, 1964.

It is preferably performed that the light-sensitive silver halide emulsion to be used in the present invention contain an ion of a transition metal, including titanium, iron, cobalt, ruthenium, rhodium, osmium, iridium, and platinum, or an ion of a typical metal, including zinc, cadmium, thallium, and lead, in the inner part or surface of the particle for the various purposes of high sensitivity, contrasting, improving reciprocity law failure, improving latent image stability, improving pressure durability, and the like. These metal ions can be introduced in the form of salts or complex salts. In particular, when the transition metal ion is contained, it is preferable to use it as complexes having ammonia, halogens, cyan, thiocyan, nitrosyl, and the like, as ligands, or complexes having organic ligands, such as imidazole, triazole, pyridine, bipyridine and the like, as ligands. These ligands can be used singly or in combination of multiple kinds of ligands. Moreover, it is also possible to use these compounds singly or in combination of two or more kinds. The amount to be added varies depending on the purpose of the application; but the amount is generally on the order of $10^{-9}$ to $10^{-3}$ mol per mol of the silver halide. When they are incorporated, they may be incorporated uniformly in the grains, or they may be localized in the grains or on the surface of the grains. Specifically, emulsions described, for example, in JP-A-2-236542, JP-A-1-116637, and JP-A-5-181246 are preferably used.

In the step for forming grains of the light-sensitive silver halide emulsion for use in the present invention, as a silver halide solvent, a rhodanate, ammonia, a tetrasubstituted thioether compound, an organic thioether derivative described in JP-B-47-11386, or a sulfur-containing compound described in JP-A-53-144319 can be used.

As other conditions employed to prepare the emulsion in the present invention, the description, for example, by P. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964, can be referred to. That is, any of the acid process, the neutral process, the ammonia process, and the like can be used; and to react a soluble silver salt with a soluble halogen salt, any of the single-jet method, the double-jet method, a combination thereof, and the like can be used. To obtain monodispersed emulsion, the double-jet method is preferably used.

A method wherein grains are formed in the presence of excess silver ions (the so-called reverse precipitation process) can also be used. As one type of the double-jet method, a method wherein pAg in the liquid phase, in which a silver halide will be formed, is kept constant, that is, the so-called controlled double-jet method, can also be used.

Further, to quicken the growth of the grains, the concentrations, the amounts, and the speeds of the silver salt and the halide to be added may be increased (e.g. JP-A-55-142329, JP-A-55-158124, and U.S. Pat. No. 3,650,757).

As the method of stirring the reaction liquid, any of known stirring methods may be used. The temperature and the pH of the reaction liquid during the formation of the silver halide grains may be set arbitrarily to meet the purpose. Preferably the pH range is 2.3 to 8.5, and more preferably 2.5 to 7.5.

In the process for preparing the light-sensitive silver halide emulsion for use in the present invention, so-called desalting, for removing excess salts, is preferably carried out. As a means for attaining it, the noodle water-washing method, which is carried out with the gelatin gelled, can be used, and also the sedimentation method, in which inorganic salts comprising polyvalent anions (e.g. sodium sulfate), an anionic surfactant, an anionic polymer (e.g. polystyrene-sulfonic acid sodium salt), or a gelatin derivative (e.g. an aliphatic-acylated gelatin, an aromatic-acylated gelatin, and an aromatic-carbamoylated gelatin) is employed, can be used, with the sedimentation method preferred.

The light-sensitive silver halide emulsion is generally a chemically-sensitized silver halide emulsion. To chemically sensitize the light-sensitive silver halide emulsion for use in the present invention, for example, a chalcogen sensitization method, such as a sulfur sensitization method, a selenium sensitization method, and a tellurium sensitization method; a noble metal sensitization method, wherein gold, platinum, or palladium is used; and a reduction sensitization method, each of which is known for silver halide emulsions in light-sensitive material, can be used alone or in combination (e.g. JP-A-3-110555 and JP-A-5-241267). These chemical sensitizations can be carried out in the presence of a nitrogen-containing heterocyclic compound (JP-A-62-253159). Further, the below-mentioned antifoggant can be added after the completion of the chemical sensitization. Specifically, methods described in JP-A-5-45833 and JP-A-62-40446 can be used.

At the time of the chemical sensitization, the pH is preferably 5.3 to 10.5, and more preferably 5.5 to 8.5, and the pAg is preferably 6.0 to 10.5, and more preferably 6.8 to 9.0.

The coating amount of the light-sensitive silver halide emulsion used in the present invention is generally in the range of 1 mg to 10 g/m$^2$ in terms of silver, and preferably in the range of 10 mg to 10 g/m$^2$.

When the photosensitive silver halide used in the present invention is made to have color sensitivities of green sensitivity, red sensitivity, and infrared sensitivity, the photosensitive silver halide emulsion is spectrally sensitized with methine dyes or the like. If required, the blue-sensitive emulsion may be spectrally sensitized in the blue region.

Dyes that can be used include cyanine dyes, merocyanine dyes, composite cyanin dyes, composite merocyanine dyes, halopolar cyanine dyes, hemicyanine dyes, styryl dyes, and hemioxonol dyes.

Specifically, sensitizing dyes described, for example, in U.S. Pat. No. 4,617,257 and JP-A-59-180550, JP-A-64-13546, JP-A-5-45828, and JP-A-5-45834 can be mentioned.

These sensitizing dyes can be used singly or in combination, and a combination of these sensitizing dyes is often used, particularly for the purpose of adjusting the wavelength of the spectral sensitivity, and for the purpose of supersensitization.

Together with the sensitizing dye, a dye having no spectral sensitizing action itself, or a compound that does not substantially absorb visible light and that exhibits supersensitization, may be included in the emulsion (e.g. those described, for example, in U.S. Pat. No. 3,615,641 and JP-A-63-23145).

The time when these sensitizing dyes are added to the emulsion may be at a time of chemical ripening or before or after chemical ripening. Further, the sensitizing dye may be added before or after the formation of nuclei of the silver halide grains, in accordance with U.S. Pat. Nos. 4,183,756 and 4,225,666. Further, these sensitizing dyes and supersensitizers may be added in the form of a solution of an organic solvent, such as methanol, or in the form of a dispersion of gelatin, or in the form of a solution of a surface-active agent. Generally the amount of the sensitizing dye to be added is of the order of $10^{-8}$ to $10^{-2}$ mol per mol of the silver halide.

These additives used in the above process, and conventionally known additives for photography that can be used in dye-fixing materials and heat-developable light-sensitive materials of the present invention, are described in the above mentioned RD No. 17643; RD No. 18716; and RD No. 307105, whose particular parts are given below in a table.

| | Kind of Additive | RD 17643 | RD 18716 | RD 307105 |
|---|---|---|---|---|
| 1 | Chemical sensitizers | p.23 | p.648 (right column) | p.866 |
| 2 | Sensitivity-enhancing agents | p.648 (right column) | — | — |
| 3 | Spectral sensitizers and Supersensitizers | pp.23–24 | pp.648 (right column)–649 | pp.866–868 |
| 4 | Brightening agents | p.24 | pp.648 (right column) | p.868 |
| 5 | Antifogging agents and Stabilizers | pp.24–25 | p.649 (right column) | pp.868–870 |
| 6 | Light absorbers, Filter dyes, and UV Absorbers | pp.25–26 | pp.649 (right column)–650 (left column) | p.873 |
| 7 | Dye-image stabilizers | p.25 | p.650 (left column) | p.872 |
| 8 | Hardeners | p.26 | p.651 (left column) | pp.874–875 |
| 9 | Binders | p.26 | p.651 (left column) | pp.873–874 |
| 10 | Plasticizers and Lubricants | p.27 | p.650 (right column) | p.876 |
| 11 | Coating aids and Surfactants | pp.26–27 | p.650 (right column) | pp.875–876 |
| 12 | Antistatic agents | p.27 | p.650 (right column) | pp.876–877 |
| 13 | Matting agents | | | pp.878–879 |

As the binder of the constitutional layer of the heat-developable light-sensitive material or the dye-fixing material, a hydrophilic binder is preferably used. Examples thereof include those described in the above-mentioned Research Disclosures and JP-A-64-13546, pages (71) to (75). Specifically, a transparent or semitransparent hydrophilic binder is preferable, and examples include proteins, such as gelatin and gelatin derivatives; cellulose derivatives; such natural compounds as polysaccharides, including starches, acacia, dextrans, and pullulan; and such synthetic polymer compounds as polyvinyl alcohols, polyvinyl pyrrolidones, and acrylamide polymers. Highly water-absorptive polymers described, for example, in U.S. Pat. No. 4,960,681 and JP-A-62-245260; that is, homopolymers of vinyl monomers having —COOM or —$SO_3M$ (M represents a hydrogen atom or an alkali metal), or copolymers of these vinyl monomers, or this vinyl monomer(s) with another vinyl monomer (e.g., those comprising sodium methacrylate or ammonium methacrylate, including Sumika Gel L-5H, trade name, manufactured by Sumitomo Chemical Co., Ltd.) can also be used. Two or more of these binders can be combined and used. Particularly, combinations of gelatin with the above binders are preferable. As the gelatin, lime-processed gelatin, acid-processed gelatin, or de-ashed gelatin, wherein the contents of calcium, etc., are reduced, can be selected to meet various purposes, and combinations of these gelatins are also preferably used.

If a system wherein the heat development is carried out with a trace amount of water supplied is adopted, the absorption of water can be rapidly carried out by using the above high-water-absorptive polymer. Further, in addition to the present invention, when the high-water-absorptive polymer is used in the dye-fixing layer or its protective layer, after the transfer the dye can be prevented from re-transferring from the dye-fixing element to others.

In the present invention, the coating amount of the binder is preferably 0.2 to 20 g, particularly preferably 0.2 to 10 g or less, and more preferably 0.5 to 7 g per $m^2$.

In the present invention, the light-sensitive silver halide emulsion may be used together with an organic metal salt as an oxidizing agent. Among the organic metal salts, organosilver salt is particularly preferably used.

As the organic compound that can be used to form the above organosilver salt oxidizing agent, benzotriazoles, aliphatic acids, and other compounds, as described in U.S. Pat. No. 4,500,626, columns 52 to 53, can be mentioned. Also useful is acetylene silver described in U.S. Pat. No. 4,775,613. organosiliver salts may be used in the form of a combination of two or more.

The above organosilver salts may be used additionally in an amount of generally 0.01 to 10 mol, and preferably 0.01 to 1 mol, per mol of the light-sensitive silver halide. Suitably the total coating amount of the light-sensitive silver halide emulsion plus the organosilver salt is generally 0.05 to 10 g/$m^2$, and preferably 0.1 to 4 g/$m^2$, in terms of silver.

Besides the compound used in the present invention, reacting agents can be used. As reducing agent to be used, reducing agents known in the field of heat-developable light-sensitive material can be used. Further, the later-described dye-providing compounds having reducibility are also included (in this case, another reducing agent can be used additionally). Further, reducing agent precursors that have no reducibility themselves but exhibit reducibility by the action of heat or a nucleophilic agent during the process of development, can be used.

Examples of the reducing agent that can be used in the present invention include reducing agents and reducing agent precursors described, for example, in U.S. Pat. No. 4,500,626, columns 49 to 50, U.S. Pat. Nos. 4,839,272, 4,330,617, 4,590,152, 5,017,454, 5,139 919, JP-A-60-140335, pages (17) to (18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pages (40) to (57), JP-A-1-120553, JP-A-2-32338, JP-A-2-35451, JP-A-2-234158, JP-A-3-160443, and European Patent No. 220 746, pages 78 to 96.

Combinations of various reducing agents as disclosed in U.S. Pat. No. 3,039,869 can also be used.

When a non-diffusion reducing agent is used, an electron-transport agent and/or an electron-transport agent precursor can be used additionally, if necessary, in order to accelerate the electron transport between the non-diffusion reducing agent and the developable silver halide. Particularly preferably, those described, for example, in the above-mentioned U.S. Pat. No. 5,139,919, EP-A-418 743, JP-A-1-138556, and JP-A-3-102345 are used. Further, a method wherein it is introduced in a layer stably as described in JP-A-2-230143 and JP-A-2-235044 is preferably used.

The electron-transport agent or its precursor can be chosen from among the above reducing agents or their precursors. The electron-transport agent and its precursor are desirably greater in its movability than the non-diffusion reducing agent (electron provider).

As the non-diffusion reducing agent (electron provider) used in combination with the electron-transport agent, those that are among the above reducing agents and that are substantially not movable in the layers of the light-sensitive material are suitable. As examples of those, preferably, for example, hydroquinones, sulfonamidophenols, sulfonamidonaphtholes, compounds described as electron providers in JP-A-53-110827, U.S. Pat. Nos. 5,032,487, 5,026,634, and 4,839,272, and the below-described non-diffusion, dye-providing compounds having reducibility can be mentioned.

Electron provider precursors as described in JP-A-3-160443 are also preferably used.

Further, the above reducing agents can be used in intermediate layers and protective layers for various purposes, for example, of the color-mixing inhibition, the improvement of color reproduction, the improvement of the white background, and the prevention of silver from migrating to the dye-fixing material. Specifically, reducing agents described in EP-A-524 649, EP-A-357 040, JP-A-4-249245, JP-A-2-64633, JP-A-2-46450, and JP-A-63-186240 are preferably used. Reducing compounds that release a development inhibitor, as described in JP-B-3-63733, JP-A-1-150135, JP-A-2-110557, JP-A-2-64634, JP-A-3-43735, and EP-A-451 833, can also be used.

The total amount of the reducing compounds to be added in the present invention is generally 0.01 to 20 mol, and particularly preferably 0.1 to 10 mol, per mol of silver.

The hydrophobic additives, such as the dye-providing compounds and non-diffusion reducing agents, can be introduced by a known method, such as a method described in U.S. Pat. No. 2,322,027, into a layer of the heat-developable light-sensitive material. In this case, use is made of a high-boiling organic solvent as described, for example, in U.S. Pat. Nos. 4,555,470, 4,536,466, 4,536,467, 4,587,206, 4,555,476, and 4,599,296, and JP-B-3-62256, if necessary, in combination with a low-boiling organic solvent having a boiling point of 50 to 160° C. Further, these dye-providing compounds, non-diffusion reducing agents, high-boiling organic solvents, and the like, can be used in the form of a combination of two or more, respectively.

The high-boiling organic solvent is used in an amount of generally 10 g or less, preferably 5 g or less, and more preferably 1 g to 0.1 g, per g of the dye-providing compound. The amount is also suitably generally 1 cc or less, particularly 0.5 cc or less, and more particularly 0.3 cc or less, per g of the binder.

A dispersion method that uses a polymer, as described in JP-B-51-39853 and JP-A-51-59943, and a method wherein the addition is made with them in the form of a dispersion of fine particles, as described, for example, in JP-A-62-30242, can also be used.

If the hydrophobic additives are compounds substantially insoluble in water, besides the above methods, a method can be used wherein the compounds may be made into fine particles to be dispersed and contained in a binder.

In dispersing the hydrophobic compound in a hydrophilic colloid, various surface-active agents can be used. Examples of the surface-active agents that can be used are listed in JP-A-59-157636, pages (37) to (38), and in the Research Disclosure (RD) publication shown above.

In the heat-developable light-sensitive material for use in the present invention, use can be made of a compound that can activate the development and can make the image stable. Preferable specific compounds for use are described in U.S. Pat. No. 4,500,626, the 51st column to the 52nd column.

In the system for forming an image by diffusion transfer of a dye, various compounds can be added to the constitutional layers of the heat-developable light-sensitive material of the present invention, for the purpose of fixing unnecessary dyes or colored substances or rendering them colorless, to improve the white background of the resulting image.

Specifically, compounds described in EP-A-353 741, EP-A-461 416, JP-A-63-163345, and JP-A-62-203158 can be used.

For the constitutional layers of the heat-developable light-sensitive material of the present invention, various pigments and dyes can be used, for the purpose of improving color separation and making sensitivity high.

Specifically, compounds described in the above Research Disclosure and compounds and layer constitutions described, for example, in EP-A-479 167, EP-A-502 508, JP-A-1-167838, JP-A-4-343355, JP-A-2-168252, JP-A-61-20943, EP-A-479 167, and EP-A-502 508 can be used.

In the present invention, a dye-fixing material is used together with the heat-developable light-sensitive material, to form an image by diffusion transfer of a dye. The dye-fixing material may be either in the form wherein the dye-fixing material is applied on a base different from that of the light-sensitive material, or in the form wherein the dye-fixing material is applied on the same base as that of the light-sensitive material. As for the mutual relationship of the light-sensitive material to the dye-fixing material, and the relationship thereof to the base, and to the white reflective layer, the relationship described in U.S. Pat. No. 4,500,626, column 57, can also be applied to the present invention.

The dye-fixing material preferably used in the present invention has at least one layer containing a mordant and a binder. As the mordant, one known in the field of photography can be used, and specific examples thereof include mordants described in U.S. Pat. No. 4,500,626, columns 58 to 59, JP-A-61-88256, pages (32) to (41), and JP-A-1-161236, pages (4) to (7), and those described, for example, in U.S. Pat. Nos. 4,774,162, 4,619,883, and 4,594,308. Further, dye-accepting polymer compounds as described in U.S. Pat. No. 4,463,079 may be used.

The binder used in the dye-fixing material for use in the present invention is preferably the above hydrophilic binder. Further, the additional use of carrageenans, as described in EP-A-443 529, and latexes having a glass transition temperature of 40° C. or less, as described in JP-B-3-74820, is preferable.

The dye-fixing material may be provided, if necessary, with an auxiliary layer, such as a protective layer, a release (peel-off) layer, an undercoat layer, an intermediate layer, a backing layer, and a curling-preventive layer. Particularly, the provision of a protective layer is useful.

For the constitutional layers of the heat-developable light-sensitive material and the dye-fixing material, use can be made of a plasticizer, a slip agent, or a high-boiling organic solvent as a releasability improver between the light-sensitive material and the dye-fixing material. Specifically, those described, for example, in the above Research Disclosures and JP-A-62-245253 can be mentioned.

Further, for the above purpose, a variety of silicone oils (all silicone oils including dimethylsilicone oils and modified silicone oils formed by introducing various organic groups into dimethylsiloxanes) can be used. For example, various modified silicone oils described in "Hensei Silicone Oils," Gijyutsu Shiryo, P6-18B, published by Shinetsu Silicone K.K., and particularly carboxy-modified silicone (trade name: X-22-3710) are effective.

Further, silicone oils described in JP-A-62-215953 and JP-A-63-46449 are also effective.

In the heat-developable light-sensitive material and the dye-fixing material, a fluorescent whitening agent may be used. Particularly preferably, the fluorescent whitening agent is built in the dye-fixing material or it is supplied from the outside, for example, from the heat-developable light-sensitive material or the transfer solvent. As examples thereof, can be mentioned compounds described, for example, in "The Chemistry of Synthetic Dyes," Vol. V, Section 8, edited by K. Veenkataraman and in JP-A-61-143752. More specifically, for example, stilbene-series compounds, coumarin-series compounds, biphenyl-series compounds, benzoxazolyl-series compounds, naphthalimide-series compounds, pyrazoline-series compounds, and carbostyryl-series compounds can be mentioned.

The fluorescent whitening agent can be used in combination with the anti-fading agent or the ultraviolet absorber.

Specific examples of these anti-fading agent, ultraviolet absorber, and fluorescent whitening agent, are described in JP-A-62-215272, pages (125) to (137), and JP-A-1-161236, pages (17) to (43).

Examples of the hardening agent that is used in constitutional layers of the heat-developable light-sensitive material or the dye-fixing material, include hardening agents described, for example, in the above Research Disclosures, U.S. Pat. No. 4,678,739, column 41, and U.S. Pat. No. 4,791,042, and JP-A-59-116655, JP-A-62-245261, JP-A-61-18942, and JP-A-4-218044. More specifically, an aldehyde-series hardening agent (formaldehyde, etc.), an aziridine-series hardening agent, an epoxy-series hardening agent, a vinyl sulfone-series hardening agent (N,N'-ethylene-bis (vinylsulfonylacetamido)ethane, etc.), an N-methylol-series hardening agent (dimethylol urea, etc.), or a polymer hardening agent (compounds described, for example, in JP-A-62-234157), can be mentioned.

These hardening agents are used in an amount of generally 0.001 to 1 g, and preferably 0.005 to 0.5 g, per g of the gelatin coated. The layer into which the hardeners are added may be any of layers that constitute the photographic material or the dye-fixing material, or the hardener may be divided into two or more parts, which are added into two or more layers.

In the constitutional layers of the heat-developable light-sensitive material and the dye-fixing material, various anti-foggants and photographical stabilizers and their precursors can be used. Specific examples thereof include azoles and azaindenes described in RD 17643 (1978), pages 24 to 25, nitrogen-containing carboxylic acids and phosphoric acids described in JP-A-59-168442, mercapto compounds and their metal salts described in JP-A-59-111636, and acetylene compounds described in JP-A-62-87957. In the case wherein a precursor is used in the present invention, it is particularly preferably used in the light-sensitive silver halide emulsion layer as described above, but it can be used in the dye-fixing material.

If these compounds are not precursors, they are used preferably in an amount of $5\times10^{-6}$ to $1\times10^{-1}$ mol and more preferably $1\times10^{-5}$ to $1\times10^{-2}$ mol, per mol of the silver. If they are precursors, the amount thereof to be used is preferably the same as described before.

In the constitutional layers of the heat-developable photographic material or dye-fixing material, use can be made of various surface-active agents for various purposes of, for example, serving as a coating aid, improving releasability and slipping property, preventing electrification, or accelerating development. Specific examples of the surface-active agents are described, for example, in the above Research Disclosures and JP-A-62-173463 and JP-A-62-183457.

In the constitutional layers of the heat-developable photographic material or dye-fixing material, an organofluoro compound may also be contained, for example, for the purposes of improving slipping properties, preventing electrification, and improving releasability. Typical examples of the organofluoro compound include hydrophobic fluoro compounds, including solid fluoro compound resins, such as ethylene tetrafluoride resins, or oily fluoro compounds, such as fluoro oils; or fluorine-containing surface-active agents described, for example, in JP-B-57-9053, column 8 to column 17, JP-A-61-20944, and JP-A-62-135826.

In the heat-developable photographic material and the dye-fixing material, a matting agent can be used for the purpose of adhesion prevention, improvement of slipping property, etc. Example matting agents include compounds, including silicon dioxide, polyolefins, polymethacrylates, and the like, as described in JP-A-61-88256, page (29), as well as compounds, including benzoguanamine resin beads, polycarbonate resin beads, ABS resin beads, and the like, described in JP-A-63-274944 and JP-A-63-274952. As other matting agents, compounds described in the above Research Disclosures can be used.

These matting agents are added into the uppermost layer (protective layer), and also into a lower layer if required.

Further, the constitutional layers of the heat-developable photographic material and the dye-fixing material may contain a heat solvent, an antifoaming agent, a germ-proofing agent, a mildew-proofing agent, colloidal silica, etc. Specific examples of these additives are described, for example, in JP-A-61-88256, pages (26) to (32); JP-A-3-11338, and JP-B-2-51496.

In the present invention, an image-formation-accelerating agent can be used in the heat-developable light-sensitive material and/or the dye-fixing material. Image-formation-accelerating agents function, for example, to accelerate the redox reaction between a silver salt oxidizing agent and a reducing agent, to accelerate a dye formation reaction from a dye-providing compound, a dye decomposition reaction, or a diffusion dye-releasing reaction, and to accelerate transfer of a dye from a layer of a heat-developable light-sensitive material to a dye-fixing layer. These agents are classified, from the physicochemical functional point of view, for example, into bases or base precursors, nucleophilic compounds, high-boiling organic solvents (oils), heat solvents, surfactants, and compounds interactive with silver or silver ions. However, generally these compounds have a composite function, and they usually possess some of the above acceleration effects in combination. The details thereof are described in U.S. Pat. No. 4,678,739, columns 38 to 40.

As the base precursor, for example, salts of organic acids with bases that will be decarboxylated by heat, as well as compounds that will release amines by intramolecular nucleophilic substitution reaction, Lossen rearrangement, or Beckman rearrangement, are mentioned. Specific examples thereof are described, for example, in U.S. Patent Nos. 4,514,493 and 4,657,848.

In the system wherein the heat development and the transfer of the dye are carried out simultaneously in the presence of a small amount of water, a base and/or a base precursor is preferably contained in the dye-fixing material, with a view to increasing the preservability of the heat-developable light-sensitive material.

In addition to the above, combinations of hardly soluble (in water) metal compounds described in EP-A-210 660 and U.S. Pat. No. 4,740,445 with compounds capable of complex formation reaction with metal ions constituting these hardly soluble compounds (referred to as complex-forming compounds), and compounds capable of producing a base by electrolysis, as described in JP-A-61-232451, can also be used as the base precursor. Particularly the former means is effective. The hardly soluble metal compound and the complex-forming compound are advantageously added separately to the heat-developable light-sensitive material and the dye-fixing element, as described in the above patent publications.

In the present invention, in the heat-developable photographic material and/or the dye-fixing material, in order to obtain a constant image all the time, against fluctuation of the processing temperature and the processing time at the time of development, various development-stopping agents can be used.

Herein, the term "a development-stopping agent" means a compound that neutralizes bases quickly or reacts quickly with bases after suitable development, to lower the base concentration in the film, to stop the development; or a compound that interacts with silver and silver salts, to inhibit the development. Specific examples include acid precursors that release an acid when heated, electrophilic compounds that undergo a substitution reaction with coexisting bases when heated, nitrogen-containing heterocyclic compounds, mercapto compounds, and their precursors. Details are described in JP-A-62-253159, pages (31) to (32).

As the base (support) of the heat-developable light-sensitive material and the dye-fixing material in the present invention, those that can withstand the processing temperature are used. Generally, photographic bases, such as papers and synthetic polymers (films) described in "Shashin Kogaku no Kiso—Ginen Shashin-hen—," edited by Nihon Shashin-gakkai and published by Korona-sha, 1979, pages (223) to (240), can be mentioned. Specifically, use is made of polyethylene terephthalates, polyethylene naphthalates, polycarbonates, polyvinyl chlorides, polystyrenes, polypropylenes, polyimides, celluloses (e.g., triacetylcellulose), those obtained by incorporating a pigment, such as titanium oxide, into films made of these, synthetic papers made from polypropylenes or the like by the film method, papers made by mixing synthetic resin pulps, for example, of polyethylenes, with natural pulp, Yankee paper, baryta paper, coated papers (particularly, cast-coated paper), metals, cloths, glasses, etc.

These may be used singly or may be used in the form of a base one or both of whose surfaces are laminated with a synthetic polymer, such as polyethylenes. This laminate layer can be previously formed to contain, if necessary, a dye or a pigment, such as titanium oxide, ultramarine, and carbon black.

In addition to the above, bases described, for example, in JP-A-62-253159, pages (29) to (31), JP-A-1-61236, pages (14) to (17), JP-A-63-316848, JP-A-2-22651, JP-A-3-56955, and U.S. Pat. No. 5,001,033 can be used.

The backing surface of these bases may be coated with a hydrophilic binder plus a semiconductive metal oxide, such as tin oxide and alumina sol, carbon black, and another antistatic agent. Specifically, bases described, for example, in JP-A-63-220246 can be used.

Further, preferably the surface of the base is subjected to various surface treatments or it is provided with various undercoats, for the purpose of improving the adhesion to the hydrophilic binder.

Example methods of exposing the heat-developable light-sensitive material to light and recording the image, include a method wherein a landscape, a man, or the like is directly photographed by a camera or the like; a method wherein a reversal film or a negative film is exposed to light using, for example, a printer, or an enlarging apparatus; a method wherein an original picture is subjected to scanning exposure through a slit by using an exposure system of a copying machine or the like; a method wherein light-emitting diodes and various lasers (e.g. laser diodes and gas lasers) are allowed to emit light, to carry out scanning exposure through image information and electrical signals (methods described, for example, in JP-A-2-129625, JP-A-5-176144, JP-A-5-199372, and JP-A-6-127021); and a method wherein image information is outputted to an image display apparatus, such as a CRT, a liquid crystal display, an electroluminescence display, and a plasma display, and exposure is carried out directly or through an optical system.

Light sources that can be used for recording an image on the heat-developable light-sensitive material, as mentioned above, include natural light and light sources and exposure methods described in U.S. Pat. No. 4,500,626, column 56, and JP-A-2-53378 and JP-A-2-54672, such as a tungsten lamp, a light-emitting diode, a laser light source, and a CRT light source.

Image-wise exposure can be carried out by using a wavelength-converting element that uses a nonlinear optical material and a coherent light source, such as laser rays, in combination. Herein the term "nonlinear optical material" refers to a material that can develop nonlinearity of the electric field and the polarization that appears when subjected to a strong photoelectric field, such as laser rays, and inorganic compounds, represented by lithium niobate, potassium dihydrogenphosphate (KDP), lithium iodate, and $BaB_2O_4$; urea derivatives, nitroaniline derivatives, nitropyridine-N-oxide derivatives, such as 3-methyl-4-nitropyridine-N-oxide (POM); and compounds described in JP-A-61-53462 and JP-A-62-210432 can be preferably used. As the form of the wavelength-converting element, for example, a single crystal optical waveguide type and a fiber type are known, both of which are useful.

Further, the above image information can employ, for example, image signals obtained from video cameras, electronic still cameras, and the like; television signals, represented by Nippon Television Singo Kikaku (NTSC); image signals obtained by dividing an original picture into a number of picture elements by a scanner or the like; and an image signals produced by a computer, represented by CG or CAD.

The heat-developable light-sensitive material and/or the dye-fixing material of the present invention may be in the form that has an electroconductive heat-generating material layer as a heating means for heat development and diffusion transfer of the dye. In this case, as the heat-generating element, one described, for example, in JP-A-61-145544 can be employed.

The heating temperature in the heat development process is about 50 to 250° C. and particularly a heating temperature of about 60 to 180° C. is useful. The diffusion transfer process of the dye may be carried out simultaneously with the heat development or after the completion of the heat development process. In the latter case, the heating temperature in the transfer process may be in the range from the temperature in the heat development process to the room temperature and is preferably particularly 50° C. or more to a temperature about 10° C. lower than the heat development process.

Although the transfer of the dye can be brought about only by heat, a solvent may be used to accelerate the dye transfer. Further, it is also useful to use a method described, for example, in U.S. Pat. Nos. 4,704,345, 4,740,445, and JP-A-61-238056 wherein the development and the transfer are carried out at the same time or successively by heating in the presence of a small amount of a solvent (particularly water). In this system, the heating temperature is preferably 50° C. or higher, but the boiling point of the solvent or lower. For example, in the case wherein the solvent is water, the heating temperature is preferably 50° C. to 100° C.

Examples of the solvent that is used for acceleration of the development and/or for diffusion transfer of dyes include water, an aqueous basic solution containing an inorganic alkali metal salt or an organic base (as the base, those described in the section of image-formation-accelerating agents can be used), a low-boiling solvent, and a mixed solution of a low-boiling solvent with water or the above-mentioned aqueous basic solution. Also, a surface-active agent, an antifoggant, a complexing compound with a hardly-soluble metal salt, a mildew-proofing agent, and an antifungus agent may be contained in the solvent.

As the solvent to be used in these heat development or diffusion transfer steps, water is preferably used, and the water may be any water that is generally used. Specifically, for example, distilled water, tap water, well water, and mineral water can be used. In the heat-development apparatus in which the heat-developable light-sensitive material of the present invention and an dye-fixing material are used, water may be used only once, or it may be circulated for repeated use. In the latter case, water that contains components dissolved out of the material will be used. Also, apparatuses and water described, for example, in JP-A-63-144354, JP-A-63-144355, JP-A-62-38460, and JP-A-3-21055 may be used.

These solvents may be used in such a way that they are applied to the heat-developable light-sensitive material or the dye-fixing material or to both of them. The amount of the solvent to be used may be the weight of the solvent corresponding to or below the maximum swell volume of the entire coated film.

As the method of applying water, for example, methods described in JP-A-62-253159, page (5), JP-A-63-85544, and JP-A-10-26818 are preferably used. Further, the solvent may be enclosed in microcapsules or may take the form of a hydrate, to be previously built into either or both of the heat-developable light-sensitive material and dye-fixing material, for use.

The suitable temperature of the water to be applied is generally 30 to 60° C., as described, for example, in JP-A-

63-85544, supra. It is particularly useful to make temperature 45° C. or more, in view of prevention of propagation of bacteria in water.

To accelerate the dye transfer, a system can be adopted wherein a hydrophilic heat solvent that is solid at normal temperatures and melts at a higher temperature is built in the heat-developable light-sensitive material and/or the dye-fixing material. The layer wherein the hydrophilic heat solvent is built in may be any of the light-sensitive silver halide emulsion layer, the intermediate layer, the protective layer, and the dye-fixing layer, but preferably it is the dye-fixing layer and/or the layer adjacent thereto.

Examples of the hydrophilic heat solvent are ureas, pyridines, amides, sulfonamides, imides, alcohols, oximes, and other heterocycles.

Example heating methods in the development step and/or transfer step include one wherein the photographic material is brought in contact with a heated block or plate; a method wherein the photographic material is brought in contact with a hot plate, a hot presser, a hot roller, a hot drum, a halogen lamp heater, an infrared lamp heater, or a far-infrared lamp heater; and a method wherein the photographic material is passed through a high-temperature atmosphere. As a method wherein the heat-developable light-sensitive material and a dye-fixing material are placed one upon the other, methods described in JP-A-62-253159 and JP-A-61-147244, on page (27), can be applied.

To process the photographic elements for use in the present invention, any of various heat development apparatuses can be used. For example, apparatuses described, for example, in JP-A-59-75247, JP-A-59-177547, JP-A-59-181353, and JP-A-60-18951, unexamined published Japanese Utility Model Application (JU-A) No. 62-25944, and JP-A-6-130509, JP-A-6-95338, and JP-A-6-95267 are preferably used. As a commercially available apparatus, for example, a PICTROSTAT 100, a PICTROSTAT 200, a PICTROGRAPHY 3000, and a PICTROGRAPHY 2000 (all trade names, manufactured by Fuji Photo Film Co., Ltd.), can be used.

In the case wherein the above image obtained by means of the heat-developable light-sensitive material and the dye-fixing element is used as a color proof for printing, the method for expressing the density may be any method of the continuous gradation control, the area gradation control that uses a part having discontinuous density, or the gradation control that is the combination of them.

By using an LD (laser diode) or LED (light-emitting diode) as an exposure light source, the output of digital signal is made possible. Thus, the using method wherein the control of the design and the image including the tinge or the like of printed products can be made on a CRT and a color proof is outputted as a final output (DDCP), becomes possible. Namely, the DDCP serves as an effective means for carrying out the output of a proof efficiently in the field of color proofs. This is because color printers are relatively simply constituted and inexpensive; in color printers, as is well known, the preparation of process films for color printers and the preparation of press plates (presensitizing printing plates, so called PS plates) or the like are not required; and hard copies each having an image on a sheet can be made easily several times in a short preriod of time.

When an LD or LED is used as an exposure light source, the three spectral sensitivities of yellow, magenta, and cyan, the four spectral sensitivities of yellow, magenta, cyan, and black, or the spectral sensitivities of respective colors obtained by mixing two or more coloring materials for the purpose of obtaining desired hue, preferably have the peaks of the spectral sensitivities on separate wavelengths 20 nm or more apart, respectively. As another method, there is a method, wherein an image having two or more colors is obtained by using one exposure wavelength, when the spectral sensitivities of two or more colors are different 10 times or more in their sensitivity difference.

Now, a method of reproducing moire or the like on printed matter by a color printer is described.

In order to form a color proof for printing that reproduces faithfully, for example, moire appearing on high resolution printed matter by a low resolution color printer, for every dot area ratio data aj of a CMYK 4 plate, the threshold value matrix 24 is referred to and the conversion to bit map data b'j of each 48800 DPI is made. Then, bit map data b'j in a certain range are referred to simultaneously, to count the area ratio ci of each color. Then, the first tristimulus value data X, Y, and Z of 1600 DPI that are colorimetry value data of the above respective colors previously found, are calculated. The first tristimulus value data X, Y, and Z are subjected to anti-aliasing filtering, to calculate the second tristimulus value data X', Y', and Z' of 400 DPI. The calculated data are used as input data of the color printer. (The foregoing is described in detail in JP-A-8-192540.)

When a color image is recorded using an output apparatus, such as a color printer, a color image having a desired color can be realized by operating color signals related, for example, to yellow, magenta, and cyan. However, since the above color signals depend on the output properties of the output apparatus, color signals fed from an external apparatus having different properties are required to be subjected to color conversion processing with the above output properties taken into consideration.

Therefore, there is a method, wherein several known color patches different in color are made by using the particular output apparatus, the colors of the color patches are measured, to obtain, for example, the conversion relation for converting the known color signals CMY of the color patches to stimulus value signals XYZ independent of the output apparatus (this conversion relation being hereinafter referred to as "forward conversion relation"); and, from this forward conversion relationship, the conversion relation for converting the stimulus value signals XYZ to color signals CMY (this conversion relation being hereinafter referred to as "reverse conversion relation") is found; and this reverse relation is used to carry out the above color conversion processing.

Herein, as a method for finding color signals CMY from the above stimulus value signals XYZ, three examples are given below, which do not limit the present invention.

1. A method wherein tetrahedrons whose apexes are four stimulus value signals XYZ are set, the spaces of the stimulus value signals XYZ are divided by the tetrahedrons, the spaces of color signals CMY are similarly divided by tetrahedrons, and color signals CMY corresponding to any stimulus value signals XYZ in corresponding tetrahedrons are found by linear computing.

2. A method wherein color signals CMY corresponding to any stimulus value signals XYZ are found by repeat operation using the Newton method. (see *PHOTOGRAPHIC SCIENCE AND ENGINEERING,* Volume 16, Number 2, March–April 1972, pp 136–143 "Metameric color matching in subtractive color photography.")

3. A color conversion method for converting color signals from a first colorimetric system to a second colorimetric system, comprising a first step of finding, as a first forward conversion relation, the relation of real color signals of the said first colorimetric system obtained from known real color signals of the said second colorimetric system, a second step of approximating the said first forward conversion relation by a monotone function to set virtual color signals outside the region consisting of the said real color signals, a third step of finding, as a second forward conversion relation, the relation of the particular color signals of the said first colorimetric system obtained from color signals consisting of the said real color signals in the said second colorimetric system and the said virtual color signals, and a fourth step of finding, as a reverse conversion relation, the relation of color signals of the said first colorimetric system from the said second conversion relation using a repeat operation, thereby color signals are converted from the first colorimetric system to the second colorimetric system using the said reverse conversion relation. Namely, in this color conversion method for converting color signals from a first colorimetric system to a second colorimetric system, after real color signals (e.g., XYZ color signals) of a first colorimetric system corresponding to known real color signals (e.g., CMY color signals) of a second colorimetric system are found, a first forward conversion relation between these real color signals is approximated by a monotone function, to set virtual color signals outside the region consisting of the said real color signals. Then, based on a second forward conversion relation between the first colorimetric system and the second colorimetric system consisting of the said real color signals and the said virtual color signals, a reverse conversion relation for converting to the said first colorimetric system and the said second colorimetric system is found using a repeat operation represented by the Newton method, to convert colors using this reverse conversion relation, which method is mentioned by way of example.

The size of the image obtained by the above heat-developable light-sensitive material and the dye-fixing element may be any of a standard size of series A, A1 to A6, a Kiku-size (a medium octabo), a standard size of series B, B1 to B6, and a Shiroku-ban-size (duodecimo). Further, in accordance with the size, the size of the heat-developable light-sensitive material and the dye-fixing element may have any width generally in the range of 100 to 2,000 mm.

The heat-developable light-sensitive material and the dye-fixing element may be fed in the form of a roll or a sheet and also a combination is possible wherein only one of them is in the form of a roll and the other is in the form of a sheet.

The image element of the present invention has high color density in image, and it is excellent in light fastness. Furthermore, according to the method of forming color diffusion transfer image of the present invention, such images excellent in color density and light fastness can be formed.

Next, the present invention is described in more detail on the basis of the following examples, but the invention is not limited to those.

EXAMPLE

Example 1

Dye-fixing element (Image-receiving sheet) R-1, having the constitution as shown in Tables 1 and 2, was prepared.

TABLE 1

Constitution of Base

| Name of layer | Composition | Film thickness (μm) |
|---|---|---|
| Surface undercoat layer | Gelatin | 0.1 |
| Surface PE layer (Glossy) | Low-density polyethylene (Density 0.923) :90.2 parts<br>Surface-processed titanium oxide :9.8 parts<br>Ultramarine :0.001 parts | 36.0 |
| Pulp layer | Fine quality paper (LBKP/NBKP = 6/4, Density 1.053) | 152.0 |
| Back-surface PE layer (Matte) | High-density polyethylene (Density 0.955) | 27.0 |
| Back-surface undercoat layer | Styrene/acrylate copolymer<br>Colloidal silica<br>Polystyrenesulfonic acid sodium salt | 0.1 |
| | | 215.2 |

TABLE 2

Constitution of Image-Fixing Element R-1

| Number of layer | Additive | Coated amount ($mg/m^2$) |
|---|---|---|
| Sixth layer | Water-soluble polymer (1) | 130 |
| | Water-soluble polymer (2) | 35 |
| | Water-soluble polymer (3) | 45 |
| | Potassium nitrate | 20 |
| | Anionic surfactant (1) | 6 |
| | Anionic surfactant (2) | 6 |
| | Amphoteric surfactant (1) | 50 |
| | Stain-preventing agent (1) | 7 |
| | Stain-preventing agent (2) | 12 |
| | Matting agent (1) | 7 |
| Fifth layer | Gelatin | 250 |
| | Water-soluble polymer (1) | 25 |
| | Anionic surfactant (3) | 9 |
| | Hardener (1) | 185 |
| Forth layer | Mordant (1) | 1850 |
| | Water-soluble polymer (2) | 260 |
| | Water-soluble polymer (4) | 1400 |
| | Dispersion of latex (1) | 600 |
| | Anionic surfactant (3) | 25 |
| | Nonionic surfactant (1) | 18 |
| | Guanidine picolinate | 2550 |
| | Sodium quinolinate | 350 |
| Third layer | Gelatin | 370 |
| | Mordant (1) | 300 |
| | Anionic surfactant (3) | 12 |
| Second layer | Gelatin | 700 |
| | Mordant (1) | 290 |
| | Water-soluble polymer (1) | 55 |
| | Water-soluble polymer (2) | 330 |
| | Anionic surfactant (3) | 30 |
| | Anionic surfactant (4) | 7 |
| | High-boiling organic solvent (1) | 700 |
| | Brightening agent (1) | 30 |
| | Stain-preventing agent (3) | 32 |
| | Guanidine picolinate | 360 |
| | Sodium quinolinate | 45 |
| First layer | Gelatin | 280 |
| | Water-soluble polymer (1) | 12 |
| | Anionic surfactant (1) | 14 |
| | Sodium metaborate | 35 |

TABLE 2-continued

| Constitution of Image-Fixing Element R-1 | | | |
|---|---|---|---|
| Number of layer | Additive | | Coated amount ($mg/m^2$) |
| | Hardener (1) | | 185 |
| Base | Paper Support of Table 1 | (thickness 215.2 $\mu$m) | |

The coated amount of dispersion of latex is in terms of the coated amount of solid content of latex.

Anionic surfactant (1)

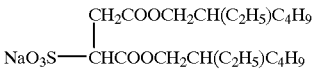

Anionic surfactant (2)

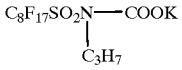

Anionic surfactant (3)

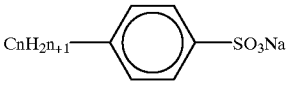

n = 12.6

Anionic surfactant (4)

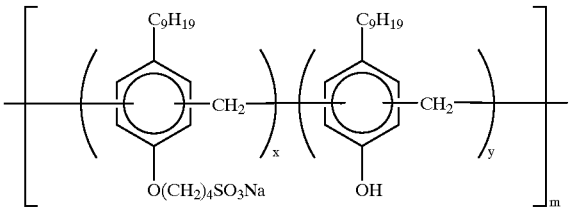

x:y = 4:6 (weight ratio)
m = 6.8

Nonionic surfactant (1)

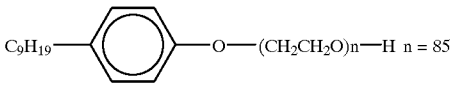

Amphoteric surfactant (1)

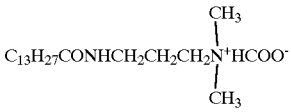

Brightening agent (1)

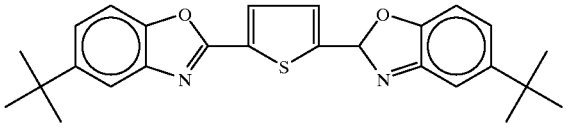

Mordant (1)

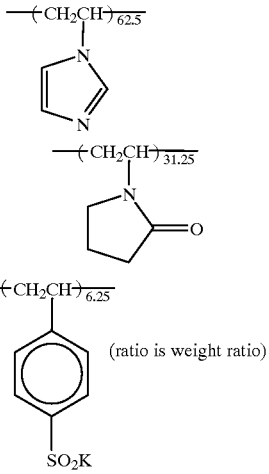

(ratio is weight ratio)

Anti-stain agent (1)

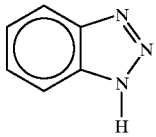

Anti-stain agent (2)

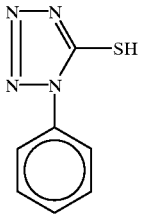

Anti-stain agent (3)

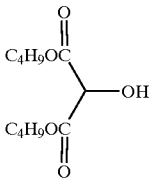

High-boiling organic solvent (1)

$C_{26}H_{26-9}Cl_{7-1}$ (EMPARA 40[trade name: manufactured by Ajinomoto K.K.])

Water-Soluble polymer (1)

Sumikagel L5-H (trade name: manufactured by Sumitomo Kagaku CO.)

Water-Soluble polymer (2)

Dextran (molecular weight 70,000)

Water-Soluble polymer (3)

κ(kappa) -Carrageenan (trade name: manufactured by Taito Co.)

Water-Soluble polymer (4)

MP polymer MP-102 (trade name: manufactured by Kuraray Co.)

Dispersion of latex (1)

LX-438 (trade name: manufactured by Nippon Zeon Co.)

Matting agent (1)

SYLOID79 (trade name: manufactured by Fuji Davisson Kagaku Co.)

Mordant (1)

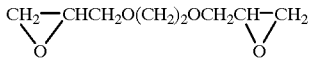

Next, Image-receiving sheets R-2 to R-15 having the same composition as that of R-1 were prepared, except that a compound for comparison or the compound for use in the present invention was added to the fourth layer, as shown in Table 3, respectively.

TABLE 3

| Image-receiving sheet No. | Kind of anti-fading agent | Added amount ($mmol/m^2$) |
|---|---|---|
| R-1 | none | — |
| R-2 | A | 0.5 |
| R-3 | A | 1 |
| R-4 | B | 0.5 |
| R-5 | B | 1 |
| R-6 | C | 1 |
| R-7 | D | 0.5 |
| R-8 | TB-6 | 1.0 |
| R-9 | TB-14 | 1.0 |
| R-10 | TB-17 | 1.0 |
| R-11 | TB-32 | 1.0 |
| R-12 | TB-50 | 0.5 |
| R-13 | TB-52 | 0.5 |
| R-14 | TB-64 | 0.5 |
| R-15 | TB-71 | 1.0 |

A

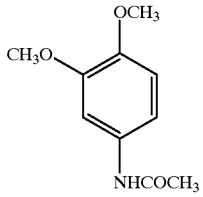

B

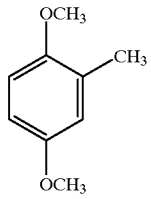

C

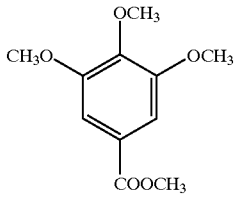

-continued

D

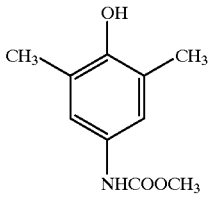

Next, the methods of preparing light-sensitive elements are described.

First, the methods of preparing light-sensitive silver halide emulsions are described.

Light-Sensitive Silver Halide Emulsion (1) [Emulsion for Fifth Layer (680-nm Light-sensitive Layer)]

To a well-stirred aqueous solution having the composition shown in Table 4, were added Solutions (I) and (II) each having the composition shown in Table 5, simultaneously over 13 min, and after 10 min, Solutions (III) and (IV) each having the composition shown in Table 5 were added over 33 min.

TABLE 4

| Composition | |
|---|---|
| $H_2O$ | 620 cc |
| Lime-processed gelatin | 20 g |
| KBr | 0.3 g |
| NaCl | 2 g |
| Silver halide solvent ① | 0.03 g |
| Sulfuric acid (1N) | 16 cc |
| Temperature | 45° C. |

TABLE 5

| | Solution (I) | Solution (II) | Solution (III) | Solution (IV) |
|---|---|---|---|---|
| $AgNO_3$ | 30.0 g | none | 70.0 g | none |
| KBr | none | 13.7 g | none | 44.2 g |
| NaCl | none | 3.62 g | none | 2.4 g |
| $K_2IrCl_3$ | none | none | none | 0.39 mg |
| Total volume | water to make 126 ml | water to make 132 ml | water to make 254 ml | water to make 252 ml |

Silver halide solvent ①

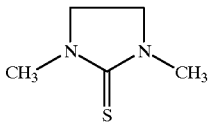

After 13 min of the start of the addition of Solution III, 150 cc of an aqueous solution containing 0.350% of Sensitizing Dye ① was added over 27 min.

After washing with water and desalting (that was carried out using Settling Agent a, at a pH of 4.1) in a usual manner, 22 g of lime-processed ossein gelatin was added, and after adjusting the pH and pAg to 6.0 and 7.9 respectively, the chemical sensitization was carried out at 60° C. The compounds used in the chemical sensitization are shown in Table 6.

The yield of the obtained emulsion was 630 g, and the emulsion was a monodisperse cubic silver chlorobromide emulsion having a deviation coefficient of 10.2% and an average grain size of 0.20 μm.

Sensitizing dye ①

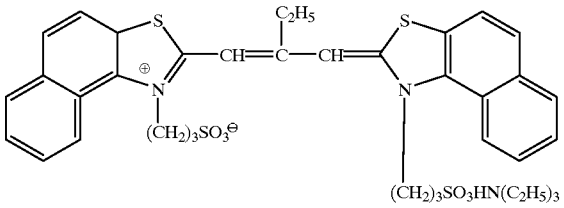

TABLE 6

| Chemicals used in chemical sensitization | Added amount |
|---|---|
| 4-hydroxy-6-methyl-1,3,3a,7-tetrazaindene | 0.36 g |
| Sodium thiosulfate | 6.75 mg |
| Antifoggant ① | 0.11 g |
| Antiseptic ① | 0.07 g |
| Antiseptic ② | 3.31 g |

Settling agent a

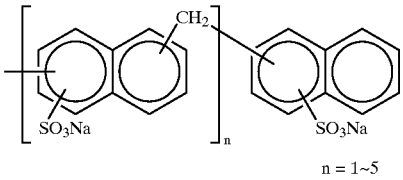

n = 1~5

Antifoggant ①

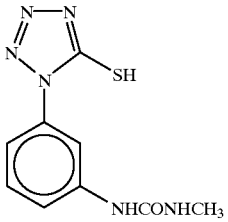

Antiseptic ①

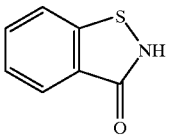

Antiseptic ②

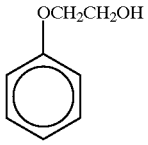

Light-Sensitive Silver Halide Emulsion (2) [Emulsion for Third Layer (750-nm Light-sensitive Layer)]

To a well-stirred aqueous solution having the composition shown in Table 7, were added Solutions (I) and (II) each having the composition shown in Table 8, simultaneously over 18 min, and after 10 min, Solutions (III) and (IV) each having the composition shown in Table 8 were added over 24 min.

TABLE 7

| Composition | |
|---|---|
| $H_2O$ | 620 cc |
| Lime-processed gelatin | 20 g |
| KBr | 0.3 g |
| NaCl | 2 g |
| Silver halide solvent ① | 0.03 g |
| Sulfuric acid (1N) | 16 cc |
| Temperature | 45° C. |

TABLE 8

| | Solution (I) | Solution (II) | Solution (III) | Solution (IV) |
|---|---|---|---|---|
| $AgNO_3$ | 30.0 g | none | 70.0 g | none |
| KBr | none | 13.7 g | none | 44.2 g |
| NaCl | none | 3.62 g | none | 2.4 g |
| $K_4[Fe(CN)_6] \cdot H_2O$ | none | none | none | 0.07 g |
| $K_2IrCl_6$ | none | none | none | 0.04 mg |
| Total volume | water to make 188 ml | water to make 188 ml | water to make 250 ml | water to make 250 ml |

After washing with water and desalting (that was carried out using Settling Agent b at a pH of 3.9) in a usual manner, 22 g of lime-processed ossein gelatin from which calcium had been removed (the calcium content: 150 ppm or less) was added, re-dispersing was made at 40° C., 0.39 g of 4-hydroxy-6-methyl-1,3,3a,-7-tetrazaindene was added, and the pH and pAg were adjusted to 5.9 and 7.8 respectively. Thereafter the chemical sensitization was carried out at 70° C. using the chemicals shown in Table 9. Further, at the end of the chemical sensitization, Sensitizing Dye ② in the form of a methanol solution (the solution having the composition shown in Table 10) was added. After the chemical sensitization, the temperature was lowered to 40° C. and then 200 g of the later-described gelatin dispersion of Stabilizer ① was added, followed by stirring well and keeping in a case. The yield of the thus-obtained emulsion was 938 g, and the emulsion was a monodisperse cubic silver chlorobromide emulsion having a deviation coefficient of 12.6% and an average grain size of 0.25 μm. In this connection, the emulsion for a 750-nm light-sensitive layer had spectral sensitivity of the J-band type.

TABLE 9

| Chemicals used in chemical sensitization | Added amount |
|---|---|
| 4-hydroxy-6-methyl-1,3,3a,7-tetrazaindene | 0.39 g |
| Triethylthiourea | 3.3 mg |
| Nucleic acid decomposition product | 0.39 g |
| NaCl | 0.15 g |
| KI | 0.12 g |
| Antifoggant ② | 0.10 g |
| Antiseptic ① | 0.07 g |

TABLE 10

| Composition of dye solution | Added amount |
|---|---|
| Sensitizing dye ② | 0.19 g |
| Methanol | 18.7 cc |

Stabilizer ①

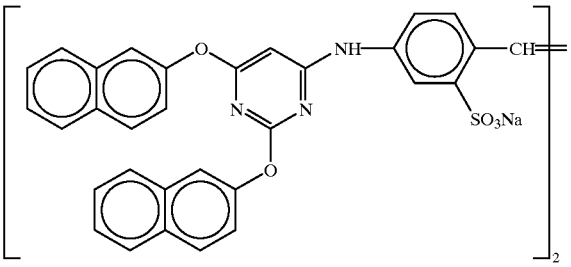

Antifoggant ②

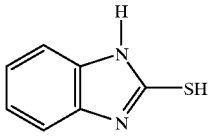

Sensitizing dye ②

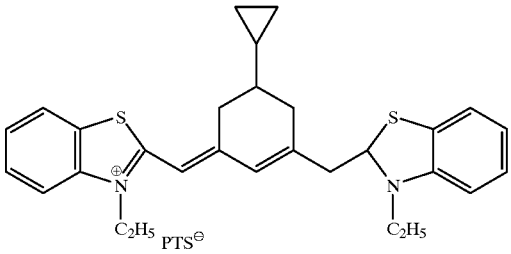

PTS = Para-toluenesulfonic acid

Settling agent b

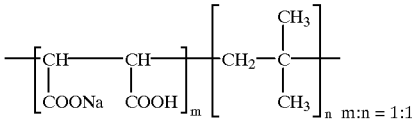

Light-Sensitive Silver Halide Emulsion (3) [Emulsion for First Layer (810-nm Light-sensitive Layer)]

To a well-stirred aqueous solution having the composition shown in Table 11, were added Solutions (I) and (II) each having the composition shown in Table 12, simultaneously over 18 min, and after 10 min, Solutions (III) and (IV) each having the composition shown in Table 12 were added over 24 min.

TABLE 11

| Composition | |
|---|---|
| $H_2O$ | 620 cc |
| Lime-processed gelatin | 20 g |
| KBr | 0.3 g |
| NaCl | 2 g |
| Silver halide solvent ① | 0.03 g |
| Sulfuric acid (1N) | 16 cc |
| Temperature | 50° C. |

TABLE 12

| | Solution (I) | Solution (II) | Solution (III) | Solution (IV) |
|---|---|---|---|---|
| $AgNO_3$ | 30.0 g | none | 70.0 g | none |
| KBr | none | 13.7 g | none | 44.1 g |

TABLE 12-continued

| | Solution (I) | Solution (II) | Solution (III) | Solution (IV) |
|---|---|---|---|---|
| NaCl | none | 3.62 g | none | 2.4 g |
| $K_2IrCl_6$ | none | none | none | 0.02 mg |
| Total volume | water to make 180 ml | water to make 181 ml | water to make 242 ml | water to make 250 ml |

After washing with water and desalting (that was carried out using Settling Agent a at a pH of 3.8) in a usual manner, 22 g of lime-processed ossein gelatin was added, and after adjusting the pH and pAg to 7.4 and 7.8 respectively, the chemical sensitization was carried out at 60° C. The compounds used in the chemical sensitization are shown in Table 13. The yield of the thus-obtained emulsion was 680 g, and the emulsion was a monodisperse cubic silver chlorobromide emulsion having a deviation coefficient of 9.7% and an average grain size of 0.32 μm.

TABLE 13

| Chemicals used in chemical sensitization | Added amount |
|---|---|
| 4-hydroxy-6-methyl-1,3,3a,7-tetrazaindene | 0.38 g |
| Triethylthiourea | 3.1 mg |
| Antifoggant ② | 0.19 g |
| Antiseptic ① | 0.07 g |
| Antiseptic ② | 3.13 g |

The preparation method of a gelatin dispersion of colloidal silver is described.

To a well-stirred aqueous solution having the composition shown in Table 14, was added a Solution having the composition shown in Table 15, over 24 min. Thereafter, the washing with water using Settling Agent a was carried out, then 43 g of lime-processed ossein gelatin was added, and the pH was adjusted to 6.3. The average grain size of the thus-obtained grains in the dispersion was 0.02 μm and the yield was 512 g. (The dispersion was a dispersion containing silver 2% and gelatin 6.8%.)

TABLE 14

| Composition | |
|---|---|
| $H_2O$ | 620 cc |
| Dextrin | 16 g |
| NaOH (5N) | 41 cc |
| Temperature | 30° C. |

TABLE 15

| Composition | |
|---|---|
| $H_2O$ | 135 cc |
| $AgNO_3$ | 17 g |

Next, the preparation methods of gelatin dispersions of hydrophobic additives are described.

A gelatin dispersion of each of a yellow coupler, a magenta coupler, a cyan coupler, and a developing agent whose formulation is shown in Table 16, was prepared, respectively. That is, the oil phase components were dissolved by heating to about 70° C., to form a uniform solution, and to the resultant solution, was added the aqueous phase components that had been heated to about 60° C., and after stirring and mixing them, the resultant mixture was dispersed for 10 min at 10,000 rpm by a homogenizer. To the resultant dispersion, was added additional water, followed by stirring, to obtain a uniform dispersion.

TABLE 16

| | | Composition of dispersion | | |
|---|---|---|---|---|
| | | Yellow | Magenta | Cyan |
| Oil phase | Cyan coupler C-28 | none | none | 7.0 g |
| | Magenta coupler C-28 | none | 7.0 g | none |
| | Yellow coupler C-30 | 7.0 g | none | none |
| | Developing agent R-31 | none | none | 5.6 g |
| | Developing agent D-37 | none | 5.6 g | none |
| | Developing agent D-37 | 5.6 g | none | none |
| | Antifoggant (5) | 0.25 g | none | none |
| | Antifoggant (2) | none | 0.25 g | 0.25 g |
| | High-boiling solvent (4) | 7.4 g | 7.4 g | 7.4 g |
| | Dye (a) | 1.1 g | none | 0.5 g |
| | Ethyl acetate | 15 cc | 15 cc | 15 cc |
| Aqueous phase | Lime-processed gelatin | 10.0 g | 10.0 g | 10.0 g |
| | Calcium nitrate | 0.1 g | 0.1 g | 0.1 g |
| | Surfactant (1) | 0.2 g | 0.2 g | 0.2 g |
| | Water | 110 cc | 110 cc | 110 cc |
| | Additional water | 110 cc | 110 cc | 110 cc |
| | Antiseptic (1) | 0.04 g | 0.04 g | 0.04 g |

A gelatin dispersion of Antifoggant (4) and Reducing Agent (1) whose formulation is shown in Table 17 was prepared. That is, the oil phase components were dissolved by heating to about 60° C., to the resultant solution, was added the aqueous phase components that had been heated to about 60° C., and after stirring and mixing them, the resultant mixture was dispersed for 10 min at 10,000 rpm by a homogenizer, to obtain a uniform dispersion.

TABLE 17

| | | Composition of dispersion |
|---|---|---|
| Oil phase | Antifoggant (4) | 0.16 g |
| | Reducing agent (1) | 1.3 g |
| | High-boiling solvent (2) | 2.3 g |
| | High-boiling solvent (5) | 0.2 g |
| | Surfactant (1) | 0.5 g |
| | Surfactant (4) | 0.5 g |
| | Ethyl acetate | 10.0 ml |
| Aqueous phase | Acid-processed gelatin | 10.0 g |
| | Antiseptic (1) | 0.004 g |
| | Calcium nitrate | 0.1 g |
| | Water | 35.0 ml |
| | Additional water | 104.4 ml |

A gelatin dispersion of Reducing Agent (2) whose formulation is shown in Table 18 was prepared. That is, the oil phase components were dissolved by heating to about 60° C., to the resultant solution, was added the aqueous phase components that had been heated to about 60° C., and after stirring and mixing them, the resultant mixture was dispersed for 10 min at 10,000 rpm by a homogenizer, to obtain a uniform dispersion. From the thus-obtained dispersion, ethyl acetate was removed off using a vacuum organic solvent removing apparatus.

TABLE 18

| | | Composition of dispersion |
|---|---|---|
| Oil phase | Reducing agent (2) | 7.5 g |
| | High-boiling solvent (1) | 4.7 g |
| | Surfactant (1) | 1.9 g |
| | Ethyl acetate | 14.4 ml |
| Aqueous phase | Acid-processed gelatin | 10.0 g |
| | Antiseptic (1) | 0.02 g |
| | Gentamicin | 0.04 g |
| | Sodium bisulfite | 0.1 g |
| | Water | 136.7 ml |

A dispersion of Polymer Latex (a) whose formulation is shown in Table 19 was prepared. That is, while a mixed solution of Polymer Latex (a), Surfactant (5), and water whose amounts are shown in Table 19 was stirred, Anionic Surfactant (6) was added thereto, over 10 min, to obtain a uniform dispersion. The resulting dispersion was repeatedly diluted with water and concentrated using a ultrafiltration module (Ultrafiltration Module: ACV-3050, trade name, manufactured by Ashahi Chemical Industry Co., Ltd.), to bring the salt concentration of the dispersion to 1/9, thereby obtaining a discripsion.

TABLE 19

| | Composition of dispersion |
|---|---|
| Polymer Latex (a) aqueous solution (solid content 13%) | 108 ml |
| Surfactant (5) | 20 g |
| Surfactant (6) | 600 ml |
| Water | 1232 ml |

A gelatin dispersion of Stabilizer (1) whose formulation is shown in Table 20 was prepared. That is, the oil phase components were dissolved at room temperature, to the resultant solution, was added the aqueous phase components that had been heated to about 40° C., and after stirring and mixing them, the resultant mixture was dispersed for 10 min at 10,000 rpm by a homogenizer. To the resultant dispersion, was added additional water, followed by stirring, hereby obtaining a uniform dispersion.

TABLE 20

| | | Composition of dispersion |
|---|---|---|
| Oil phase | Stabilizer (1) | 4.0 g |
| | Sodium hydroxide | 0.3 g |
| | Methanol | 62.8 g |
| | Antiseptic (2) | 0.8 g |
| Aqueous phase | Gelatin from which calcium had been removed (Ca content 100 ppm or less) | 10.0 g |
| | Antiseptic (1) | 0.04 g |
| | Water | 320 ml |

A gelatin dispersion of zinc hydroxide was prepared according to the formulation shown in Table 21. That is, after the components were mixed and dissolved, dispersing was carried out for 30 min in a mill, using glass beads having an average particle diameter of 0.75 mm. Then the glass beads were separated and removed off, to obtain a uniform dispersion.

TABLE 21

| | Composition of dispersion |
|---|---|
| Zinc hydroxide | 15.9 g |
| Carboxymethyl cellulose | 0.7 g |
| Poly(sodium acrylate) | 0.07 g |
| Lime-processed gelatin | 4.2 g |
| Water | 100 ml |
| Antiseptic ② | 0.4 g |

The preparation method of a gelatin dispersion of a matting agent that was added to the protective layer is described. A solution containing PMMA dissolved in methylene chloride was added, together with a small amount of a surfactant, to gelatin, and they were stirred and dispersed at high speed. Then the methylene chloride was removed off using a vacuum solvent removing apparatus, to obtain a uniform dispersion having an average particle size of 4.3 μm.

Dye (a)

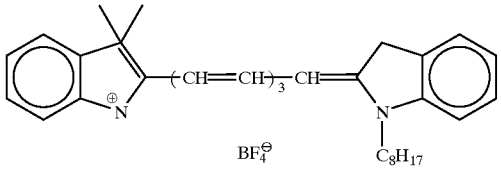

Stabilizer ①

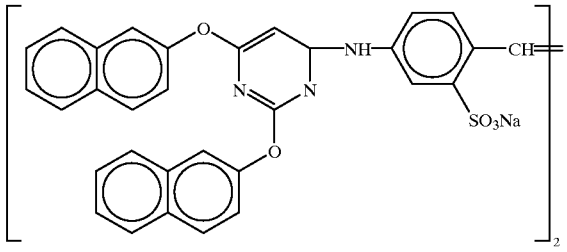

Antiseptic ①

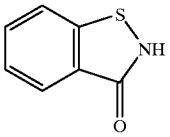

Antiseptic ②

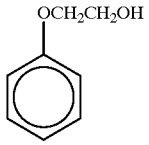

C-28

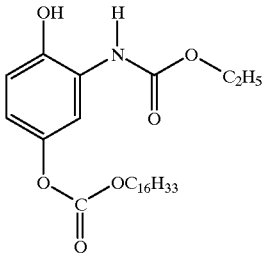

Cyan, Magenta coupler

-continued

C-30

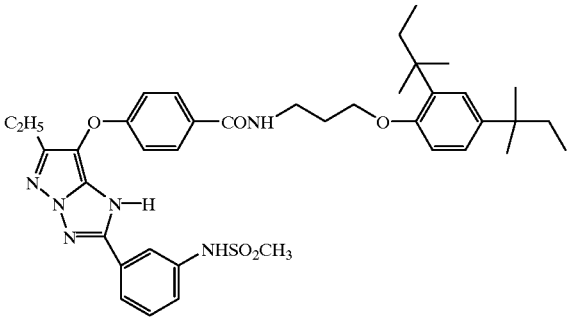

Yellow coupler

R-31

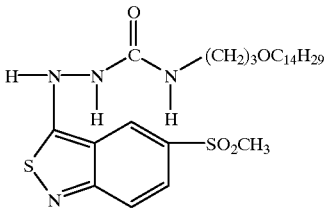

Cyan developing agent

D-37

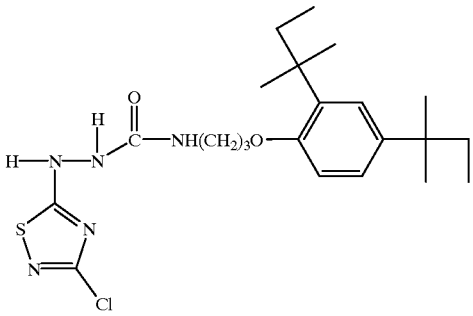

Magenta, Yellow developing agent

Antifoggant ⑤

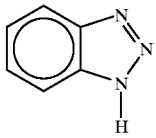

Antifoggant ②

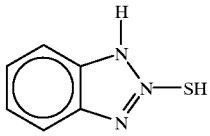

High-boiling organic solvent ④

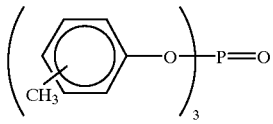

-continued

Antiseptic ①

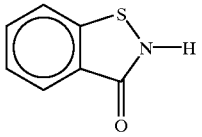

Reducing agent ①

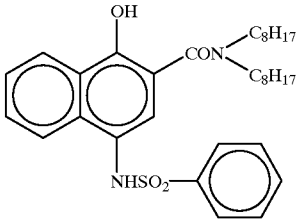

Antifoggant ④

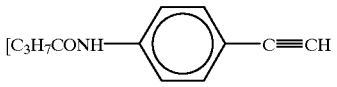

Surfactant ①

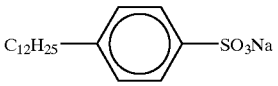

-continued

High-boiling organic solvent ①

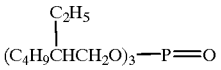

High-boiling organic solvent ②

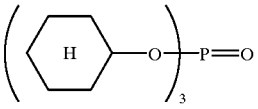

Reducing agent ②

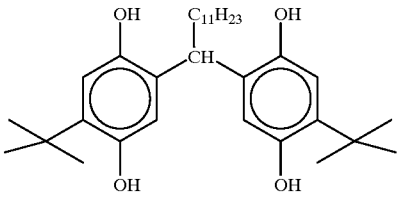

Surfactant ②

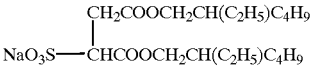

Surfactant ③

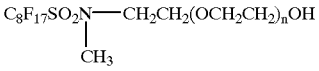

n = 3 ~ 8

Water-soluble polymer ①

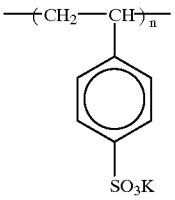

limiting viscosity [η]
= 1.6 (0.1N NaCl, 30° C.)
molecular weight ≒ 1,000,000

Hardener ①

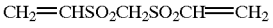

Water-soluble polymer ②

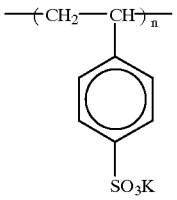

limiting viscosity [η]
= 0.8 (0.1N NaCl, 30° C.)
molecular weight ≒ 400,000

Surfactant ④

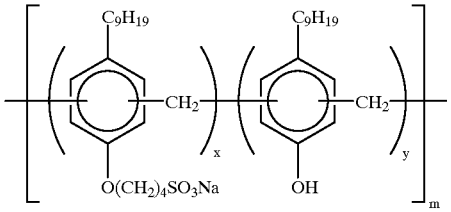

x:y = 4:6
m = 6.8

High-boiling organic solvent ⑤

$C_{26}H_{48-9}Cl_{7-1}$ (EMPARA 40 [trade name: manufactured by Ajinomoto K.K.])

-continued

Polymer Latex (a)

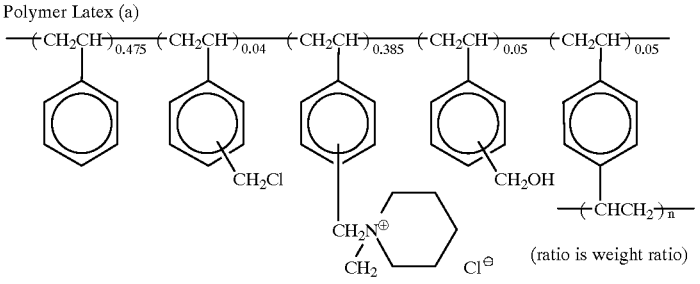

Surfactant ⑤

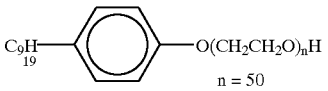

Surfactant ⑥

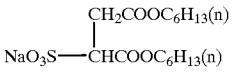

Developing agent (a)

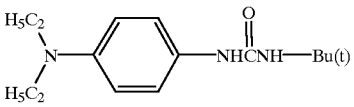

Compound described in JP-A-59-111148

Using the above materials, Light-Sensitive Element shown in Table 22 was prepared.

TABLE 22

Constitution of Main Materials of Light-Sensitive Element 101

| Number of layer | Name of layer | Additive | Added amount (mg/m²) |
|---|---|---|---|
| Seventh layer | Protective layer | Acid-processed gelatin | 442 |
| | | Reducing agent ② | 47 |
| | | High-boiling solvent ① | 30 |
| | | Colloidal silver grains | 2 |
| | | Matting agent (PMMA resin) | 17 |
| | | Surfactant ① | 16 |
| | | Surfactant ② | 9 |
| | | Surfactant ③ | 2 |
| Sixth layer | Intermediate layer | Lime-processed gelatin | 862 |
| | | Antifoggant ④ | 7 |
| | | Reducing agent ① | 57 |
| | | High-boiling solvent ② | 101 |
| | | High-boiling solvent ⑤ | 9 |
| | | Surfactant ① | 21 |
| | | Surfactant ④ | 21 |
| | | Dispersion of Polymer Latex a | 5 |
| | | Water-soluble polymer ① | 4 |
| | | Calcium nitrate | 6 |
| Fifth layer | Red-light-sensitive layer | Lime-processed gelatin | 452 |
| | | Light-sensitive silver halide emulsion (1) | 301 |
| | | Magenta coupler C-28 | 420 |
| | | Developing agent D-37 | 336 |
| | | Antifoggant ② | 15 |
| | | High-boiling solvent | 444 |
| | | Surfactant ① | 12 |
| | | Water-soluble polymer ① | 10 |
| Forth layer | Intermediate layer | Lime-processed gelatin | 862 |
| | | Antifoggant ④ | |
| | | Reducing agent ① | 57 |
| | | High-boiling solvent ② | 101 |
| | | High-boiling solvent ⑤ | 9 |
| | | Surfactant ① | 21 |
| | | Surfactant ④ | 21 |
| | | Dispersion of Polymer Latex a | 5 |
| | | Water-soluble polymer ① | 4 |
| | | Calcium nitrate | 6 |

TABLE 22-continued

Constitution of Main Materials of Light-Sensitive Element 101

| Number of layer | Name of layer | Additive | Added amount (mg/m²) |
|---|---|---|---|
| Third layer | Second infrared-light-sensitive layer | Lime-processed gelatin | 373 |
| | | Light-sensitive silver halide emulsion (2) | 106 |
| | | Cyan coupler C-28 | 390 |
| | | Developing agent R-31 | 312 |
| | | Antifoggant ② | 14 |
| | | High-boiling solvent | 412 |
| | | Surfactant ① | 11 |
| | | Water-soluble polymer ① | 11 |
| Second layer | Intermediate layer | Lime-processed gelatin | 862 |
| | | Antifoggant ④ | 7 |
| | | Reducing agent ① | 57 |
| | | High-boiling solvent ② | 101 |
| | | High-boiling solvent ⑤ | 9 |
| | | Surfactant ① | 21 |
| | | Surfactant ④ | 21 |
| | | Water-soluble polymer ② | 25 |
| | | Zinc hydroxide | 750 |
| | | Calcium nitrate | 6 |
| First layer | First infrared-light-sensitive layer | Lime-processed gelatin | 587 |
| | | Light-sensitive silver halide emulsion (3) | 311 |
| | | Yellow coupler C-30 | 410 |
| | | Color-developing agent D-37 | 328 |
| | | Antifoggant | 15 |
| | | High-boiling solvent | 433 |
| | | Surfactant ① | 12 |
| | | Water-soluble polymer ② | 40 |
| | | Hardener ① | 45 |
| Support (a support made by aluminum-evaporation on a PET of 20 μm and further surface-undercoating with gelatin.) | | | |

Then, as a comparative example, for all of yellow, magenta, and cyan, light-sensitive element 102 was prepared in the same manner as light-sensitive element 101, except that developing agents and couplers were changed as shown in Table 23.

TABLE 23

| | Light-sensitive material<br>Light-sensitive element 102 |
|---|---|
| Cyan dye-forming material | Coupler: C-26<br>Developing agent: (a) |
| Magenta dye-forming material | Coupler: C-27<br>Developing agent: (a) |
| Yellow dye-forming material | Coupler: C-30<br>Developing agent: (a) |

After that, as shown in Table 24, gray images were output by the above-mentioned light-sensitive elements of 101 to 102 and image-receiving elements containing compounds (II) of the present invention, under the heating condition of 35 seconds at 83° C. with a digital color printer: a Fujics Pictrography PG-3000, manufactured by Fuji Photo Film Co., Ltd. Clear color images were obtained from the output images.

A transparent film having an ultraviolet-ray-absorbing layer was laid on top of the sample film after the treatment. Then, xenon (100,000 lux) was irradiated on the dye image, with an Atras C.I Weatherometer, for seven days. After the irradiation, the density was measured again, and the percentage of the ratio of the density to the density measured just after the treatment, was indicated as the rate of fading (it means that the higher the value is, the more excellent the fastness to light is), to evaluate light fading. (A reflection densitometer X-rite 304, manufactured by X-rite Co., was used to measure the density.)

Rate of fading=(The density after having been left as it is for 7 days)/(The density just after treatment)×100

The results are shown in Table 24. As is clearly seen from Table 24, it was found that image fastness was excellent when compounds of the present invention were used.

TABLE 24

| Light-sensitive element | Dye-fixing material | Image fastness Rate of fading Cyan | Magenta | Yellow | Remarks |
|---|---|---|---|---|---|
| 102 | R-1 | 50 | 63 | 76 | Comparative example |
| 102 | R-8 | 51 | 61 | 76 | Comparative example |
| 102 | R-13 | 56 | 67 | 77 | Comparative example |
| 101 | R-1 | 56 | 68 | 78 | Comparative example |
| 101 | R-2 | 57 | 69 | 80 | Comparative example |
| 101 | R-3 | 58 | 70 | 82 | Comparative example |
| 101 | R-4 | 55 | 69 | 79 | Comparative example |
| 101 | R-5 | 56 | 70 | 79 | Comparative example |
| 101 | R-6 | 58 | 69 | 79 | Comparative example |
| 101 | R-7 | 60 | 69 | 79 | Comparative example |
| 101 | R-8 | 71 | 82 | 85 | This invention |
| 101 | R-9 | 72 | 81 | 84 | This invention |
| 101 | R-10 | 73 | 83 | 83 | This invention |
| 101 | R-11 | 71 | 81 | 84 | This invention |
| 101 | R-12 | 77 | 84 | 83 | This invention |
| 101 | R-13 | 80 | 88 | 88 | This invention |
| 101 | R-14 | 76 | 83 | 86 | This invention |
| 101 | R-15 | 73 | 82 | 84 | This invention |

Example 2

A light-sensitive element 201 was prepared which had the same composition as the light-sensitive element 101 in Example 1 except that the combinations of the couplers of the first layer, third layer and fifth layer and the developing agents were changed as follows and an auxiliary developing agent ETA-28 was added as shown in the following table 25. The light-sensitive element 101 was treated together with the same dye-fixing materials, R-1 to R-15, that was used in Example 1, in the same manner as in Example 1 to output images. The output images were evaluated for image fastness in the same method as in Example 1.

TABLE 25

| | Light-sensitive element 201 | Amount to be added ($mg/m^2$) |
|---|---|---|
| Fifth layer | Magenta coupler C-23 | 267 |
| | Developing agent D-35 | 308 |
| | Auxiliary developing agent ETA-28 | 81 |
| Third layer | Cyan coupler C-23 | 390 |
| | Developing agent D-37 | 312 |
| | Auxiliary developing agent ETA-28 | 4 |
| First layer | Yellow coupler C-14 | 193 |
| | Developinq aqent D-33 | 162 |
| | Auxiliary developing agent ETA-28 | 4 |

Also, the same procedures that were used for the formation of the light-sensitive element 201 were conducted to prepare a light-sensitive element 202 for comparative use, except that the developing agent and the couplers, for yellow, magenta and cyan, were altered to those shown in Table 26. Using this light-sensitive element 202 and the same dye-fixing material as in Example 1 described in the following Table 27, the image fastness was likewise evaluated.

TABLE 26

| | Light-sensitive material<br>Light-sensitive element 202 |
|---|---|
| Cyan dye-forming material | Coupler: C-18<br>Developing agent: (a) |
| Magenta dye-forming material | Coupler: C-15<br>Developing agent: (a) |
| Yellow dye-forming material | Coupler: C-11<br>Developing agent: (a) |

The results are shown in Table 27. As is clear from Table 27, the image fastness is found to be superior when the compound defined in the present invention are used.

TABLE 27

| Light-sensitive element | Dye-fixing material | Image fastness Rate of fading Cyan | Magenta | Yellow | Remarks |
|---|---|---|---|---|---|
| 202 | R-1 | 49 | 64 | 71 | Comparative example |
| 202 | R-8 | 53 | 63 | 72 | Comparative example |
| 202 | R-13 | 51 | 62 | 74 | Comparative example |
| 201 | R-1 | 55 | 68 | 76 | Comparative example |
| 201 | R-2 | 56 | 69 | 81 | Comparative example |
| 201 | R-3 | 57 | 71 | 81 | Comparative example |
| 201 | R-4 | 55 | 72 | 78 | Comparative example |

TABLE 27-continued

| Light-sensitive element | Dye-fixing material | Image fastness Rate of fading Cyan | Magenta | Yellow | Remarks |
|---|---|---|---|---|---|
| 201 | R-5 | 57 | 70 | 77 | Comparative example |
| 201 | R-6 | 57 | 68 | 78 | Comparative example |
| 201 | R-7 | 61 | 69 | 78 | Comparative example |
| 201 | R-8 | 70 | 85 | 88 | This invention |
| 201 | R-9 | 71 | 86 | 87 | This invention |
| 201 | R-10 | 72 | 87 | 85 | This invention |
| 201 | R-11 | 73 | 86 | 87 | This invention |
| 201 | R-12 | 77 | 89 | 88 | This invention |
| 201 | R-13 | 79 | 89 | 88 | This invention |
| 201 | R-14 | 75 | 85 | 85 | This invention |
| 201 | R-15 | 74 | 84 | 88 | This invention |

Having described our invention as related to the present embodiments, it is our intention that the invention not be limited by any of the details of the description, unless otherwise specified, but rather be construed broadly within its spirit and scope as set out in the accompanying claims.

What is claimed is:

1. An image element wherein a dye, formed by reaction of a coupler with an oxidized product of a compound represented by the following formula (I), and a fixed compound represented by the following formula (II), coexist in a binder on a support:

formula (I)

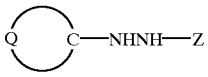

wherein, Z represents a carbamoyl group, a sulfonyl group, or a sulfamoyl group, and Q represents a group of atoms that, together with the C, form an unsaturated ring:

formula (II)

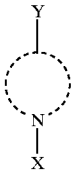

wherein the ring structure containing the N represents a nitrogen-containing nonaromatic ring having at least three ring members, X represents a hydrogen atom, an alkoxy group, an aryloxy group, an oxy radical group, a hydroxyl group, or a group capable of forming an imino group or a hydroxyimino group by hydrolysis, and Y represents a group that is capable of causing chemical reaction with a reactive group contained in the binder, to form a covalent bond.

2. The image element as claimed in claim 1, wherein the compound represented by formula (I) is a compound represented by the following formula (Ia):

formula (Ia)

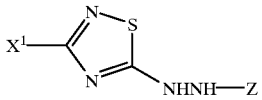

wherein $X^1$ represents a halogen atom, an alkyl group, an aryl group, a heterocyclic group, an alkylthio group, an arylthio group, a heterocyclic thio group, an alkylsulfinyl group, an arylsulfinyl group, an alkylsulfonyl group, an arylsulfonyl group or a sulfamoyl group and Z has the same meanings as defined in the formula (I).

3. The image element as claimed in claim 1, wherein the binder comprises at least one mordant polymer.

4. The image element as claimed in claim 3, wherein the reactive group which can react with Y, to fix the compound represented by the formula (II), is contained in the mordant polymer.

5. The image element as claimed in claim 3, wherein the mordant polymer comprises tertiary nitrogen atoms.

6. The image element as claimed in claim 1, wherein the ring structure containing the N in the formula (II) is a pyrrolidine ring or a piperidine ring.

7. A method of forming a color diffusion transfer image, in which a light-sensitive material having a light-sensitive silver halide, a binder, a compound represented by the following formula (I), and a compound which reacts with an oxidized product of a compound represented by the formula (I) to form or release a diffusion dye, on a support, is developed after exposure, and the formed or released diffusion dye is transferred on a dye-fixing layer, wherein the dye-fixing layer comprises a mordant polymer and a compound represented by the following formula (II):

formula (I)

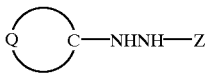

wherein, Z represents a carbamoyl group, a sulfonyl group, or a sulfamoyl group, and Q represents a group of atoms that, together with the C, form an unsaturated ring:

formula (II)

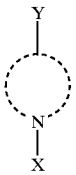

wherein the ring structure containing the N represents a nitrogen-containing nonaromatic ring having at least three ring members, X represents a hydrogen atom, an alkoxy group, an aryloxy group, an oxy radical group, a hydroxyl group, or a group capable of forming an imino group or a hydroxyimino group by hydrolysis, and Y represents a group that is capable of causing chemical reaction with a reactive group contained in a binder, to form a covalent bond.

8. The method of forming a color diffusion transfer image as claimed in claim 7, wherein the compound represented by formula (I) is a compound represented by the following formula (Ia):

formula (Ia)

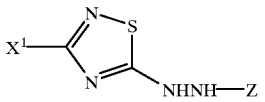

wherein $X^1$ represents a halogen atom, an alkyl group, an aryl group, a heterocyclic group, an alkylthio group, an arylthio group, a heterocyclic thio group, an alkylsulfinyl group, an arylsulfinyl group, an alkylsulfonyl group, an arylsulfonyl group or a sulfamoyl group and Z has the same meanings as defined in the formula (I).

9. The method of forming a color diffusion transfer image as claimed in claim 8, wherein the reactive group which can react with Y, to fix the compound represented by the formula (II), is contained in the mordant polymer.

10. The method of forming a color diffusion transfer image as claimed in claim 8, wherein the mordant polymer contains tertiary nitrogen atoms.

11. The method of forming a color diffusion transfer image as claimed in claim 7, wherein the ring structure containing the N in the formula (II) is a pyrrolidine ring or a piperidine ring.

12. The method of forming a color diffusion transfer image as claimed in claim 7, wherein the development is conducted by heat development.

13. The method of forming a color diffusion transfer image as claimed in claim 12, wherein the heat development is conducted at a temperature from 50 to 250° C.

* * * * *